US010179991B2

(12) United States Patent
Houghton

(10) Patent No.: US 10,179,991 B2
(45) Date of Patent: Jan. 15, 2019

(54) FORMING COLUMN ASSEMBLIES FOR MOMENT RESISTING BI-AXIAL BEAM-TO-COLUMN JOINT CONNECTIONS

(71) Applicant: MITEK HOLDINGS, INC., Wilmington, DE (US)

(72) Inventor: David L. Houghton, Mission Viejo, CA (US)

(73) Assignee: MITEK HOLDINGS, INC., Wilmington, DE (US)

( * ) Notice: Subject to any disclaimer, the term of this patent is extended or adjusted under 35 U.S.C. 154(b) by 0 days.

(21) Appl. No.: 15/284,142

(22) Filed: Oct. 3, 2016

(65) Prior Publication Data

US 2018/0094420 A1 Apr. 5, 2018

(51) Int. Cl.

| | |
|---|---|
| ***E04B 1/24*** | (2006.01) |
| ***E04H 12/08*** | (2006.01) |
| *E04H 9/02* | (2006.01) |

(52) U.S. Cl.

CPC ..... *E04B 1/2403* (2013.01); *E04H 12/08* (2013.01); *E04B 2001/2415* (2013.01); *E04B 2001/2418* (2013.01); *E04B 2001/2448* (2013.01); *E04B 2001/2454* (2013.01); *E04B 2001/2457* (2013.01); *E04H 9/021* (2013.01)

(58) Field of Classification Search

CPC . E04H 12/10; E04H 12/085; E04H 2012/006; E04H 12/08; E04B 1/1903; E04B 2001/1936; E04B 2001/1957; E04B 2001/2415; E04B 1/2403; E04B 1/985; B23K 2201/06; B23K 2201/08; Y10T 29/49623; Y10T 29/49634; Y10T 29/49968; Y10T 29/49936

USPC ..... 52/655.1, 656.1, 656.9, 838; 29/462, 29/463, 525.01

See application file for complete search history.

(56) References Cited

U.S. PATENT DOCUMENTS

| | | | |
|---|---|---|---|
| 674,752 | A | 5/1901 | Baker |
| 2,868,568 | A | 1/1959 | Frye |
| 3,203,150 | A | 8/1965 | Sernebald |

(Continued)

FOREIGN PATENT DOCUMENTS

| | | | |
|---|---|---|---|
| CN | 105888059 | A | 8/2016 |
| FR | 2821395 | A1 | 8/2002 |

(Continued)

OTHER PUBLICATIONS

Search Report from United Kingdom Application No. GB1619732.9, dated May 15, 2017, 5 pages.

(Continued)

*Primary Examiner* — Brian E Glessner
*Assistant Examiner* — Adam G Barlow
(74) *Attorney, Agent, or Firm* — Stinson Leonard Street LLP

(57) ABSTRACT

A method of fabricating a biaxial moment resisting column assembly allows the column assembly to be formed with a minimum of external fixturing. A column of the column assembly functions as a jig for sequentially attaching each gusset plate to the column and in some instances to other gusset plates to form a gusset plate assembly of the column assembly. In some embodiments, all welds used to form the gusset plate assembly are made in the horizontal welding position. Movement of the column to different positions can be achieved by rotation about its longitudinal axis.

40 Claims, 60 Drawing Sheets

(56) References Cited

U.S. PATENT DOCUMENTS 3,382,634 A 5/1968 Shaw
3,691,712 A 9/1972 Bowling et al.
3,716,957 A 2/1973 Bernardi
3,844,124 A 10/1974 Tupper
3,855,748 A * 12/1974 Thomas ..... A63B 9/00 446/115
3,914,063 A 10/1975 Papayoti
3,952,472 A 4/1976 Boehmig
4,012,882 A 3/1977 Juriss et al.
4,014,089 A 3/1977 Sato et al.
4,409,765 A * 10/1983 Pall ..... E04B 1/2403 52/167.1
4,441,289 A 4/1984 Ikuo et al.
4,445,801 A 5/1984 Trudeau
4,551,960 A 11/1985 Fleishman
4,863,305 A 9/1989 Schold
5,148,642 A 9/1992 Plumier et al.
5,244,300 A 9/1993 Perreira et al.
5,660,017 A 8/1997 Houghton
5,680,737 A 10/1997 Sheipline
5,680,738 A 10/1997 Allen et al.
6,022,165 A * 2/2000 Lin ..... E04B 1/2608 403/170
6,073,405 A 6/2000 Kasai et al.
6,138,427 A 10/2000 Houghton
6,219,989 B1 * 4/2001 Tumura ..... E04B 1/2403 52/274
6,237,303 B1 5/2001 Allen et al.
6,516,583 B1 * 2/2003 Houghton ..... E04B 1/24 52/167.3
6,591,573 B2 7/2003 Houghton
6,837,010 B2 1/2005 Powell et al.
6,993,880 B2 2/2006 Cameron et al.
7,021,020 B2 4/2006 Simmons et al.
7,047,695 B2 5/2006 Allen et al.
7,076,926 B2 7/2006 Kasai et al.
7,178,296 B2 2/2007 Houghton
7,225,588 B2 6/2007 Nakamura et al.
7,310,920 B2 12/2007 Hovey, Jr.
7,637,076 B2 12/2009 Vaughn
7,703,244 B2 * 4/2010 Suzuki ..... E04B 1/24 403/169
7,762,038 B2 7/2010 Ceba et al.
7,784,226 B2 8/2010 Ichikawa et al.
7,941,985 B2 5/2011 Simmons
8,122,671 B2 2/2012 Karns
8,146,322 B2 4/2012 Karns
8,205,408 B2 6/2012 Houghton et al.
8,375,652 B2 2/2013 Hiriyur et al.
8,458,980 B2 6/2013 Ivanov
8,468,775 B2 6/2013 Vaughn
8,505,260 B1 8/2013 Chang et al.
8,635,834 B2 1/2014 Houghton et al.
8,640,419 B2 2/2014 Lee
8,915,042 B2 12/2014 Ahn et al.
9,091,065 B2 7/2015 Tran et al.
2002/0124520 A1 9/2002 Bock et al.
2003/0009977 A1 * 1/2003 Houghton ..... E04B 1/2403 52/656.9
2003/0041549 A1 * 3/2003 Simmons ..... E04B 1/2403 52/655.1
2003/0172516 A1 * 9/2003 Glenn ..... B27F 7/003 29/525.01
2003/0208985 A1 11/2003 Allen et al.
2004/0088944 A1 * 5/2004 Simmons ..... E04B 1/2403 52/656.9
2004/0244330 A1 * 12/2004 Takeuchi ..... E04B 1/2403 52/831
2005/0204684 A1 9/2005 Houghton
2006/0144006 A1 * 7/2006 Suzuki ..... E04B 1/2403 52/655.1
2006/0185258 A1 8/2006 Ouellet et al.
2006/0265992 A1 * 11/2006 Hiragaki ..... E04B 1/2403 52/633
2007/0209314 A1 * 9/2007 Vaughn ..... E02D 27/34 52/838
2007/0261356 A1 * 11/2007 Vaughn ..... E02D 27/34 52/655.1
2008/0236071 A1 10/2008 Surowiecki et al.
2008/0289267 A1 11/2008 Sarkisian
2008/0295443 A1 * 12/2008 Simmons ..... E04B 1/24 52/655.1
2009/0025308 A1 * 1/2009 Deans ..... E04B 5/12 52/92.2
2009/0165419 A1 7/2009 Richard et al.
2009/0223166 A1 * 9/2009 Ohata ..... E04B 1/2403 52/699
2010/0043316 A1 2/2010 Karns
2011/0030305 A1 * 2/2011 Karns ..... E04B 1/2403 52/650.1
2011/0047925 A1 3/2011 Gan
2011/0252743 A1 * 10/2011 Yang ..... E04B 1/2403 52/849
2011/0280649 A1 * 11/2011 Dewson ..... F16B 7/187 403/171
2012/0017523 A1 * 1/2012 Ozaki ..... E04H 9/02 52/167.1
2012/0131878 A1 5/2012 Ivanov
2013/0326993 A1 12/2013 Schold
2014/0325932 A1 11/2014 Tran et al.
2015/0275501 A1 10/2015 Houghton

FOREIGN PATENT DOCUMENTS

GB 717744 A 11/1954
GB 1421040 A 1/1976
GB 2036235 A * 6/1980 ..... E04B 1/5831
GB 2036235 A 6/1980
JP S4959307 U 5/1974
JP H0860748 3/1996
JP H10292491 11/1998
JP H0317491 A 12/1998
JP H09189075 A 1/1999
JP H10227063 A 2/2000
JP 2000336772 A 12/2000
JP H11200489 A 1/2001
JP 2002013203 1/2002
JP 2002371627 A 12/2002
JP 2003-74126 3/2003
JP 2010229660 A 4/2012
JP 2013253368 A 6/2015
WO 2004067869 A1 8/2004
WO 2012112608 A2 8/2012
WO 2014085680 A1 6/2014

OTHER PUBLICATIONS

American Institute of Steel Construction, Prequalified Connections for Special and Intermediate Steel Moment Frames for Seismic Applications, ANSI/AISC 358-10, ANSI/AISC 358s1-11, Including Supplement No. 1, 2011, 178 pages, Chicago, Illinois.

American Institute of Steel Construction, Steel Design Guide 4, Extended End-Plate Moment Connections, Seismic and Wind Applications, Second Edition, 166 pages, 2003, United States.

American Institute of Steel Construction, Steel Design Guide Series 16, Flush and Extended Multiple Row, Moment End-Plate Connections, 74 pages, 2002, United States.

Atsushi Sato, et al., Cyclic Behavior and Seismic Design of Bolted Flange Plate Steel Moment Connections, Engineering Journal, Fourth Quarter, 2008, pp. 221-232, United States.

Simpson, Strong Tie, Introduction to the Strong Frame® Special Moment Frame, http://www.strongtie.com/products/strongframe/special_mf/intro.asp, 2014, 3 pages, United States.

Japan Office action, Application No. 2016-246580, dated Jan. 9, 2018, 2 pgs.

Extended European Search Report dated Oct. 27, 2017, Application No. 17167414.6-1601, 8 pages.

Notification of Transmittal of The International Search Report and the Written Opinion of the International Searching Authority, or the

(56) References Cited

OTHER PUBLICATIONS

Declaration, International application No. PCT/IB2017/056014, dated Jan. 25, 2018, 15 pgs.

* cited by examiner

FORMING COLUMN ASSEMBLIES FOR MOMENT RESISTING BI-AXIAL BEAM-TO-COLUMN JOINT CONNECTIONS

CROSS-REFERENCE TO RELATED APPLICATION

This application is related to U.S. application Ser. No. 15/144,414, titled Moment Resisting Bi-Axial Beam-to-Column Joint Connection, which was filed on May 2, 2016, and which is incorporated herein by reference in its entirety for all purposes.

FIELD OF THE INVENTION

The present invention generally relates to moment resisting, bi-axial beam-to-column joint connections, and more particularly to forming a column assembly for a bi-axial beam-to-column moment-resisting joint connection.

BACKGROUND OF THE INVENTION

It has been found in a moment-resisting building having a structural steel framework, that most of the energy of an earthquake, or other extreme loading condition, is absorbed and dissipated, in or near the beam-to-column moment resisting joints of the building.

It is desirable to achieve greater strength, ductility and joint rotational capacity in beam-to-column moment resisting connections in order to make buildings less vulnerable to disastrous events. Greater connection strength, ductility and joint rotational capacity are particularly desirable in resisting sizeable moments in both the lateral and the vertical plane. That is, the beam-to-column moment-resisting connections in a steel frame building can be subjected to large rotational demands in the vertical plane due to interstory lateral building drift. Engineering analysis, design and full-scale specimen testing have determined that prior steel frame connection techniques can be substantially improved by strengthening the beam-to-column connection in a way which better resists and withstands the sizeable beam-to-column, joint rotations which are placed upon the beam and the column. That is, the beam-to-column connection must be a strong and ductile, moment-resisting connection.

Hollow tubular columns are structurally efficient members to use in a variety of building design applications (both structural and architectural), including moment frames. Hollow tubular columns include, but are not limited to, Hollow Structural Section (HSS) columns and built-up box columns. However traditional moment connections types that connect a wide flange ('H' section) beam to a hollow tubular column involve significantly different design considerations than does connecting a wide flange beam to a wide flange column. During loading conditions, the moments in the wide flange beams are resolved into concentrated forces at the beam flanges that must be transferred into the column. The main difference between a hollow tubular column and a wide flange column is how the forces from the beam flanges are transferred into the column webs to be resisted as shear. In a wide flange column, the web is located at the center of the column flange. In a hollow tubular column, the forces from the beam flanges applied to the column face must be transferred to the sidewalls of the column, which act as the webs of the column. For traditional moment connection types that connect a wide flange beam to a hollow tubular column, the side walls of the hollow tubular column facing the beams ("flange walls") must structurally span between the other sidewalls ("webs") of the column to transfer out-of-plane forces from the beam flanges to the column webs. Accordingly, for such traditional moment connection types, the thickness of the flange walls of the hollow tubular column becomes a critical consideration for the out of plane strength and stiffness of the flange walls.

Conventional methods of connecting a hollow tubular column to a wide flange beam must rely on technically uncertain and costly means to transfer significant moment forces to the webs of hollow tubular columns. These current methods are typically used in uniaxial moment frame applications. One such method is directly welding flanges of the wide flange beams to the flange wall faces of a hollow tubular column. This method is self-limiting when the applied moment approaches the full flexural strength of the beam because of the inherent out of plane flexibility of the flange wall thickness of the hollow tubular column. Therefore, the direct welding technique has limited capacity to transfer applied moment forces through out-of-plane bending and shear to the connecting webs of the hollow tubular column.

Another conventional method is through-plate connections wherein the hollow tubular column is cut in two places at each floor level to allow through-plates attached to the top and bottom flanges of the wide flange beam to pass through the column. These through-plates are welded along the full perimeter of the cut sections of the hollow tubular column on both top and bottom faces of each through-plate. These type of connections have proven to be both costly to fabricate and uncertain in their performance when subjected to violent earthquakes. For example, the connection may be inherently susceptible to out-of-plane punching shear failures in the through-plate due to cyclic tensile forces in the column.

Exterior diaphragm plate connections (also known as cut-out plates) are similar to the through-plate connections in that they use flange plates attached to the top and bottom flanges of the beam to transfer the moments. However, in the exterior diaphragm plate connection the hollow tubular column remains continuous and the top and bottom flange plates are made wider than the width of the hollow tubular column to allow for cut openings having a perimeter that surrounds and is attached to the full perimeter of the hollow tubular column. This connection is inherently difficult to fabricate and erect.

Interior diaphragm plate connections consist of shop welded plates that are cut to fit along the inside perimeter of the hollow tubular column, thereby stiffening the flange walls of the hollow tubular column and thus providing a strengthening means to transfer beam flange forces to the sidewall webs of the hollow tubular column. Top and bottom flanges of wide flange beam are directly welded to the flange wall faces of the column. The fabrication of this connection type is difficult because of precise fit up issues and difficulty in access for welding of interior diaphragm plates to inside faces of the hollow tubular column. The performance of this connection type is correspondingly uncertain.

SUMMARY

In one aspect of the present invention, a method of fabricating a column assembly including a hollow tubular column and connected gusset plates configured to form bi-axial moment connections with beams in a building framework is described. The method generally comprises using the column as a jig to locate gusset plates for assembling a gusset plate assembly of the gusset plates. At least some of gusset plates located by the column are connected to the column, and at least some of the gusset plates are connected to each other to form the gusset plate assembly. The connection of the gusset plates to each other is separate from the connection of the gusset plates to the column.

In another aspect of the present invention, a method of fabricating a column assembly including a hollow tubular column and connected gusset plates configured to form bi-axial moment connections with beams in a building framework is described. The method generally comprises placing the column in a first horizontal assembly position. A first of the gusset plates is positioned on an upwardly facing portion of the column placed in the horizontal position so that the first gusset plate is supported in a horizontal orientation on the column in the first horizontal assembly position of the column. The first gusset plate is joined to the column in the first horizontal assembly position of the column. A second of the gusset plates is mated with the first gusset plate such that the second gusset plate is supported by the first gusset plate in a vertical orientation. A third of the gusset plates is mated with the first gusset plate such that the third gusset plate is supported by the first gusset plate in a vertical orientation. The column is rotated about a longitudinal axis of the column to a second horizontal assembly position, and a fourth of the gusset plates is mated with the second and third gusset plates such that the fourth gusset plate is supported by the second and third gusset plates. The first, second, third and fourth gusset plates are rigidly interconnected with each other on the column.

Other objects and features of the present invention will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
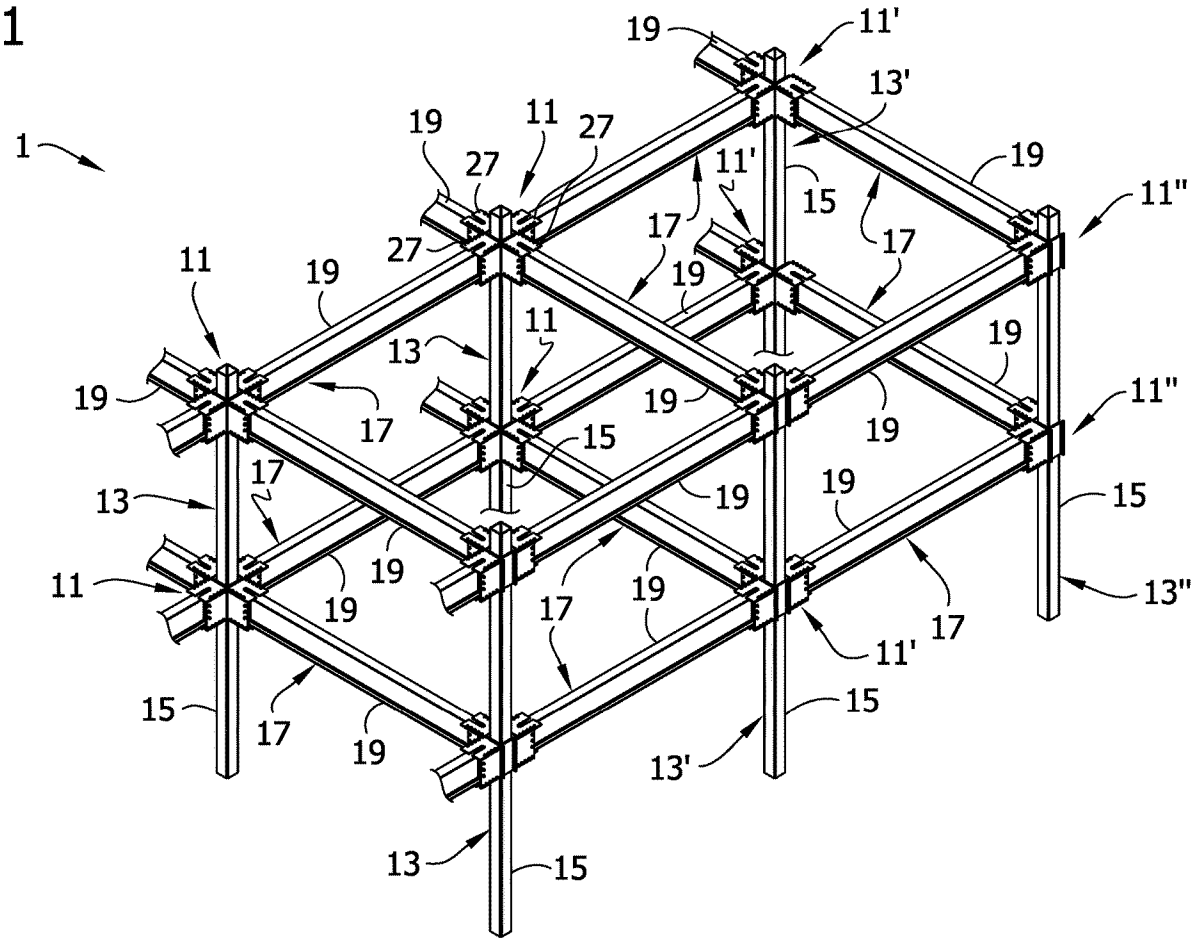
FIG. 1 is a diagrammatic fragmentary perspective of a building framework.
Figure 2:
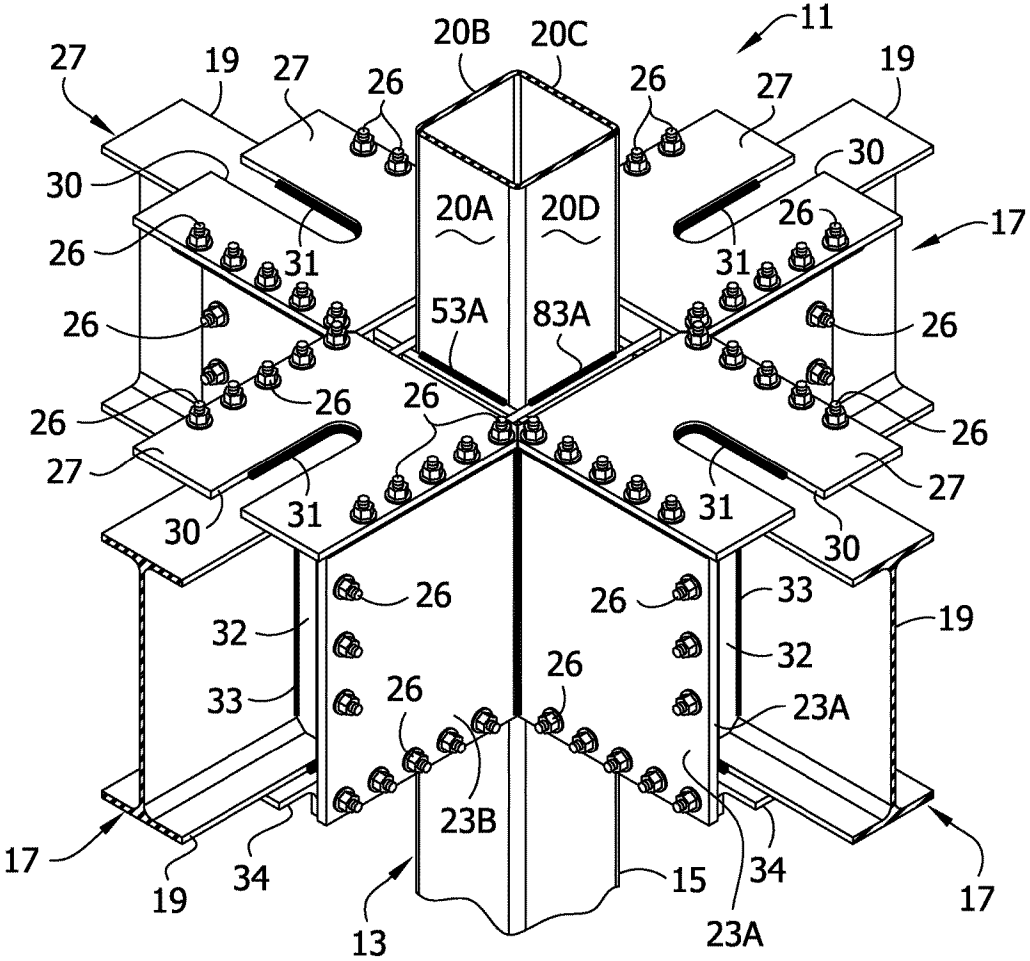
FIG. 2 is a fragmentary perspective of a four-sided bi-axial beam-to-column joint connection structure including a column assembly.
Figure 3:
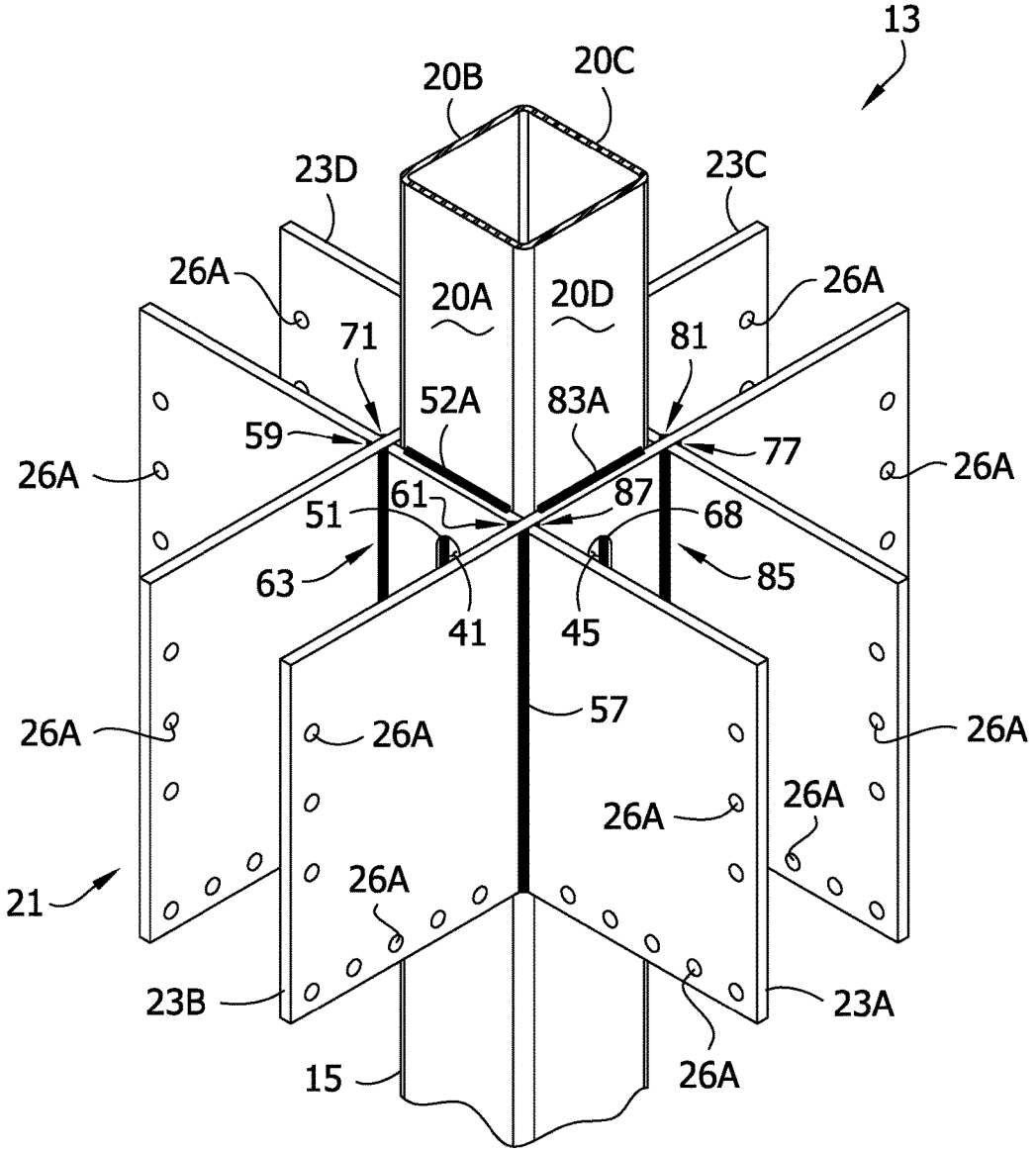
FIG. 3 is a fragmentary perspective of the column assembly.
Figure 5:
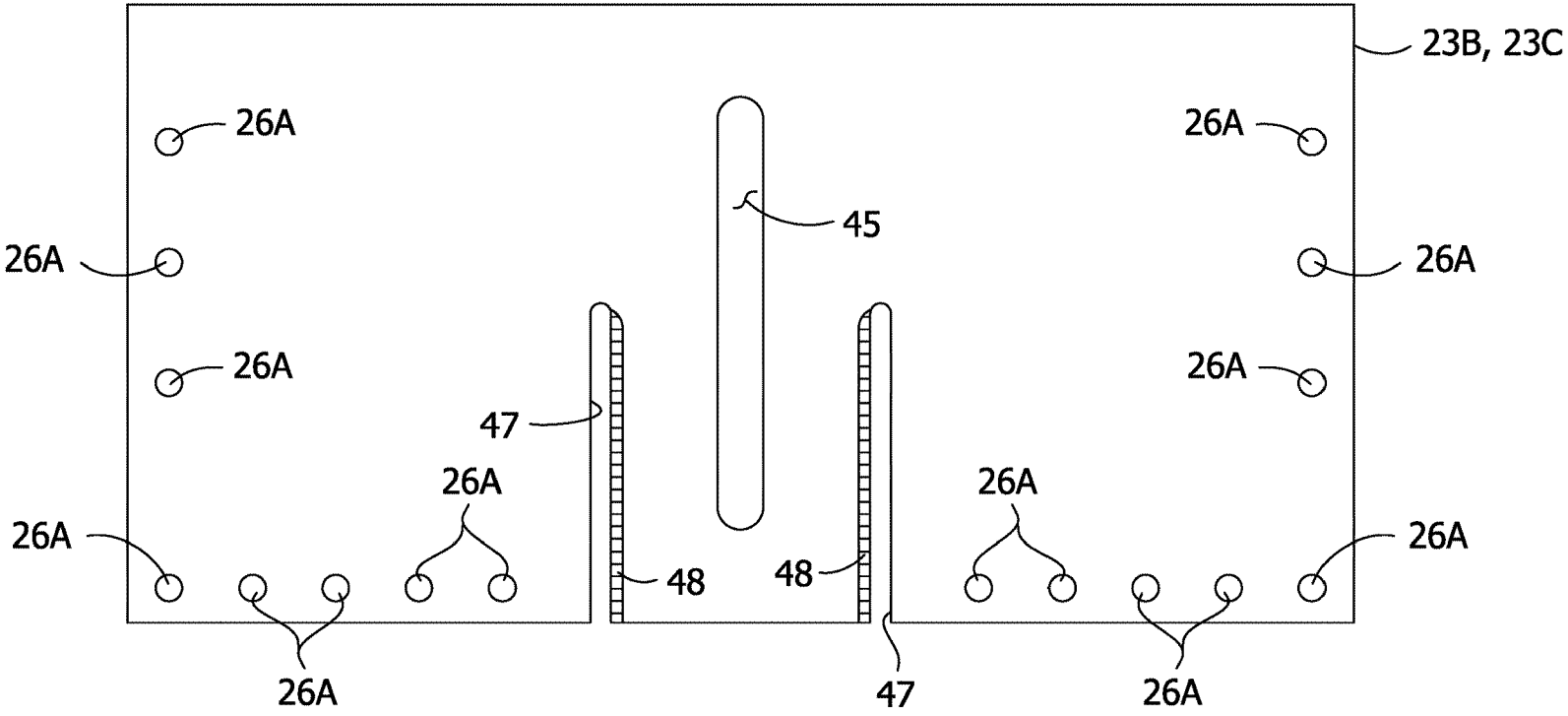
FIG. 5 is a front elevation of a second gusset plate of the gusset plate assembly.
Figure 16:
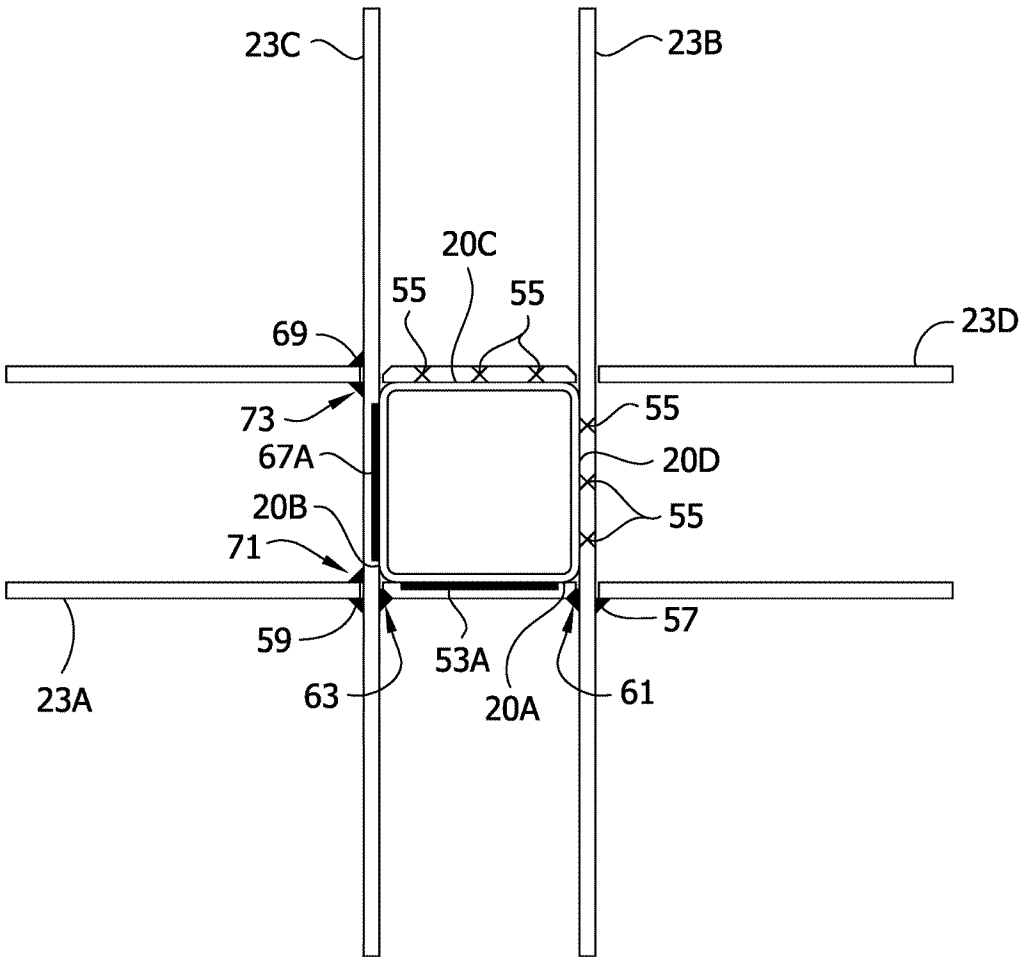
FIG. 16 is the end elevation of FIG. 13 rotated counter-clockwise 90° to a third assembly position.

Referring to FIGS. 1-3, a bi-axial beam-to-column moment-resisting joint connection structure including a column assembly is generally indicated at 11. The joint connection structure may be used in the construction of a building framework 1 (see, FIG. 1). In the illustrated embodiment, the joint connection structure joins a column assembly 13 including a column 15 to a plurality of full-length beam assemblies 17 each including a full-length beam 19. A full-length beam is a beam that has a length sufficient to extend substantially the full-length between adjacent columns in a structure. Thus, a stub and link beam assembly as shown in FIGS. 5 and 16 of U.S. Pat. No. 6,138,427, herein incorporated by reference, is not a full-length beam. However, it will be understood that the present invention may be used with stub and link beams and other beams that are not full-length beams. It will be understood that the beams 19 in FIG. 2 have been broken away, but are full-length beams. The beams 19 may have any suitable configuration, such as an I-beam, H-beam configuration, or hollow rectangular shape (built-up box member or HSS tube section).

In the illustrated embodiment of FIG. 2, the joint connection structure has a 4-sided/4-beam configuration whereby four full-length beam assemblies 17 are configured to be attached to the column assembly 13. However, as may be seen in FIG. 1, other joint connections 11', 11" using column assemblies 13', 13' involving three beams and two beams are also employed in the framework 1. The construction of the beam assembly 13', 13" may be closely similar to what is described for column assembly 13. It will be understood that some of the column assemblies 13, 13', 13" in the framework may have a construction different than that described for column assembly 13 herein. In the illustrated embodiment, column 15 is an HSS tube section structure having a rectangular (broadly, "polygonal") cross section defined by four column faces 20A, 20B, 20C and 20D. However, the column 15 may have other configurations, such as a built-up box member, and in general will be referred to as a hollow tubular column. As illustrated herein, the column 15 comprises an enclosed rectangular wall including opposing planar wall members.

The global moment-resisting frame design configuration of the building framework 1 can, as needed, provide a distributed moment-resisting space frame wherein all or most beam-to-column connections are moment-resisting in each principal direction of the building. This bi-axial beam-to-column moment resisting framework 1 is in contrast to conventional building frameworks which may use fewer discretely located uniaxial moment frames throughout a building foot print in each principal direction of the building. The global frame structure that is framework 1 is a beam-to-column framing system that maximizes structural redundancy in the lateral load resisting system of a multi-story building to increase resistance to progressive collapse scenarios when subjected to, for example, terrorist bomb blast and other catastrophic load environments. Other configurations are possible. For example, another cost-effective framework (not shown) constructed according to the principles of this invention can include fewer but discretely located biaxial moment resisting joint connections. Such a framework can achieve similar performance objectives while minimizing the number of required moment-resisting beam-to-column joints to be constructed, which in turn reduces construction costs.

Referring to FIG. 3, the column assembly 13 includes a collar like gusset plate assembly 21 for attaching the column assembly to the beam assemblies 17, similar to what is shown in co-assigned U.S. patent application Ser. No. 15/144,414, filed May 2, 2016. A unique method of fabricating the column assembly 13 using the column 15 as a jig for building up the gusset plate assembly 21 in an ordered sequence, one gusset plate at a time, will be described in more detail hereinafter. The gusset plate assembly 21 comprises a plurality of gusset plates 23A, 23B, 23C and 23D connected to the column 15 and extending laterally outward from the column. The gusset plates 23A-23D extend within planes generally parallel to a longitudinal axis of the column 15, and include bolt holes 26A for receiving bolts 26 to connect the full-length beam assemblies 17 to the column assembly 13 (FIG. 2). A first pair of spaced apart parallel, vertically and horizontally extending gusset plates 23A, 23D sandwich the column 15 and co-axially extending beams 19. The first pair of gusset plates 23A, 23D extends laterally outward from the column 15 in opposite directions along a first column axis and defines spaces for receiving end portions of beams 19 for mounting respective beam assemblies 17 to the column assembly 13 via the gusset plate assembly 21. A second pair of spaced apart parallel, vertically and horizontally extending gusset plates 23B, 23C sandwich the column 15 and co-axially extending beams 19. The second pair of gusset plates 23B, 23C extends laterally outward from the column 15 in opposite directions along a second column axis extending orthogonally to the first axis. The second pair of gusset plates 23B, 23C defines spaces for receiving end portions of beams 19 for mounting respective beam assemblies 17 to the column assembly 13 via the gusset plate assembly 21. The first and second pairs of gusset plates each intersect a single plane perpendicular to the longitudinal axis of the column 15. In the illustrated embodiment, the gusset plate assembly 21 is constructed and arranged so that four, co-planar beams 19 are connected to the column 15.

Figure 4:
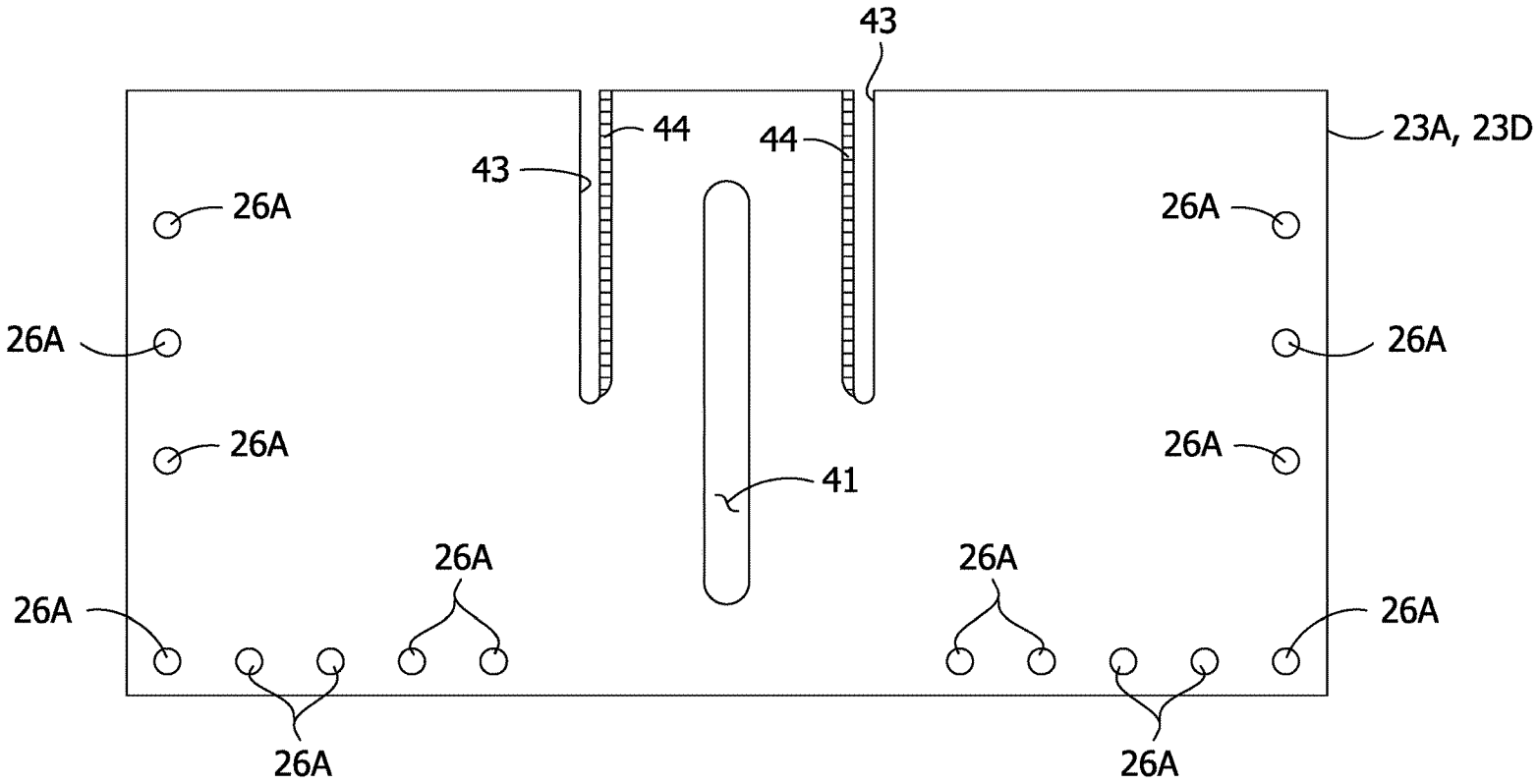
FIG. 4 is a front elevation of a first gusset plate of a gusset plate assembly.

The gusset plates 23A, 23D have the same construction in the illustrated embodiment. FIG. 4 shows one gusset plate, but is designated by both 23A and 23D to indicate that the construction is the same for both. As illustrated in FIG. 4, the first gusset plate 23A is shown as it would appear when looking toward a face 20A of the column 15, and fourth gusset plate 23D is shown as it would appear when looking toward the face 20C of the column. The gusset plate 23A, 23D is shown to include a closed interior aperture 41 (broadly, "elongate opening") having an edge defining a closed loop encompassing the aperture. The gusset plate 23A, 23D also has a pair of open slots 43 flanking the interior aperture 41. The open slots 43 extend from a top of the gusset plate 23A, 23D, where they open upwardly from the gusset plates, to an interior of the gusset plates. One edge margin of the gusset plate 23A, 23D defining an edge of the open slot 43 forms a bevel 44 that facilitates welding as will be described hereinafter. In the illustrated embodiment the open slots 43 extend about half the depth of the gusset plate 23A, 23D. The gusset plates 23B, 23C have the same construction as each other but differ from gusset plates 23A, 23D on account of the different orientation these plates will assume in the gusset plate assembly 21. FIG. 5 shows one gusset plate, but is designated by both 23B and 23C to indicate that the construction is the same. As shown in FIG. 5, second gusset plate 23B is seen as it would appear looking toward the face 20D of the column, and third gusset plate 23C is seen as it would appear looking toward the face 20B of the column. The gusset plate 23B, 23C includes a closed interior aperture 45 (broadly, "elongate opening") of substantially the same construction as the aperture 41, and a pair of open slots 47 flanking the interior aperture. The open slots 47 extend from a bottom of the gusset plates 23B, 23C, where they open downwardly from the gusset plates, to an interior of the gusset plates. One edge margin of each open slot 47 defining an edge of the slot forms a bevel 48 that facilitates welding between mated gusset plates as will be described more fully. The open slots 43, 47 of the gusset plates 23A, 23D and 23B, 23C allow the gusset plates to be assembled with each other and onto the column 15 in an ordered sequential manner, gusset plate by gusset plate, as will be described hereinafter.

Figure 1A:
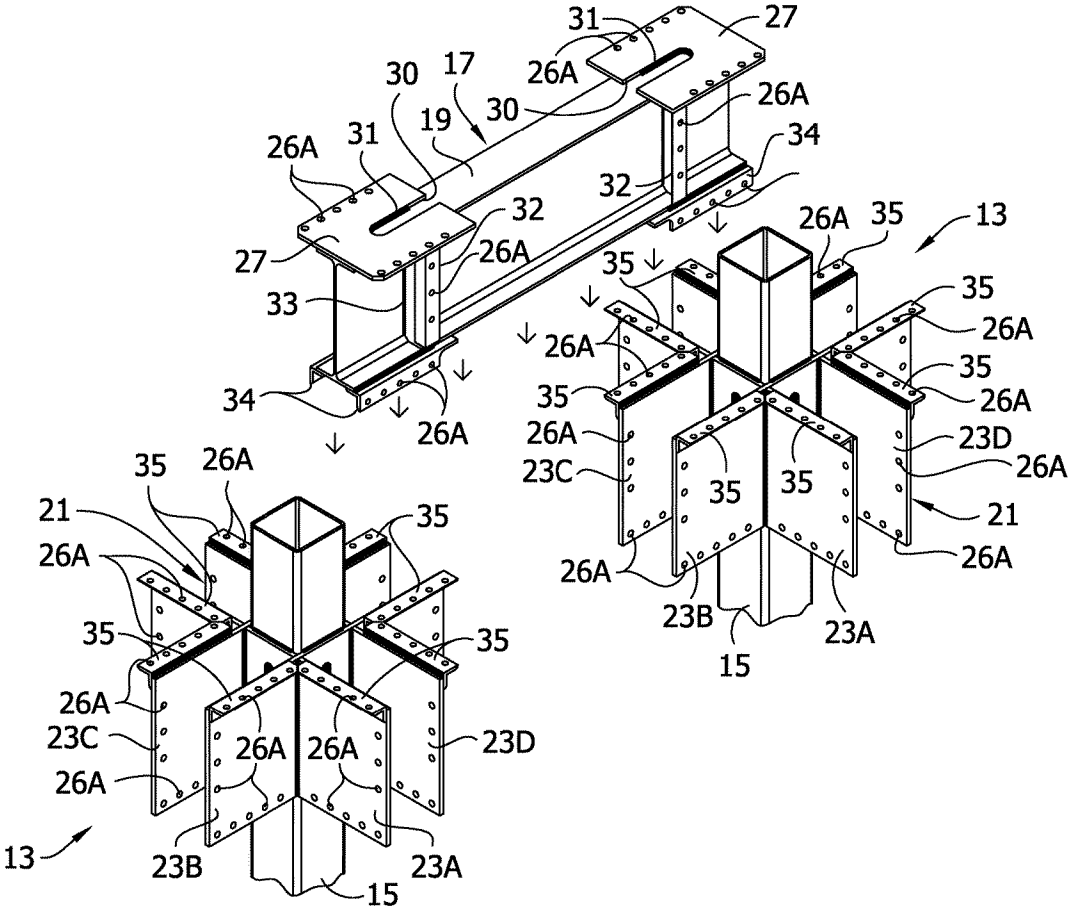
FIG. 1A is a fragmentary perspective showing a full-length beam assembly being lowered into connection with adjacent column assemblies in the framework.

Referring to FIGS. 1, 1A and 2, horizontal cover plates 27 are disposed on top of and attached to an end of the beams 19. The cover plates 27 have a width that is greater than a width of the respective beam 19 and a horizontal spacing between the associated gusset plate pair 23A, 23D and between associated gusset plate pair 23B, 23C. As shown in FIG. 1A, the configuration of the cover plates 27 allows the full-length beams 19 to be lowered between the gusset plates 23B, 23C of respective column assemblies 13 so that each end of the full-length beam assembly 17 is initially supported in bearing between the cover plate 27 and the top edge of the horizontal extension of the gusset plates 23 of the column assembly 13. In other words, the beams 19 are self-shoring. In the illustrated embodiment, the cover plates 27 may rest on a top face of a projecting horizontal leg of upper angle irons 35 attached in a suitable manner such as by welding to the exterior faces of gusset plates 23A-23D. The cover plates 27 extend along the length of their respective beams 19 and terminate at or just beyond the ends of the gusset plates 23A-23D. The cover plates 27 each have an oblong radiused slot opening 30 extending along the length of the cover plate and opening at one edge of the cover plate. U-shaped fillet welds 31 in the slot openings 30 connect the cover plates 27 to the upper flanges of the beams 19. It will be understood that the cover plates 27 may have other widths, configurations and slot-type oblong openings. For example, a cover plate (not shown) may have no slot opening 30 or a fully enclosed slot opening. Vertical shear plates 32 (only two of which are shown) are attached in a suitable manner such as by fillet welds 33 to the web of the beam 19 on both sides of the web.

The beam assembly 17 is attached by bolts 26 to the column assembly 13 (FIG. 2). More particularly, bolts 26 are received through holes 26A in the cover plates 27 and aligned bolt holes 26A in the upper angle irons 35. Lower angle irons 34 welded to the lower flange of the beam 19 receive bolts 26 that also pass through holes 26*a* in the gusset plates 23A-23D. In addition, bolts 26 are received through holes 26A in the gusset plates 23A-23D and through holes 26A in the vertical shear plate element 32 for transferring beam shear to the resisting gusset plate 23A-23D. The vertical shear plate element 32 has a suitable configuration, such as that of a vertically oriented angle iron. Other configurations (not shown) for connection of a beam assembly to a column assembly including gusset plates may be used within the scope of the present invention. For example and without limitation, a beam assembly could be formed with the locations of the cover plate 27 and angle irons 34 reversed in vertical position from what is shown in FIG. 1A. With the cover plate on the bottom of the beam, the beam assembly can be field erected by raising it so that ends of the beam assemblies are received between corresponding pairs of gusset plates. This is the opposite of what is illustrated in FIG. 1A, where the beam assembly 17 is lowered into place between the gusset plates 23A, 23B of the column assemblies 13. An advantage of this embodiment is that it allows non-structural building systems, such as electrical conduit, mechanical ductwork, piping and sprinkler systems that typically run perpendicular to the beam 19 to be attached to the bottom flanges of beams.

The joint connection structure 11 outlined above is a bi-axial beam-to-column moment resisting type structure. The structure 11 provides for a full-length beam assembly connection along four sides of hollow tubular column 15. Each of the components of the joint connection structure 11, as well as the beam 19 and column 15, are preferably made of structural steel. Some of the components of the joint connection structure 11 are united by welding and some by bolting. All of the welding may be performed at a fabrication shop. The bolting may all be performed at the construction site, which is the preferred option in many regions of the world. However, it will be understood that the beam assembly 17 can be connected to the column assembly 13 in other suitable ways such as by field welding, or in an all-bearing beam-to-column moment resisting connection, as shown in FIG. 140 of coassigned U.S. patent application Ser. No. 14/729,957, the disclosure of which is incorporated herein in its entirety by reference.

Figure 6:
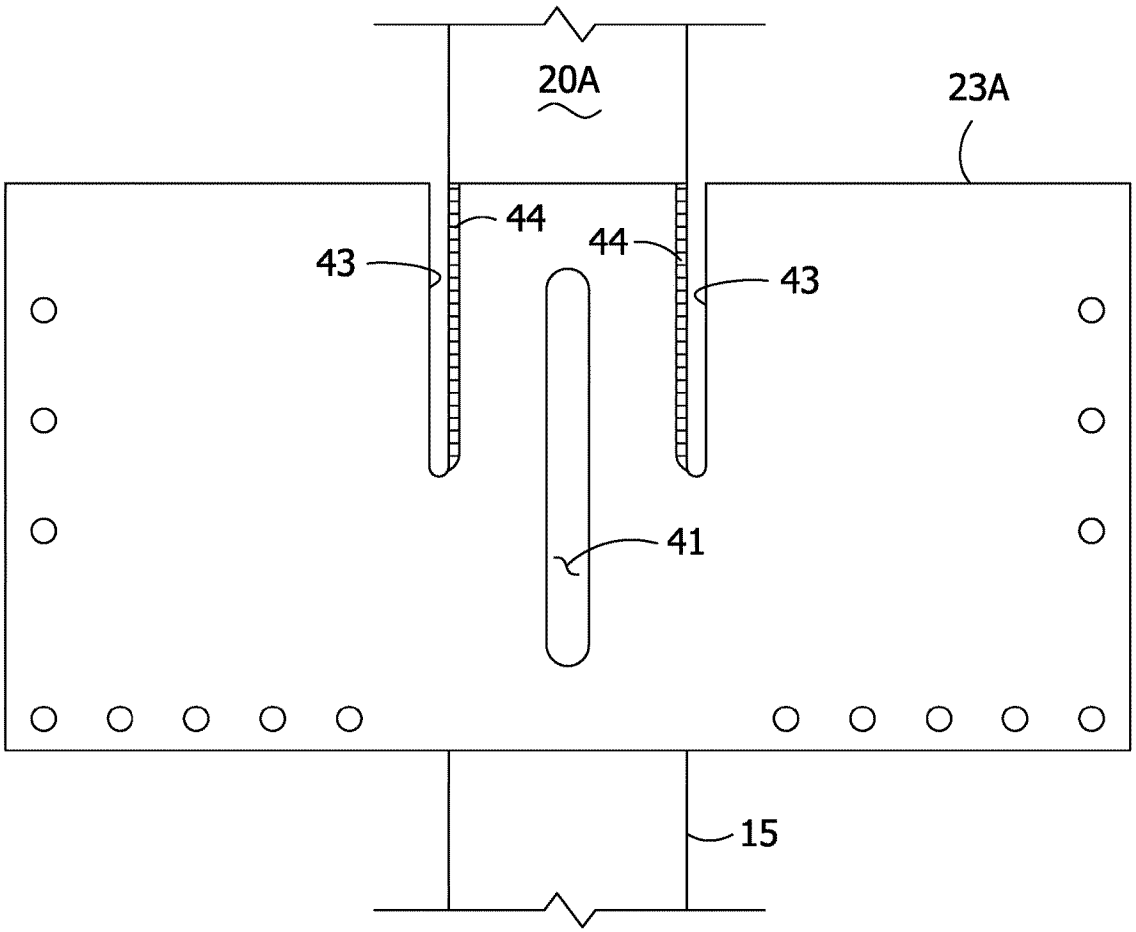
FIG. 6 is a fragmentary top plan view of a column having the first gusset plate laid on top of the column that is placed in a horizontal position in a first horizontal assembly position for initiating construction of a gusset plate assembly on the column.
Figure 7:
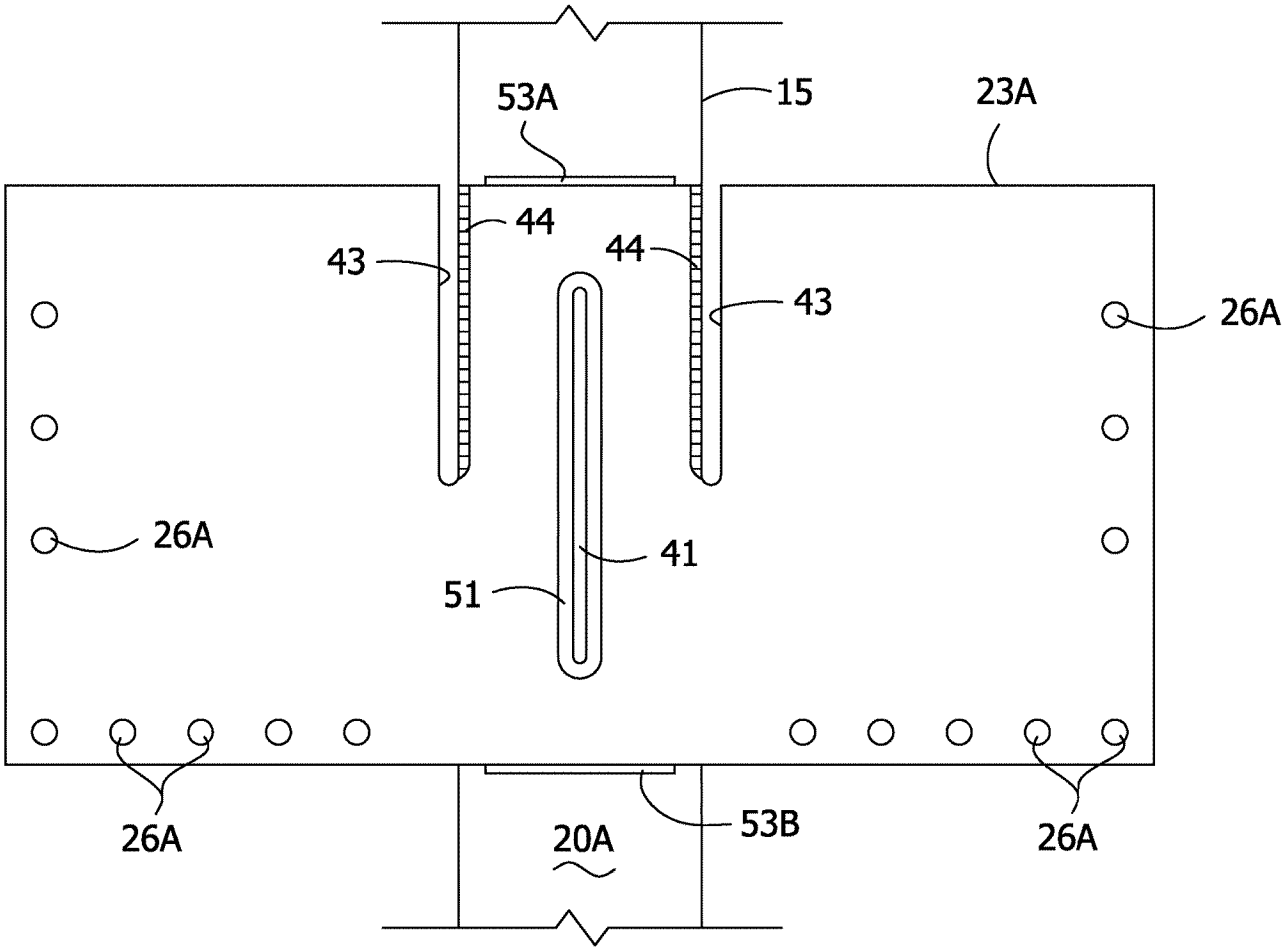
FIG. 7 is the top plan view of FIG. 6 showing first and second fillet welds made to connect the first gusset plate to the column.
Figure 8:
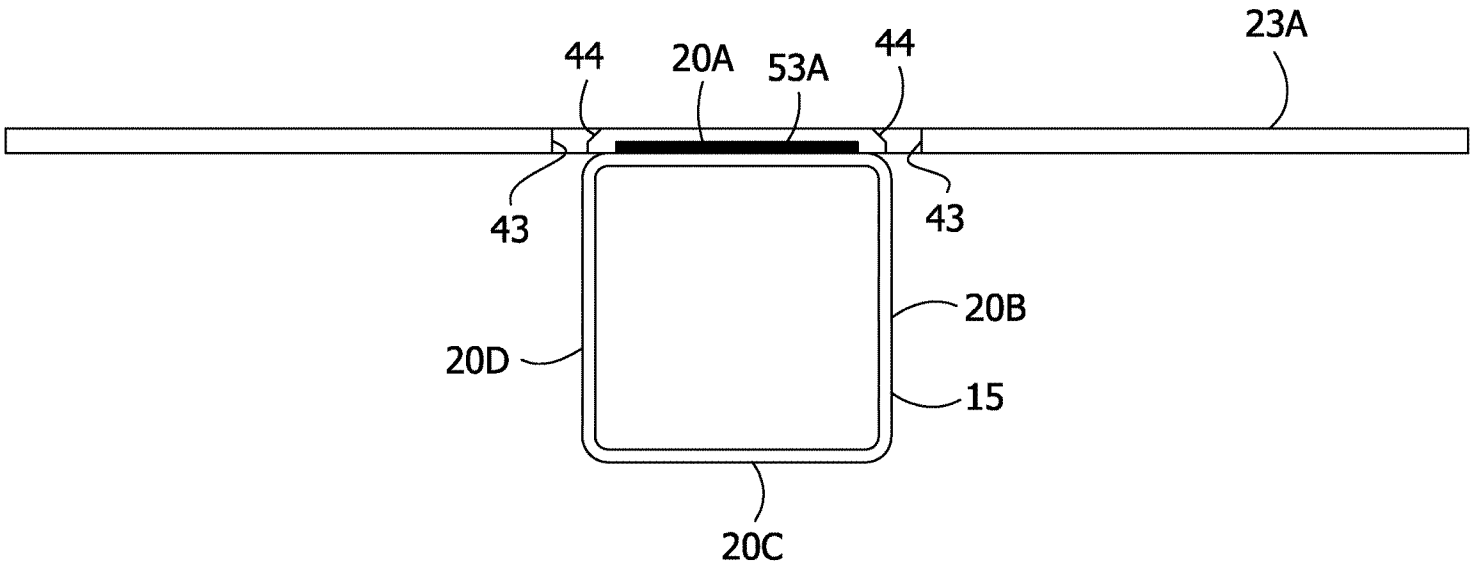
FIG. 8 is an end elevation of the column and first gusset plate of FIG. 7.

Referring to FIGS. 6-21, the column assembly 13 may be fabricated at a fabrication shop and later transported to the construction site. Formation of the gusset plate assembly 21 can be efficiently carried out using the column 15 as a jig, and with all welds made in the horizontal welding position. The horizontal welding position is the preferred welding position over other possible welding positions such as vertical and overhead welding positions, because of its ease of weld metal deposition, and because of its inherent high level of weld quality and certainty. However, some or all of the welding could be done in lesser preferred welding positions within the scope of this invention. In some instances welding in a flat welding position may be employed. This desirable welding position could present certain challenges in handling the column and jigging the gusset plates, but could be used. The column is first oriented in a horizontal assembly position and the first gusset plate 23A is placed on top of the upwardly facing column surface 20A, as shown in the top plan view of FIG. 6. In this first horizontal assembly position, tack welds (not shown) could be used as needed to temporarily secure the gusset plate 23A on the face 20A of the column 15. Referring to FIGS. 7 and 8, the gusset plate 23A is permanently attached to the surface 20A of the column 15. A fillet weld 51 is formed around the entire perimeter of the interior aperture 41, and linear fillet welds 53A, 53B are made along opposite edges of the gusset plate 23A that are spaced apart along the longitudinal axis of the column 15. Welds 51, 53A, 53B are all made in the horizontal welding position. The fillet welds 53A, 53B are transverse to the longitudinal axis of the column 15. The first gusset plate 23A is disposed in a horizontal position on the column 15 when it is welded to the column.

Figure 9:
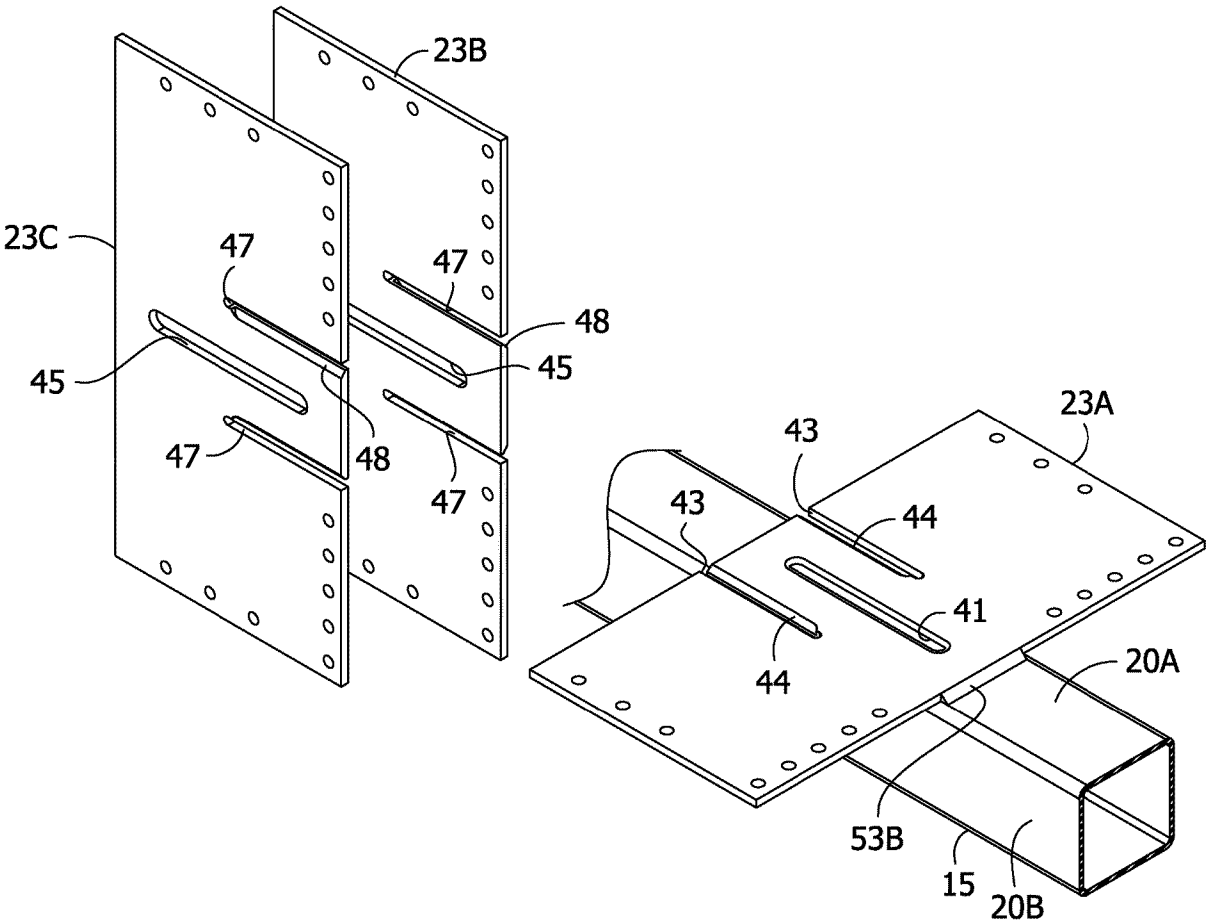
FIG. 9 is a fragmentary perspective of the column and first gusset plate of FIG. 7, illustrating mating second and third gusset plates with the first gusset plate.
Figure 9A:
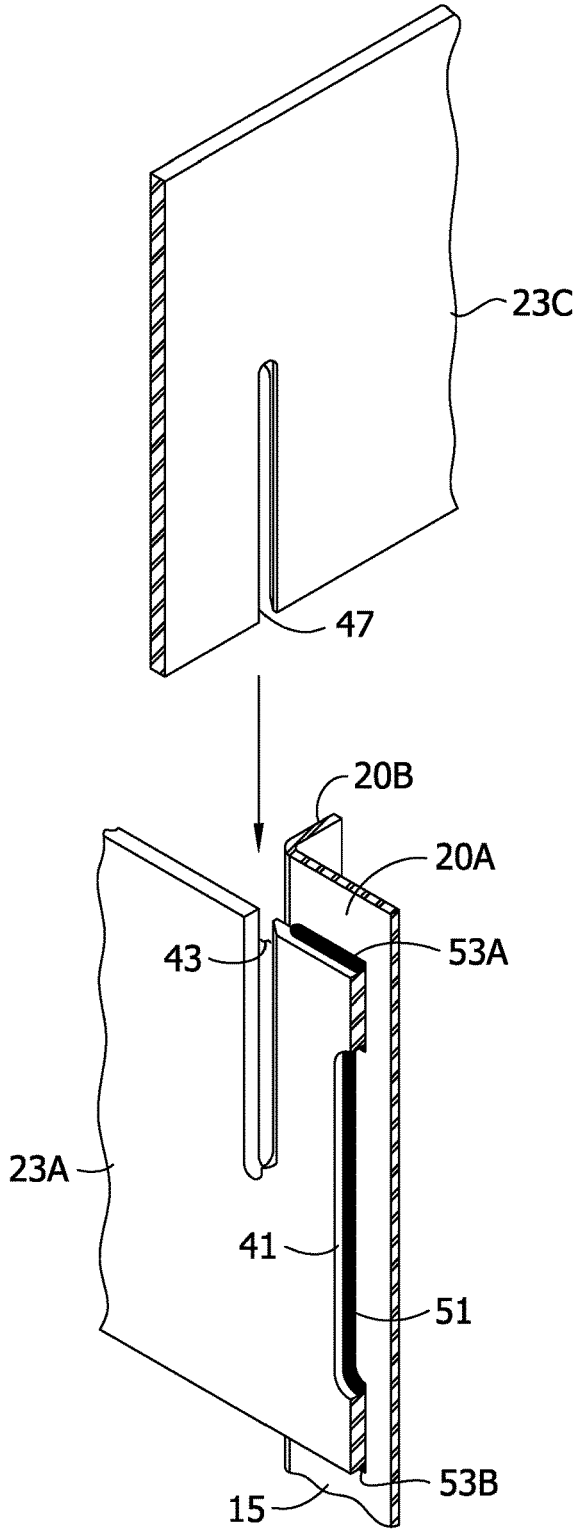
FIG. 9A is a top and right side fragmentary perspective similar to FIG. 9 and illustrating mating the third gusset plate with the first gusset plate.
Figure 9B:
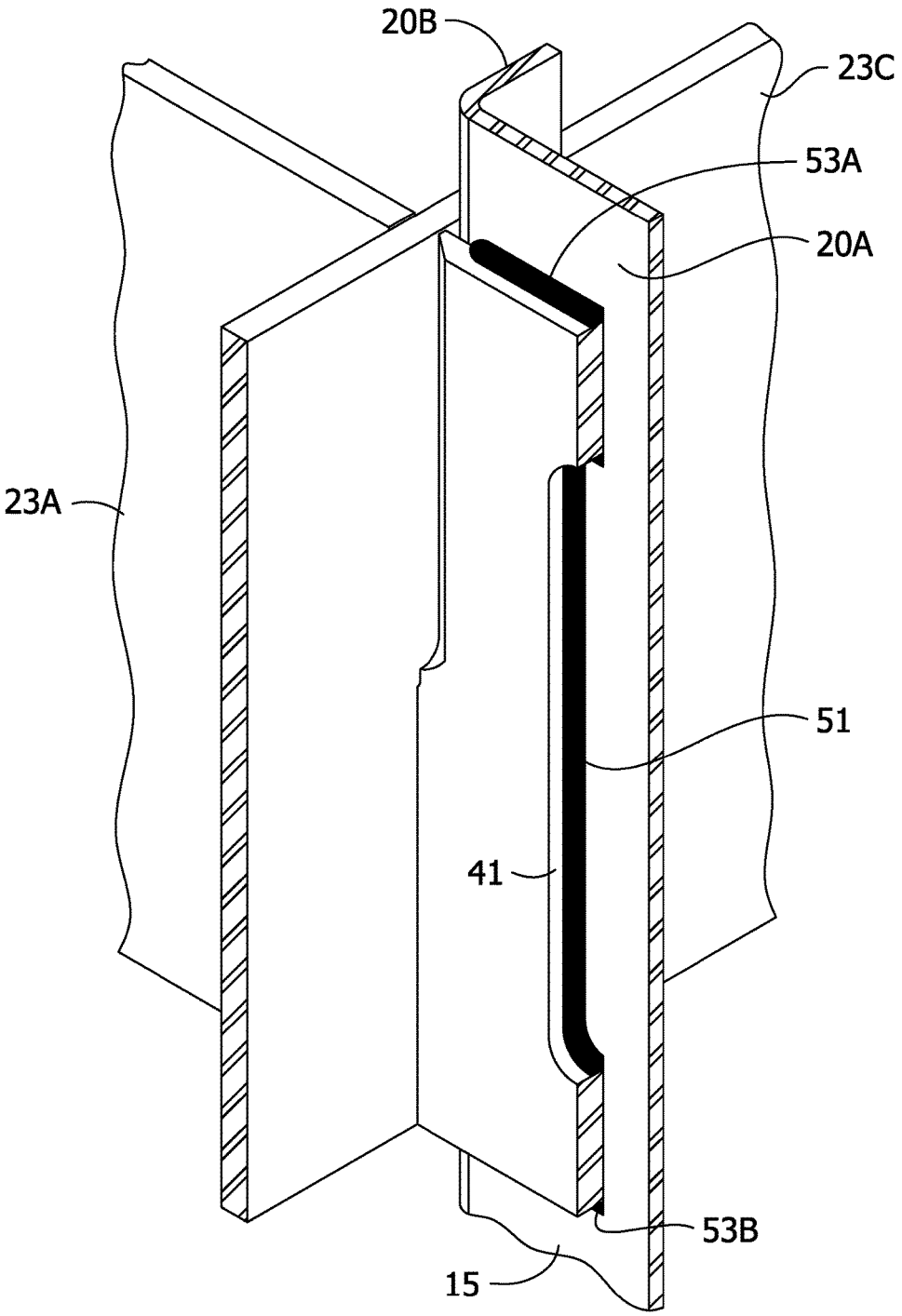
FIG. 9B is the fragmentary perspective of FIG. 9 showing the third gusset plate mated with the first gusset plate.

As illustrated in FIG. 9, gusset plates 23B, 23C are supported (shored) on the gusset plate 23A by inserting an upper one of the open slots 47 in each of the gusset plates 23B, 23C into a respective one of the open slots 43 in the gusset plate 23A. FIG. 9A shows the insertion of a gusset plate 23C along its open slot 47 into a respective open slot 43 of the gusset plate 23A on a larger scale and from a different vantage than FIG. 9. As fully mated, each of the open slots 43 in the gusset plate 23A receives a portion of a respective one of the gusset plates 23B, 23C (see, FIG. 9B, showing the mated portions of gusset plate 23C with gusset plate 23A), which provides temporary shoring of gusset plates 23B, 23C by gusset plate 23A prior to fixedly connecting the gusset plates 23B, 23C to the gusset plate 23A. By using the column 15 as an alignment jig, all three of the gusset plates 23A, 23B, 23C are substantially axially aligned on the column 15.

Figure 10:
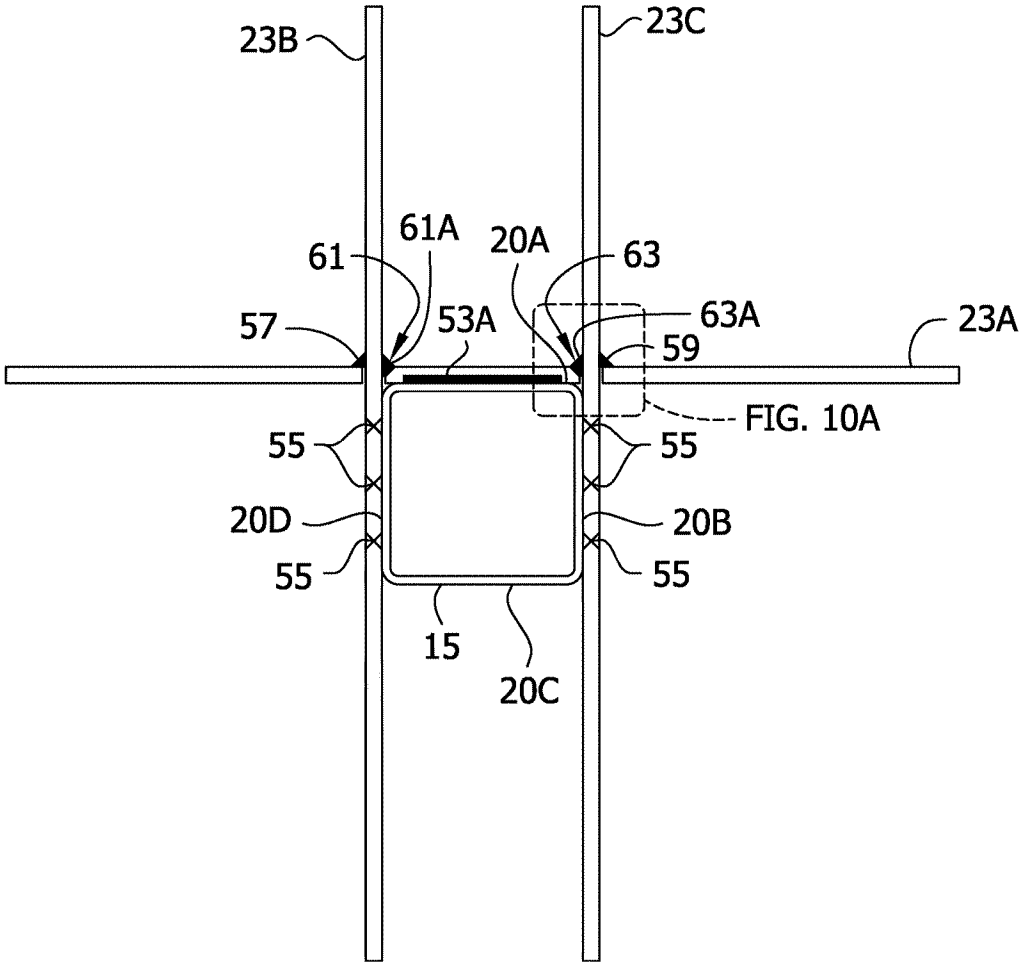
FIG. 10 is an end elevation of the column and first, second and third gusset plates, illustrating additional welds formed to connect the second and third gusset plates to the first gusset plate and to the column.
Figure 10A:
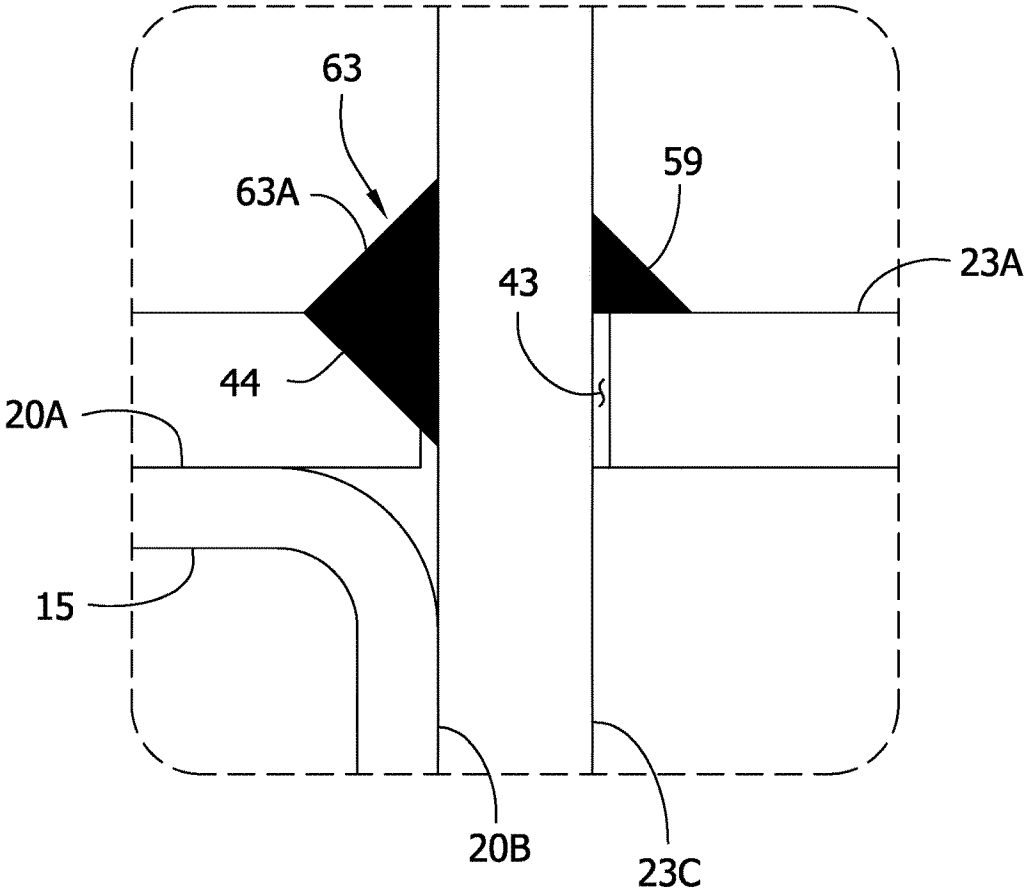
FIG. 10A is an enlarged fragment of the end elevation of FIG. 10 showing welds in the upper right hand corner of the column and attached gusset plates.
Figure 10B:
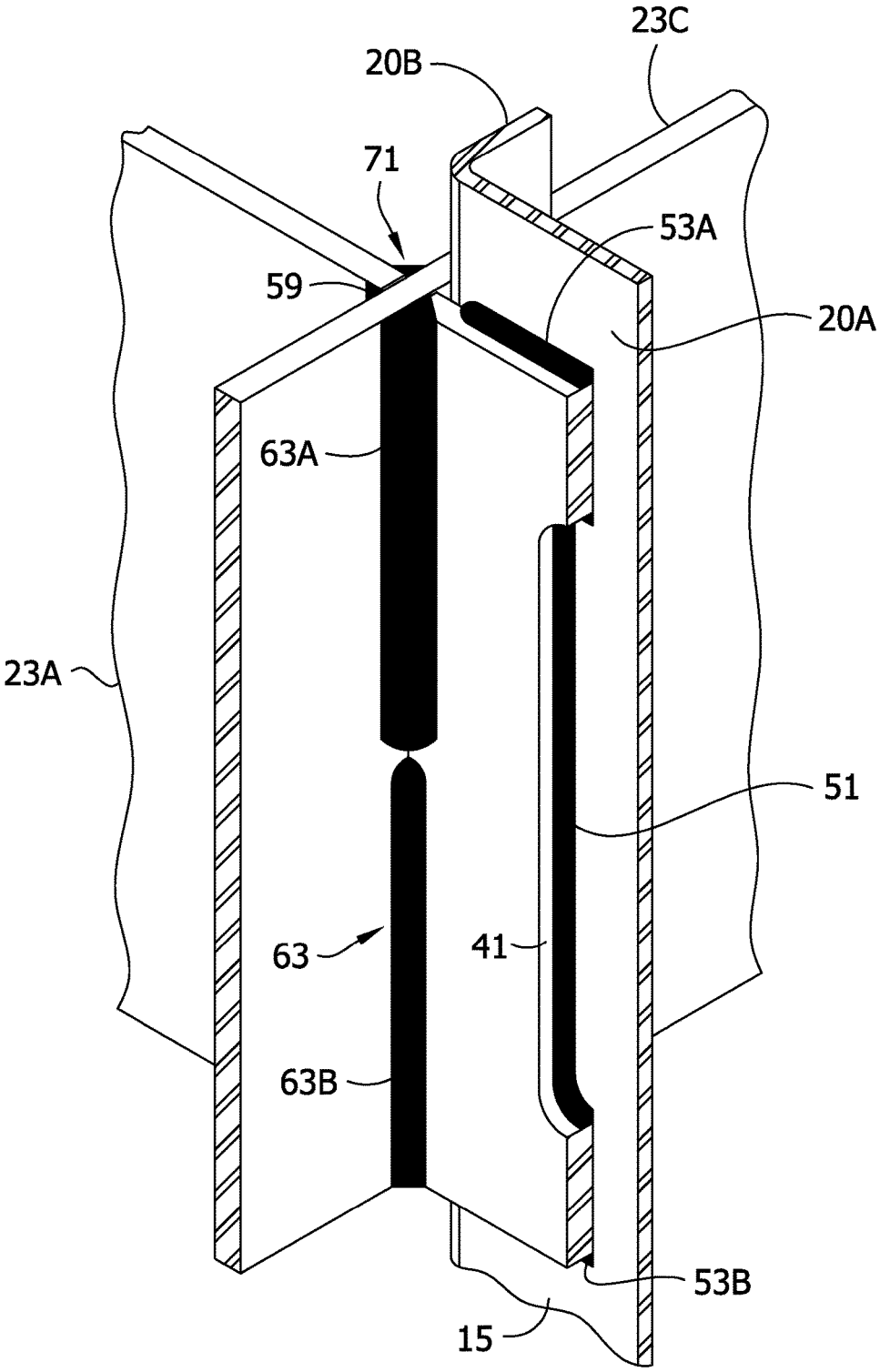
FIG. 10B is a fragmentary perspective of the subassembly shown in FIG. 10 showing completed welds between the first and third gusset plates.
Figure 11:
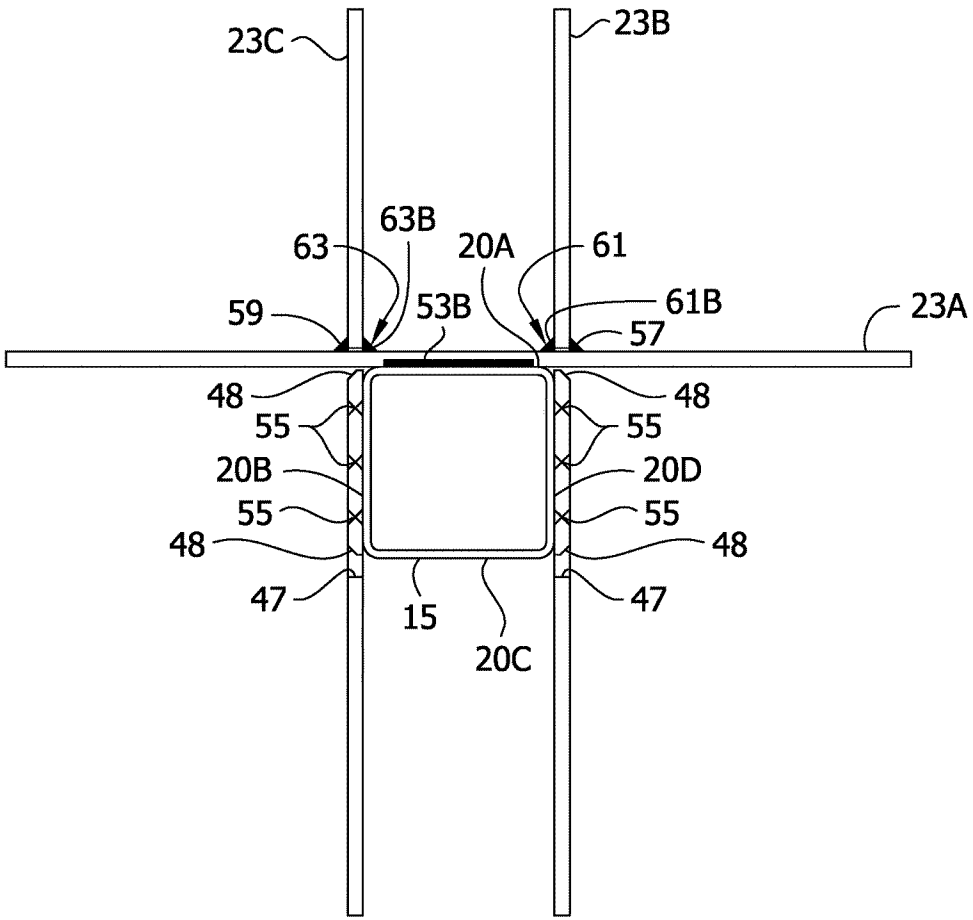
FIG. 11 is an elevation as seen from the opposite end of the column from that shown in FIG. 10.

After the gusset plates 23B, 23C are supported on the gusset plate 23A in this manner, and plumbness and orthogonal alignment have been achieved, the gusset plates 23B, 23C are temporarily attached by tack welds 55 to respective faces 20D, 20B of the column 15, as shown in FIG. 10. A fillet weld 57 made in the horizontal welding position extends the full depth of the gusset plates to join gusset plate 23B to gusset plate 23A as shown in FIGS. 10 and 11. Likewise, fillet weld 59 is made in the horizontal welding position and extends the full depth of the gusset plates to join gusset plate 23C to gusset plate 23A. A weld 61 located between the gusset plates 23B, 23C and adjacent to face 20A connects the gusset plate 23B to the gusset plate 23A, and another weld 63 between the gusset plates 23B, 23C connects the gusset plate 23C to the gusset plate 23A. The welds 61, 63 are made in the horizontal welding position and extend the full depths of the gusset plates 23A, 23B, 23C to permanently join gusset plate 23B to gusset plate 23A and also join gusset plate 23C to gusset plate 23A. Referring to FIGS. 10, 10A and 11, each of the welds 61, 63 includes two types of welds along their lengths. Where the welds 61, 63 extend along the bevels 44 of the open slots 43 in the gusset plate 23A, they each comprise a partial joint penetration (PJP) groove weld with reinforcing fillet weld, designated 61A, 63A, respectively, as shown in FIG. 10. In the illustrated embodiment, each of the joint penetration groove welds is a single bevel partial joint penetration (PJP) groove weld in a T-joint configuration with a reinforcing fillet weld, as may be seen in FIGS. 10A and 10B. FIG. 10A is an enlarged fragment of the upper right hand corner of the column 15 showing in greater detail bevel 44 and the profile of the single-bevel partial joint penetration groove weld 63A. Away from the bevels 44, the welds 61, 63 are simply fillet welds 61B, 63B, as may be seen in FIG. 11 illustrating the column 15 from the opposite end from that shown in FIG. 10. There may be a slight break in the continuities of the welds 61, 63 between the types of welds 61A, 61B and 63A, 63B. However, the welds 61, 63 may be continuous.

Figure 12:
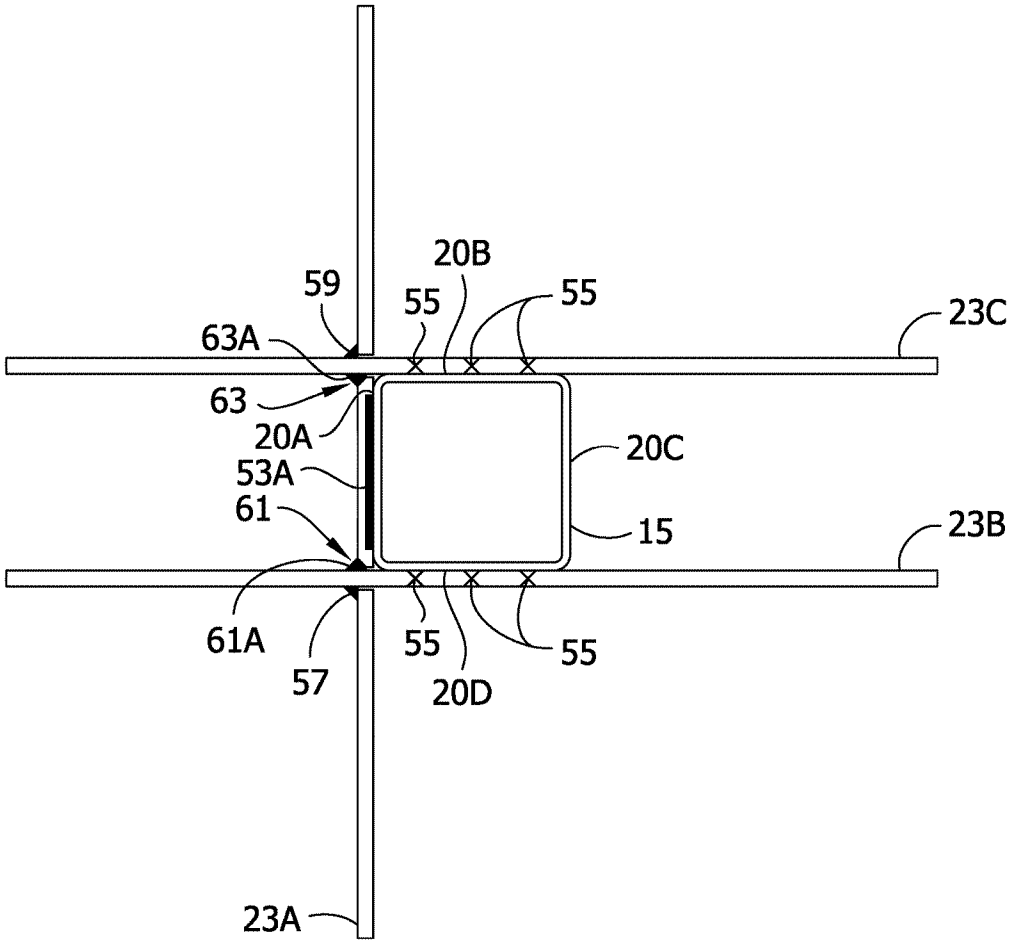
FIG. 12 is the end elevation of FIG. 10 rotated counter-clockwise 90° to a second assembly position.
Figure 13:
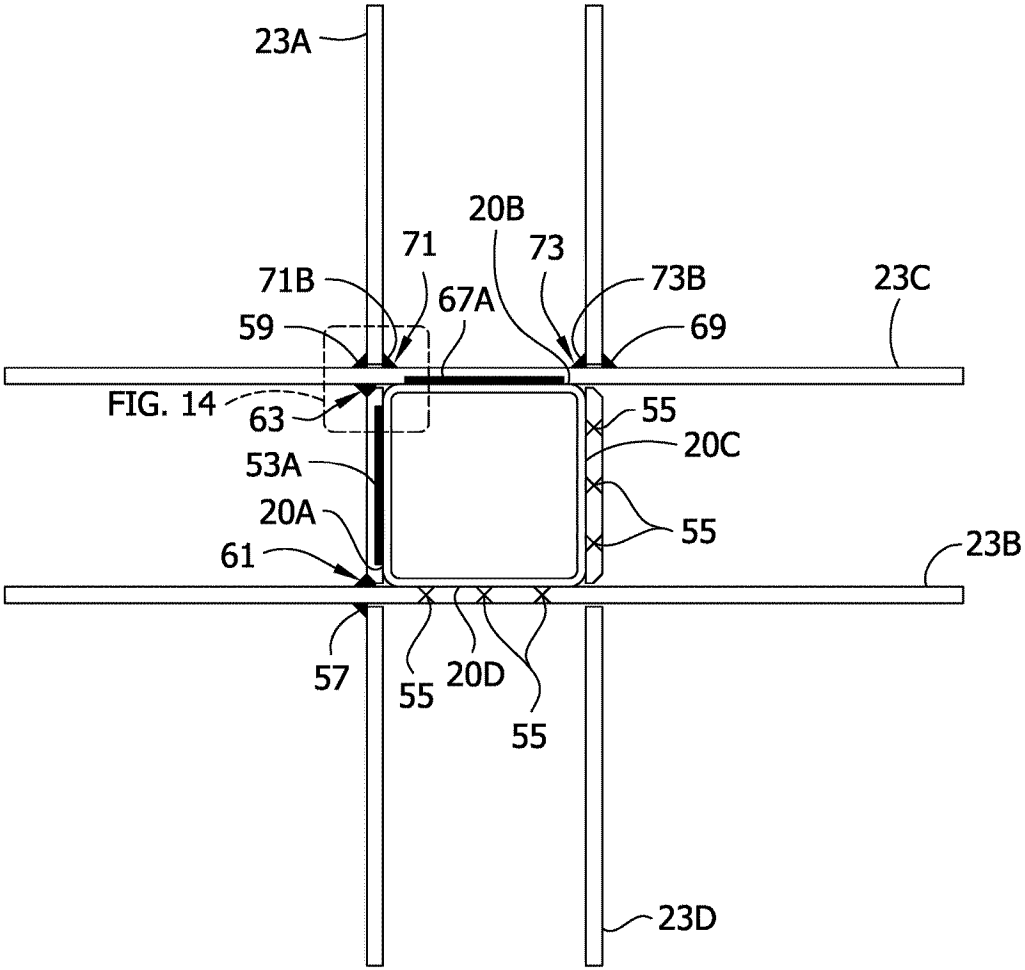
FIG. 13 is the end elevation of FIG. 12 illustrating the connection of a fourth gusset plate to the second and third gusset plates and welds connecting the fourth gusset plate to the third gusset plate.
Figure 14:
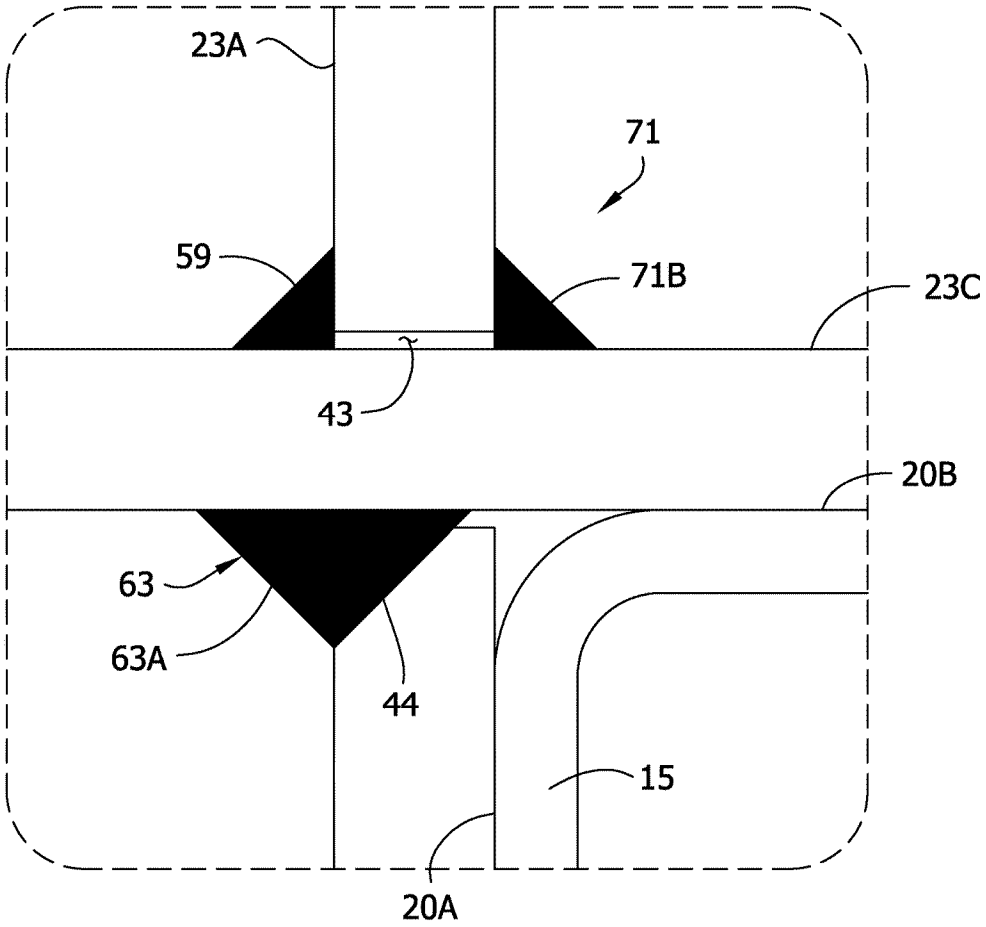
FIG. 14 is an enlarged fragment of the end elevation of FIG. 13 showing welds in the upper left hand corner of the column and attached gusset plates.
Figure 15:
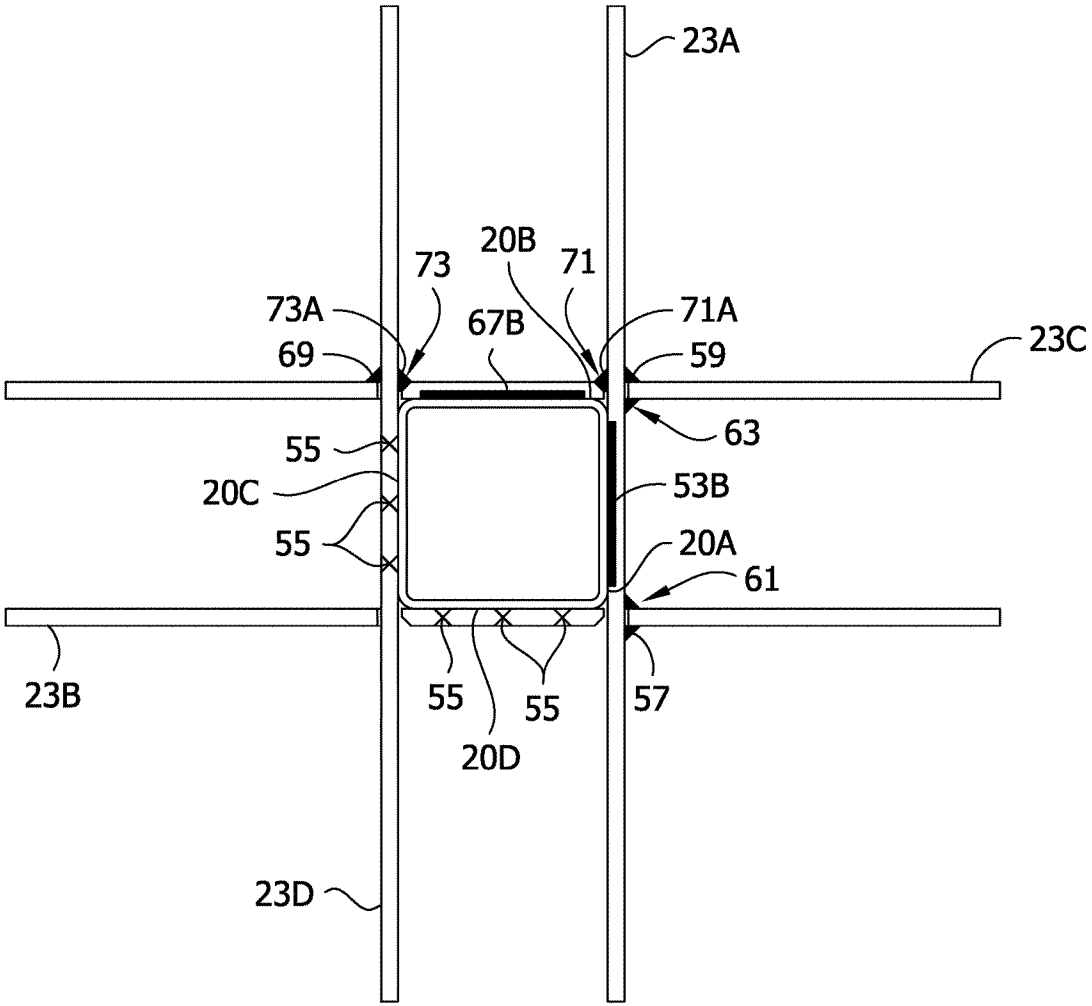
FIG. 15 is an elevation as seen from the opposite end of the column from that shown in FIG. 13.

Following formation of the welds 57, 59, 61, 63, the column 15 still in its horizontal position is rotated 90° in a counterclockwise direction from its position shown in FIG. 10, to a second horizontal assembly position shown in FIG. 12. In the second assembly position, gusset plate 23C is now oriented on the top side of the column 15, flush against the face 20B. The final gusset plate 23D of the gusset plate assembly 21 can be slid onto the gusset plates 23B, 23C in the same way gusset plates 23B, 23C were mated with gusset plate 23A (see, FIG. 13). The open slots 43 on the gusset plate 23D receive and are received by respective open slots 47 on the gusset plates 23B, 23C. Gusset plates 23B, 23C provide temporary shoring of gusset plate 23D. Again, the column 15 is used as a jig to that, as fully seated in the open slots 47 of gusset plates 23B, 23C, the gusset plate 23D is substantially axially aligned along the column with all of the other gusset plates 23A-23C. Tack welds 55 are used to temporarily secure gusset plate 23D to the face 20C of the column 15. Fillet welds 67A, 67B are made in the horizontal welding position along axially opposite edges of the gusset plate 23C to the face 20B of the column 15 in directions transverse to the longitudinal axis of the column (see FIGS. 13 and 15). A fillet weld 68 (FIG. 3) is also made in the horizontal welding position around the perimeter of interior aperture 45 of gusset plate 23C, similar to the weld 51 for the gusset plate 23A shown in FIG. 7. The third gusset plate 23C has a horizontal position on the column 15 when it is welded to the column. Fillet weld 69 is made in the horizontal welding position, extends the full depths of the gusset plates 23C, 23D and joins these two gusset plates together. Welds 71 and 73 located between the gusset plates 23A, 23D adjacent to the face 20B also extend the full depths of the gusset plates 23A, 23C, 23D and join respective pairs of the gusset plates together. The welds 71, 73 are made in the horizontal welding position and each includes two different forms of welds along its length. Where the weld 71 extends along the bevel 44 in the open slot 47 of the gusset plate 23C it comprises a partial joint penetration (PJP) groove weld with reinforcing fillet weld, designated 71A (FIG. 15). Away from the bevel 48, the weld 71 is a standard fillet weld 71B (FIG. 13). Similarly, where the weld 73 extends along the bevel 48 in the gusset plate 23C it is a partial joint penetration (PJP) groove weld with reinforcing fillet weld, designated 73A (FIG. 15). Away from the bevel 48, the weld 73 comprises a standard fillet weld 73B (FIG. 13). FIG. 14 enlarges the upper left hand corner of the column 15 and intersecting gusset plates 23A, 23C to show the partial joint penetration (PJP) groove weld with reinforcing fillet weld 63A in greater detail. The weld 63A is the same as all the other partial joint penetration (PJP) groove welds with reinforcing fillet welds used in the construction of the column assembly 13.

Figure 17:
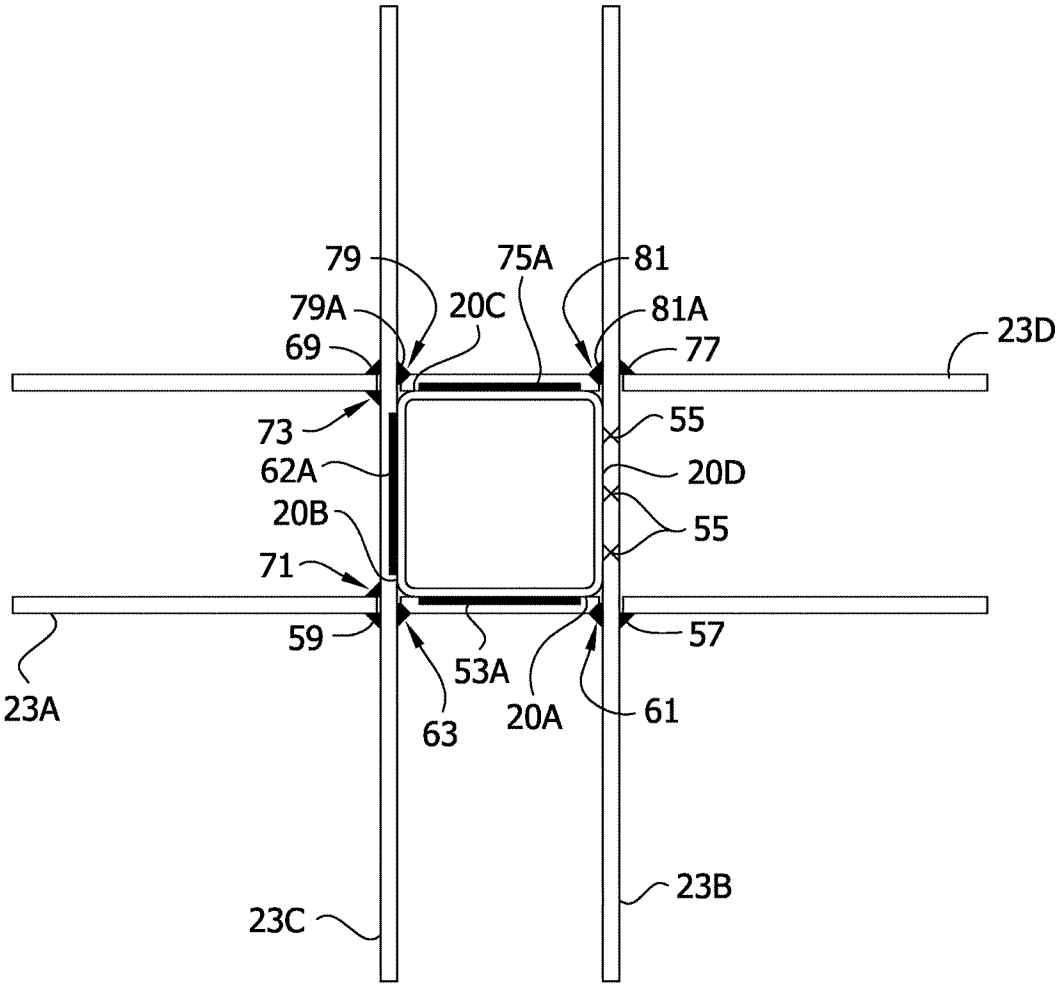
FIG. 17 is the end elevation of FIG. 16 illustrating welds connecting the fourth gusset plate to the second and third gusset plates.
Figure 18:
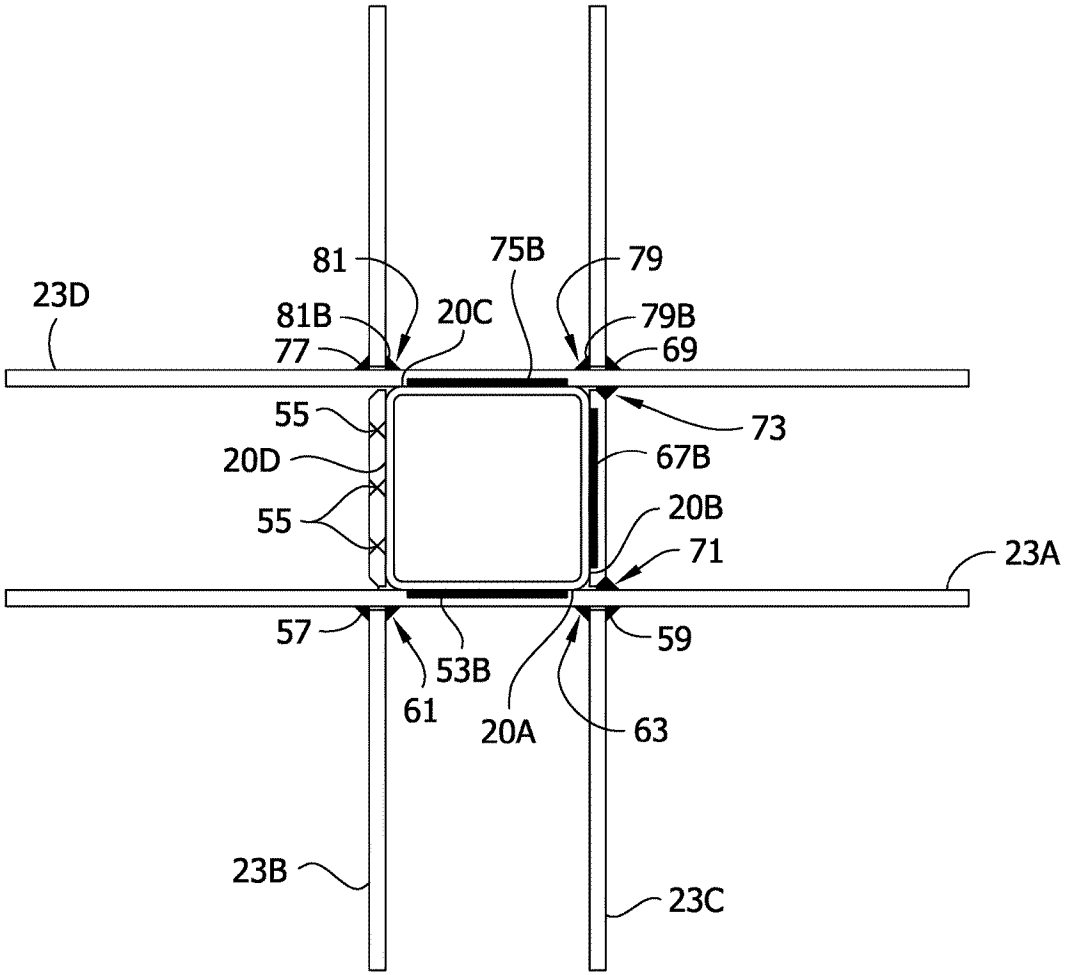
FIG. 18 is an elevation as seen from the opposite end of the column of FIG. 17.

After completion of the welds 69, 71 and 73 connecting gusset plate 23C to gusset plates 23A and 23D, the column 15 is rotated counterclockwise 90° from its position in FIG. 13 to a third (horizontal) assembly position shown in FIG. 16. Referring to FIGS. 17 and 18, fillet welds 75A, 75B are then made in the horizontal welding position along axially opposite edges of the gusset plate 23D to the face 20C of the column 15, in directions transverse to the longitudinal axis of the column. A fillet weld (not shown) is also made in the horizontal welding position around the perimeter of interior aperture 41 of gusset plate 23D, similar to the weld 51 for the gusset plate 23A shown in FIG. 7. The fourth gusset plate 23D has a horizontal position on the column 15 when it is welded to the column. Fillet weld 77 extends the full depths of the gusset plates 23B, 23D and joins these gusset plates together. Between the gusset plates 23B, 23C, welds 79 and 81 also extend the full depths of the gusset plates 23B, 23C, 23D and join them together. Welds 77, 79, 81 are all welded in the horizontal welding position. The welds 79, 81 each include two different forms of welds along its length. Where the weld 79 extends along the bevel 44 in the open slot 43 of the gusset plate 23D it comprises a partial joint penetration (PJP) groove weld with reinforcing fillet weld, designated 79A (FIG. 17). Away from the bevel 44, the weld 79 is a standard fillet weld 79B (FIG. 18). Similarly, where the weld 81 extends along the bevel 44 in the gusset plate 23D is a partial joint penetration (PJP) groove weld with reinforcing fillet weld, designated 81A (FIG. 17). Away from the bevel 44, the weld 81 comprises a standard fillet weld 81B (FIG. 18).

Figure 19:
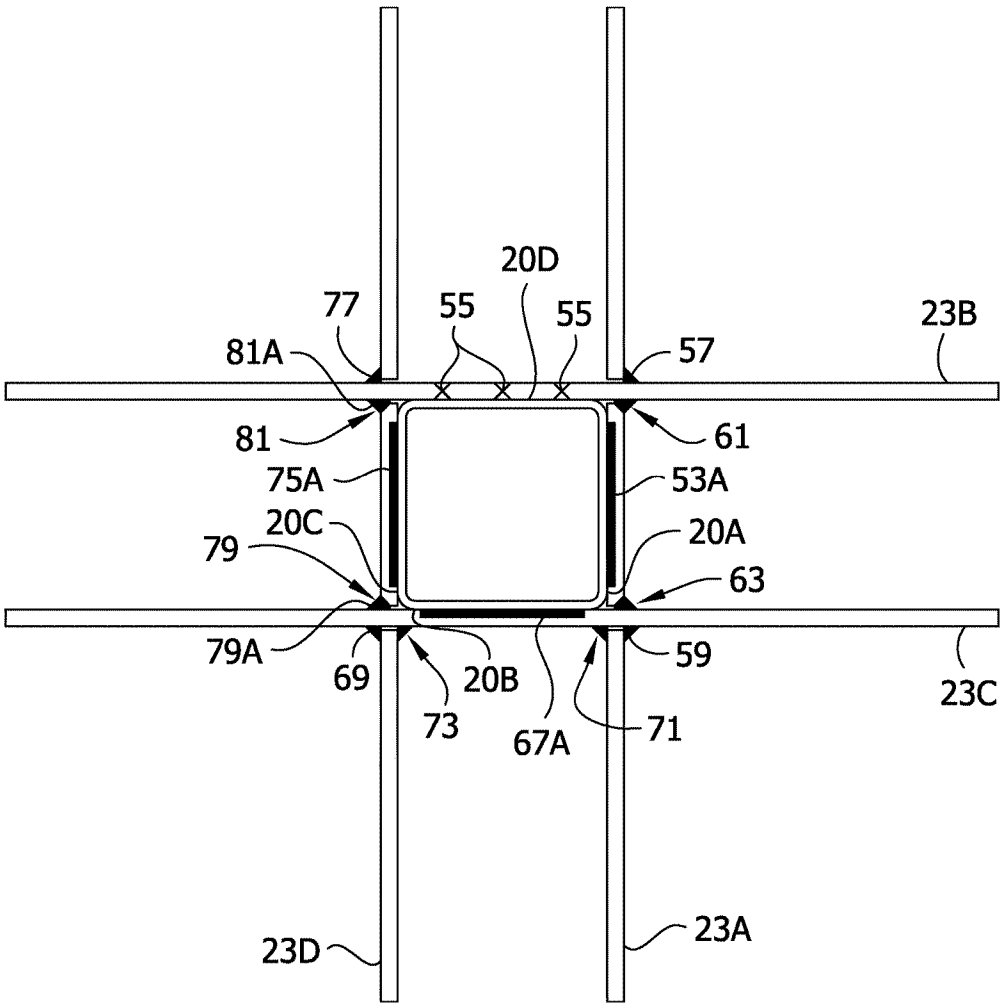
FIG. 19 is the end elevation of FIG. 17 rotated counter-clockwise 90° to a fourth assembly position.
Figure 20:
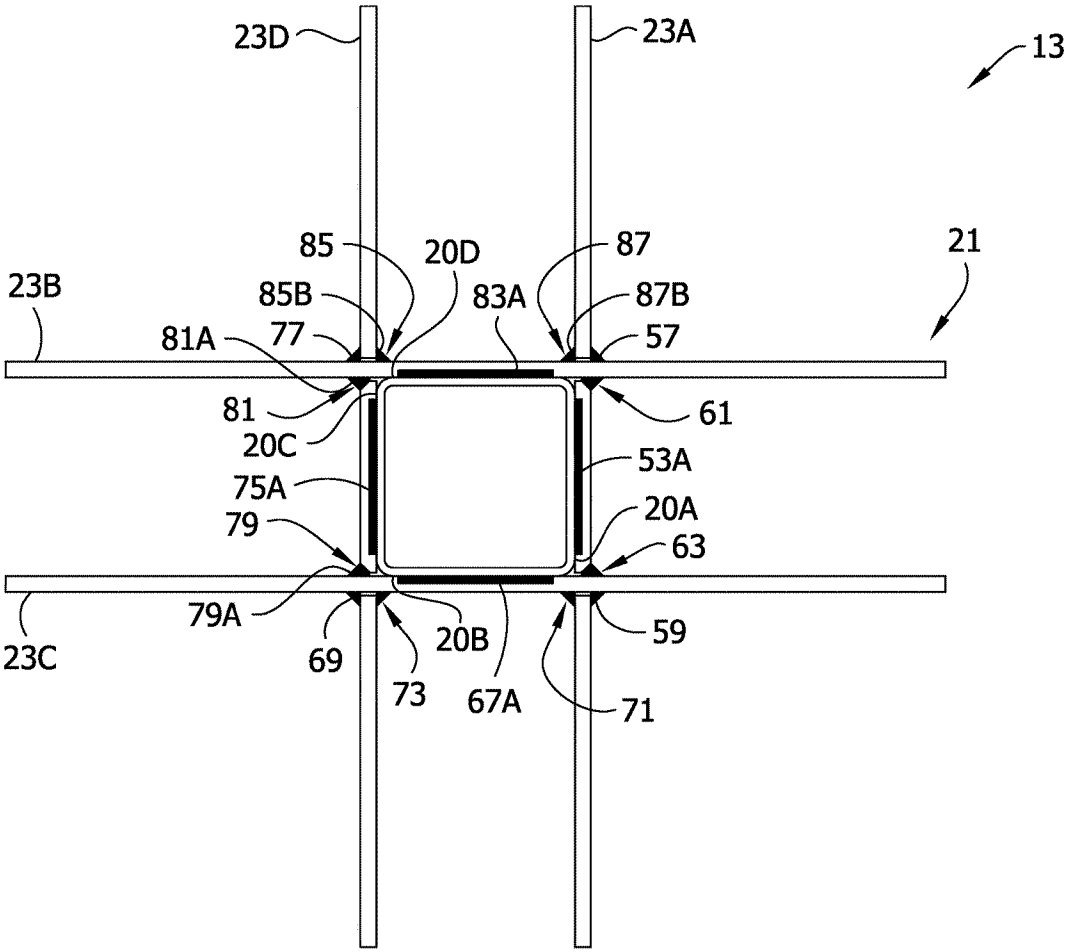
FIG. 20 is the end elevation of FIG. 19 illustrating welds connecting the second gusset plate to the first and fourth gusset plates.
Figure 21:
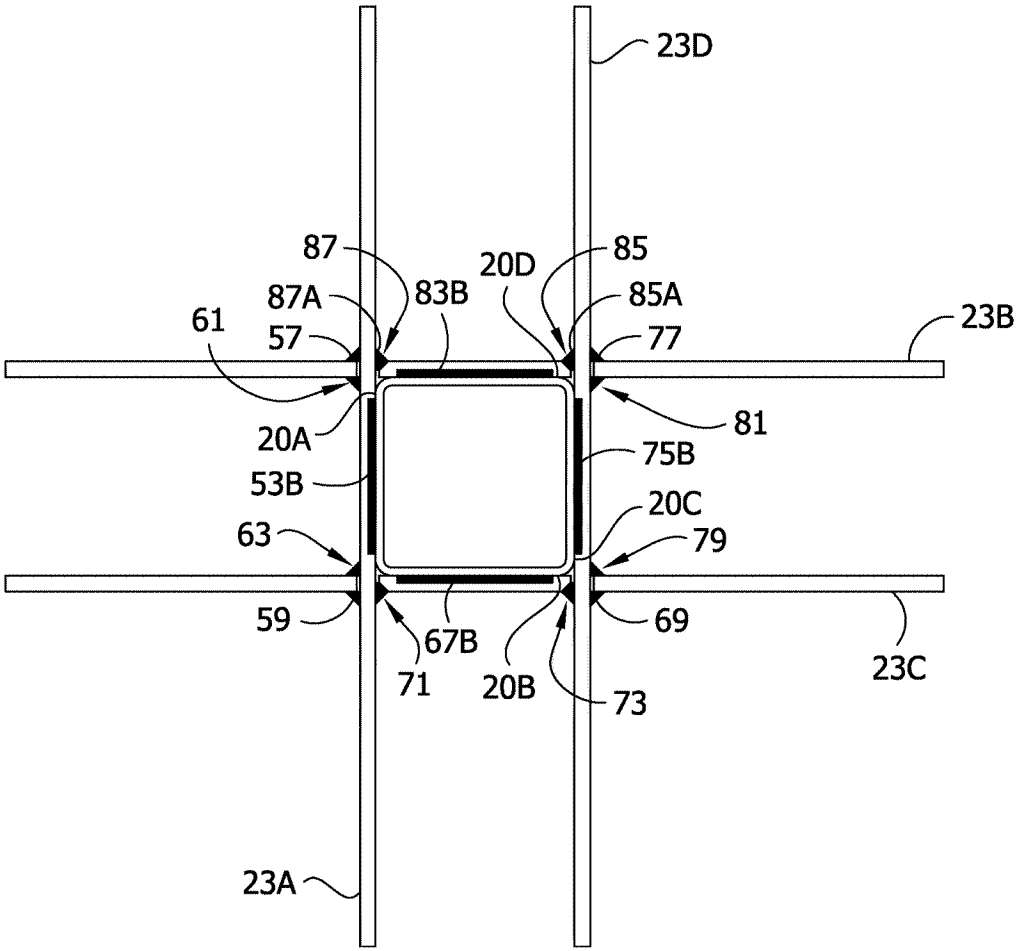
FIG. 21 is an elevation as seen from the opposite end of the column of FIG. 20
Figure 22:
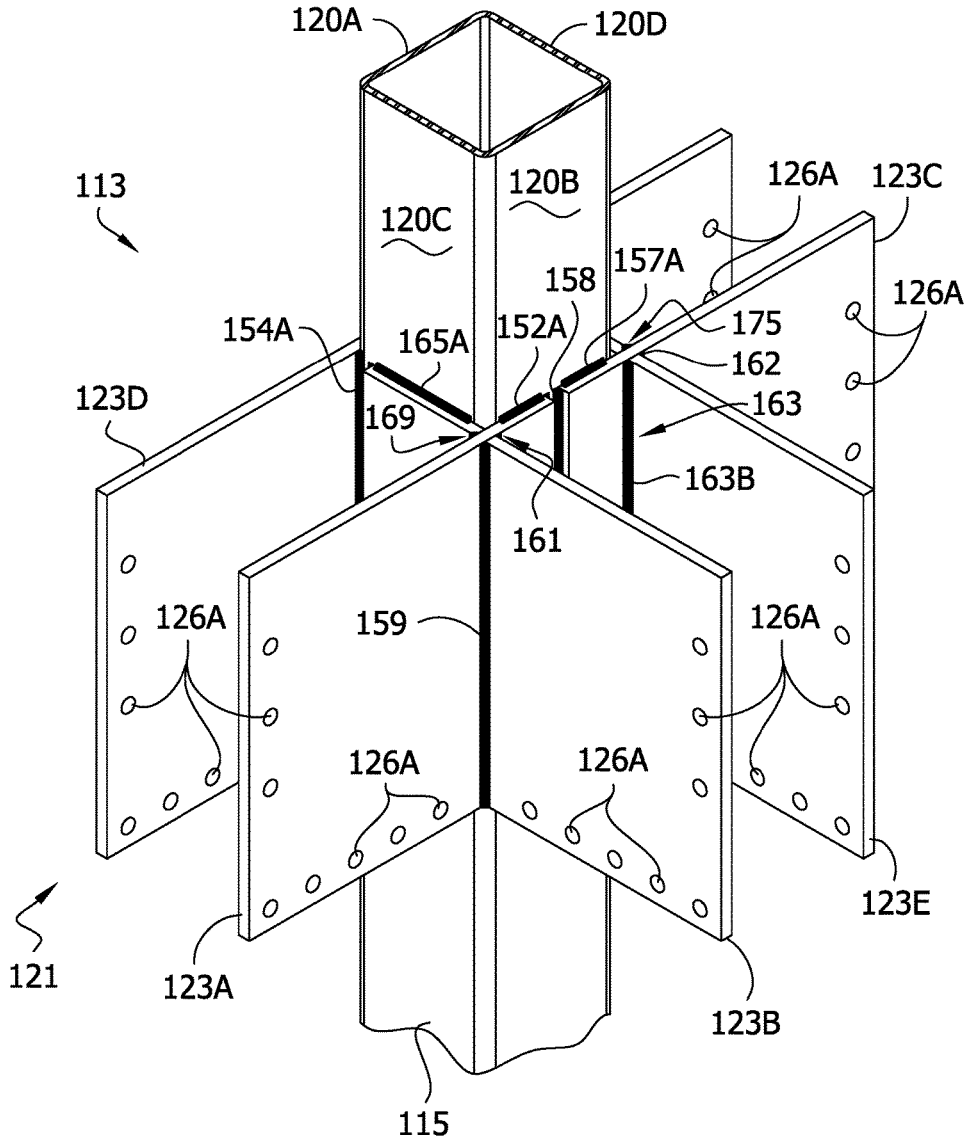
FIG. 22 is a front, fragmentary perspective of a column assembly configured for receiving three beams.
Figure 23:
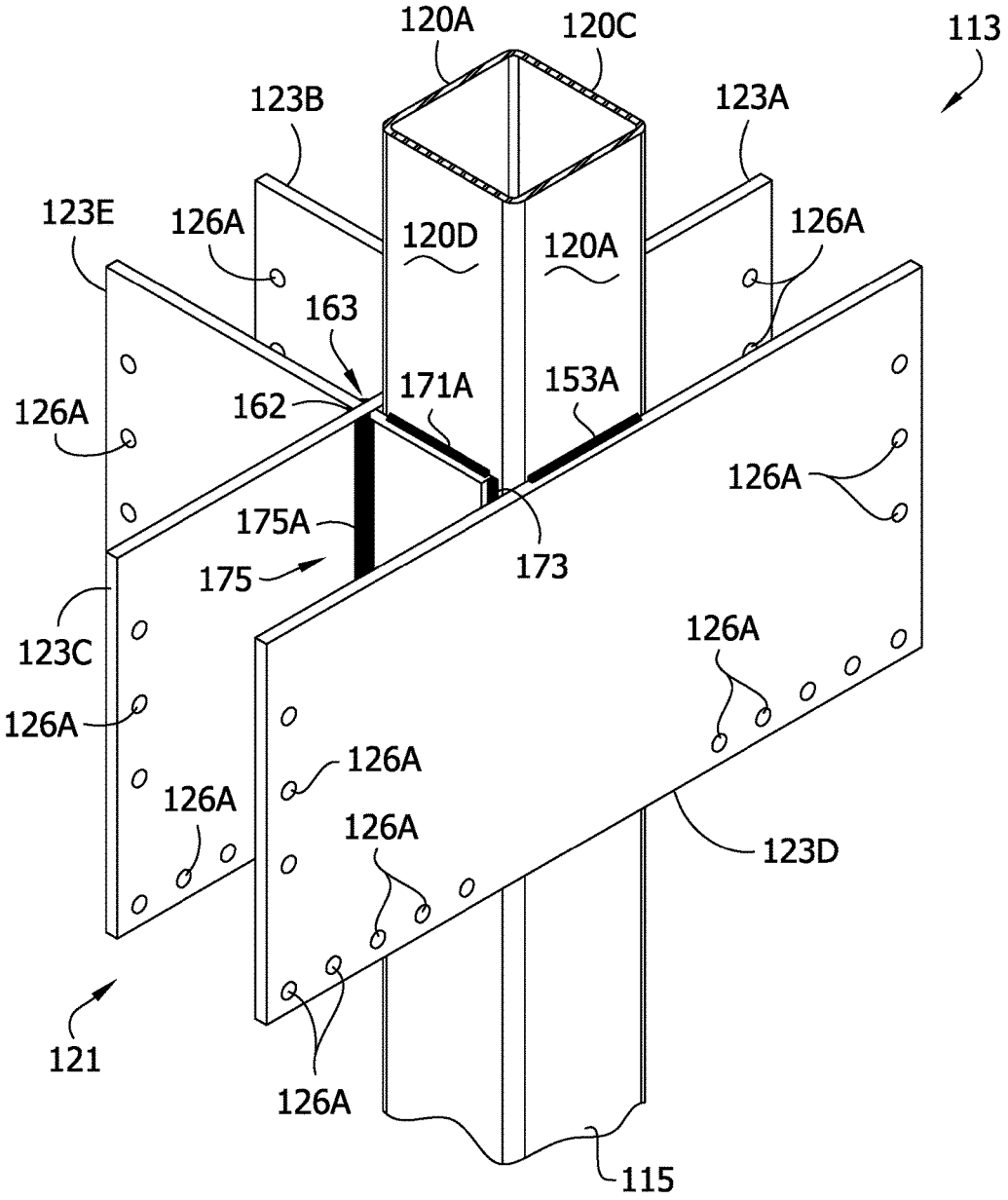
FIG. 23 is a rear, fragmentary perspective of the column assembly of FIG. 22.
Figure 24:
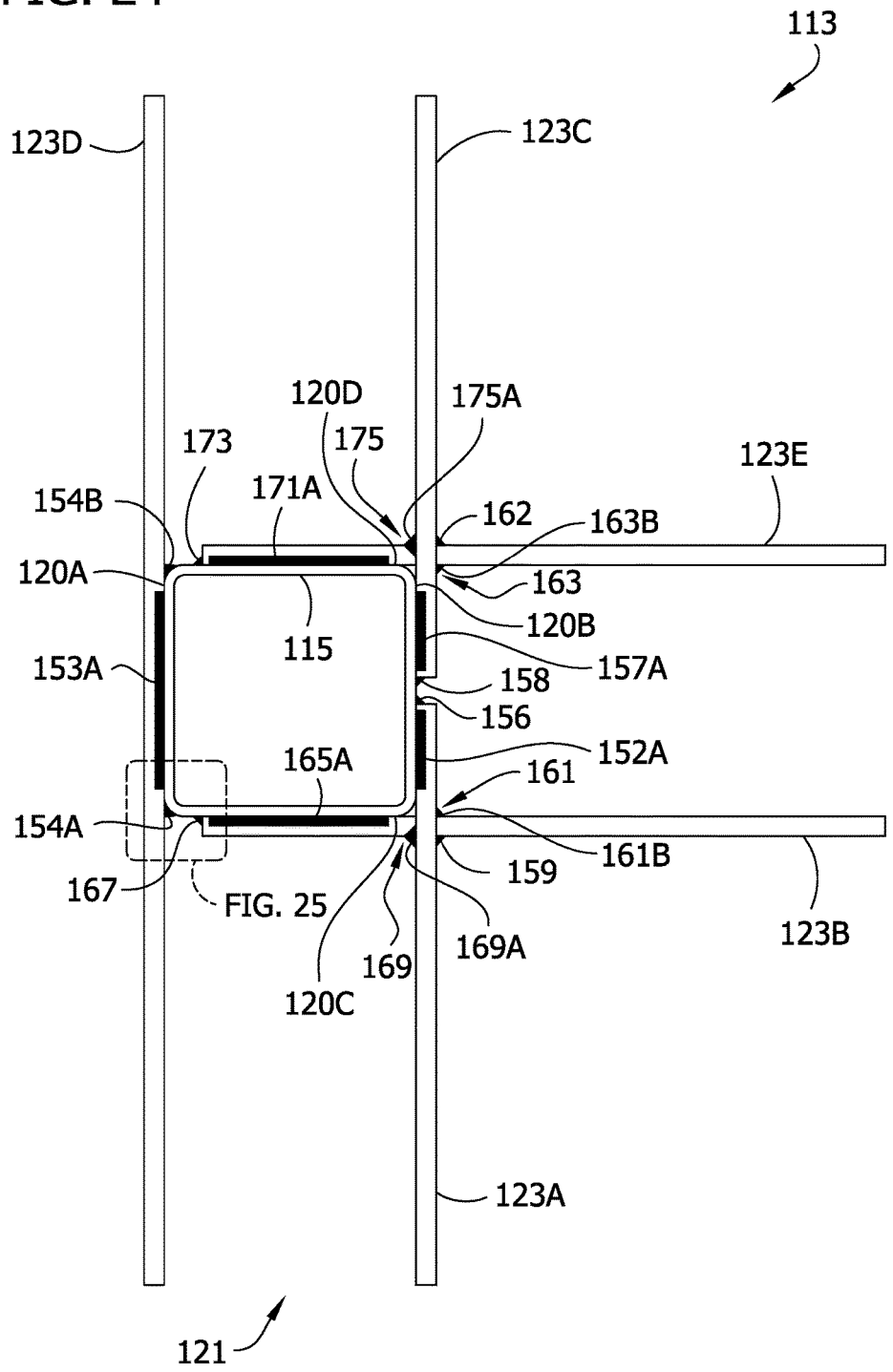
FIG. 24 is a top plan view of the column assembly of FIG. 22.
Figure 25:
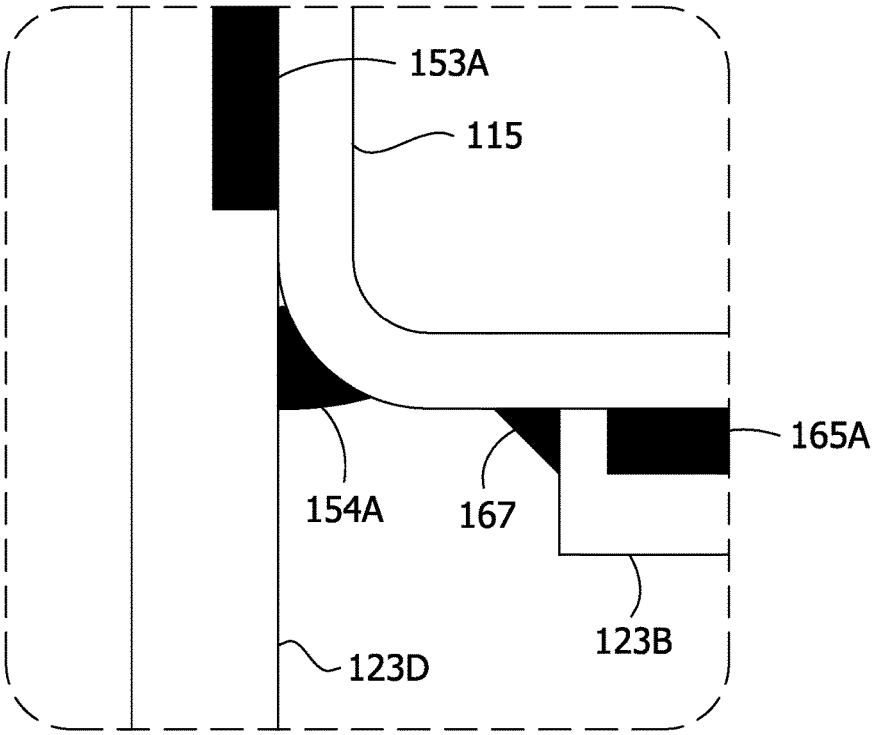
FIG. 25 is an enlarged, fragmentary view of the lower left hand corner of the column assembly as shown in FIG. 24.

The column 15 is rotated 90° counterclockwise from its orientation shown in FIG. 17 to a fourth horizontal assembly position shown in FIG. 19 after completion of the welds 77, 79 and 81. Referring to FIGS. 20 and 21, fillet welds 83A, 83B are then made in the horizontal welding position along opposite edges of the gusset plate 23B to the face 20D of the column 15, in directions transverse to the longitudinal axis of the column. A fillet weld (not shown) is also made in the horizontal welding position around the perimeter of interior aperture 45 of gusset plate 23B, similar to the weld 51 for the gusset plate 23A shown in FIG. 7. The second gusset plate 23B has a horizontal position on the column 15 when it is welded to the column. Welds 85 and 87 located between the gusset plates 23A, 23D adjacent to the face 20D of the column 15 also extend the full depths of the gusset plates 23A, 23B, 23D and join respective pairs of these gusset plates together. The welds 85, 87 are both made in the horizontal welding position and each includes two different forms of welds along its length. Where the weld 85 extends along the bevel 48 in the open slot 47 of the gusset plate 23B it comprises a partial joint penetration (PJP) groove weld with reinforcing fillet weld, designated 85A (FIG. 21). Away from the bevel 48, the weld 85 is a standard fillet weld 85B (FIG. 20). Similarly, where the weld 87 extends along the bevel 48 of the open slot 47 in the gusset plate 23B, it is a partial joint penetration (PJP) groove weld with reinforcing fillet weld, designated 87A (FIG. 21). Away from the bevel 48, the weld 87 comprises a standard fillet weld 87B (FIG. 20).

The column assembly 13 is complete after formation of the welds 83A, 83B, 85, 87 and the weld (not shown) in the interior aperture 45 of the gusset plate 23B. As will be understood, the construction of the column assembly is carried out in an ordered, gusset plate by gusset plate sequence using the column 15 as an alignment jig to form the gusset plate assembly 21. The column assembly 13 is formed using both the column 13 and gusset plates 23A-23D as alignment jigs to facilitate flush and plumb fit-up between faces 20A-20D of column 15 and respective adjacent interior faces of interlocked gusset plates 23A-23D, resulting in gusset plate orthogonal alignment accuracy and efficient construction. In the illustrated embodiment, all of the welds are desirably made in the horizontal welding position, simplifying the welding and improving the opportunity that all of the welds will be formed without defect. The welds 57, 59, 61, 63, 69, 71, 73, 77, 79, 81, 85 and 87 rigidly interconnect the gusset plates 23A, 23B, 23C, 23D forming the rigid gusset plate assembly 21 capable of transmitting biaxial force and bending moments generated from reaction forces and bending moments from beams 19 to the column 15. The welds 57, 59, 61, 63, 69, 71, 73, 77, 79, 81, 85 and 87 rigidly connect the gusset plates 23A-23D to each other separately from their connections to the column 15. Welds 53A, 53B, 67A, 67B, 75A, 75B, 83A, 83B, and all four closed loop welds 51, 68 that are placed around the full perimeter of the interior apertures 41, 45 of gusset plates 23A-23D rigidly and collectively connect gusset plates 23A-23D to the column 15. It will be understood that the column assembly 13 can be formed in other ways within the scope of the present invention. For example, instead of making three 90° turns about the longitudinal axis of the column 15 a fewer number of turns could be made. In one embodiment, the column can be turned 180° from its position shown in FIG. 10 to its position shown in FIG. 17. The gusset plate 23D would then be slid onto the gusset plates 23B, 23C in a horizontal orientation in that embodiment. This variation on the illustrated method would require making some welds in the vertical welding position, which is not as preferred as the horizontal welding position.

The partial joint penetration groove welds with reinforcing fillet welds 61, 63, 71, 73, 79, 81, 85, 87 provide for a strong connection between the connected pairs of the gusset plates 23A-23D. The joint penetration groove weld connection allows the gusset plates 23A-23D to be connected without any welds on the interior corners of the gusset plate assembly 21. Referring to the enlarged view of FIG. 14, it may be seen that the partial joint penetration groove welds with reinforcing fillet welds 63 and 71 are made at two exterior corners formed by the intersection of gusset plate 23A and gusset plate 23C. The fillet weld 59 is formed at a third exterior corner between the two exterior corners where welds 63 and 71 are made. At each of these exterior corners, the intersecting gusset plates 23A, 23C define edges along which the particular welds are made. It may also be seen that the intersection of the gusset plates 23A, 23C defines an interior corner adjacent to the column 15 and directly opposite the fillet weld 59. This allows the corner of the column 15 to be closely fit up into the interior corner of the gusset plate assembly 21 without any interference from a weld on the gusset plate assembly. The benefit may be even greater when built up box columns are used (see, FIG. 39 below), which have angular rather than rounded corners like the HSS section column 15 shown in FIG. 14. It will be understood that one function of using joint penetration groove welds and in particular partial joint penetration groove welds with reinforcing fillet welds to provide strength without an interior corner weld applies to all embodiments described herein where ever joint penetration groove welds are employed. However, the use of a weld on any interior corner of a gusset plate assembly (not shown) is within the scope of the present invention.

The partial joint penetration groove weld with reinforcing fillet welds 61A, 63A, 71A, 73A, 79A, 81A, 85A, 87A illustrated provide benefits because of their overall economy in making. However, it is to be understood that other joint penetration groove weld types and associated T-joints configurations (with or without beveled gusset plate edges, and with or without a reinforcing fillet weld) may also be used. For example and without limitation, these welds include a single-bevel complete joint penetration (CJP) groove weld, a single J-groove weld and a square-groove weld which might be employed in electro-slag welding applications. The configuration of the groove weld used in a given application may depend upon regional code design requirements. Some regional codes may require the use of a backer bar at the toe (or root) of the groove weld profile, followed by a subsequent removal of the backer bar after placing the weld metal. That may be followed by a back gouge of the root pass of the completed groove weld (with associated non-destructive testing and inspection), and finally the placement of a reinforcing fillet weld to fill the cavity left by back gouging the root pass of the groove weld.

The finished column assembly 13 can be transported to the worksite where it can be erected as part of the building framework 1 (FIG. 1). In the illustrated embodiment, the joint connection structure 11 formed using the column assembly 13 connects four beams. However, other column assemblies may be formed that may interconnect a greater or lesser number of incoming beams. For example, joint connection structures 11', 11" in FIG. 1 are constructed for receiving three beams and two beams, respectively. Column assemblies 13', 13" of these joint connection structures 11', 11" may be formed using the method of the present invention.

The column assembly 13 beneficially distributes the resistance to moments applied by the beams 19 to the column 15 to all four faces 20A-20D of the column, making it well-suited to resist bi-axial loads applied by the beams to the column, particularly in severe load events. This is made possible by the use of welded interlocked orthogonal gusset plates forming the rigid gusset plate assembly 21 that hugs the sidewalls and snugly encloses the corners of the column 15. It will be understood that a moment applied by any one or any combination of the four beams will be transmitted by the rigid gusset plate assembly 21 to locations all around the column 15. For example, when a moment is applied on one axis (e.g., as from one beam 19 connected to gusset plates 23A, 23D), it is resisted through connections of the gusset plates 23A, 23D to the faces 20A, 20C of the column 15 parallel to the axis of the beam in a manner similar to gusset plate connections described in U.S. Pat. Nos. 6,138,427, 7,178,296, 8,146,322, and 9,091,065. The connection to the parallel faces 20A, 20C of the column 15 provides a force couple (principally acting in shear along the length of the welds) formed by the top and bottom horizontal welds 53A, 53B, 75A, 75B (comprising a horizontal weld group) connecting the gusset plates 23A, 23D to their respective faces 20A, 20C of column 15 to resist applied moment. In addition, top and bottom horizontal welds 83A, 83B of the gusset plate 23B facing the end of the beam 19 comprise another horizontal weld group forming a resisting tension/compression force couple acting perpendicular to the face 20A of the column 15 to resist applied moment. The rigid gusset plate assembly 21 also transmits the moment to the opposite face 20B of the column 15 through its connection to the gusset plate 23C, by providing a redundant resisting tension/compression force couple (acting perpendicular to the opposite face 20C) formed by the top and bottom horizontal welds 67A, 67B (comprising yet another horizontal weld group) connecting the far gusset plate 23C to the opposite face 20B to resist the applied moment.

In addition to the foregoing moment resisting features of the column assembly 13, the column assembly is configured to provide further moment resistance unique to bi-axial moments. It can be understood that if moments are being applied to the joint column assembly 13 from beams 19 which are orthogonally arranged with respect to each other, the resolved moment vector would not lie in a vertical plane including the longitudinal axis of either beam. Instead, the moment vector would lie in a vertical plane somewhere in between orthogonal beams 19, and would therefore urge the gusset plate assembly 21 to tilt on the column along a diagonal between the longitudinal axes of said orthogonal beams 19. In this case, adjacent, near orthogonal faces 20A, 20D of the column 15 provide cooperative moment resistance. More specifically, the welds (e.g., welds 51, 68) in the vertical apertures 41, 45 in the gusset plates 23A-23D, which are centered at the mid-depth of the column 15 on the adjacent faces 20A, 20D orthogonal to each other, provide additional moment-resisting capacity by coupling the same vertical slot welds located in their respective apertures 41, 45, which act together orthogonally as a vertical weld group to provide a force couple to resist the applied bi-axial moment. The rigid gusset plate assembly 21 also transfers the bi-axial moments to the far orthogonal faces 20B, 23C of the column 15, which comprises another vertical weld group to provide additional cooperative moment resistance. Both the near orthogonal faces 20A, 20D and far orthogonal faces 20B, 20C act in concert with the moment resistance force couples described in the preceding paragraph to make the column assemblies 13 and joint connection structures 11 formed using the column assemblies remarkably robust and redundant.

Concurrently, load transfer redundancy can also be provided under severe load conditions by a 'push/pull' effect of opposite gusset plates 23 (facing perpendicular to the longitudinal axis of the beam) bearing against the same opposite faces 20 of the column 15 under the applied moment. Thus, opposing faces 20 of the column 15 cooperate to resist moment (under extreme load conditions) from one beam 19, in addition to resistance provided by the welded connection of the gusset plates 23 to the orthogonal side faces 20 of the column 15, thereby providing redundancy in resisting applied moment. It will be understood that the column assembly 13 is configured to resist applied moment in the way just described for moment applied for only one beam 19, for as many as all the four beams 19 in the joint connection structure 11 made possible by bi-axial interaction of all aforementioned load transfer mechanisms.

Further, the unique geometry and stiffness of this all shop fillet-welded and all field-bolted, bi-axial, beam-to-column moment-resisting joint connection structure 11 maximizes its performance and the broadness of its design applications, including both extreme wind and moderate-to-severe seismic conditions. In particular, the all field-bolted joint connection structure 11 preserves the physical separation (or gap) between the end of a full-length beam 19 and the face of the column 15 made possible by the use of vertically and horizontally extended parallel gusset plates 23A, 23D or 23B, 23C that sandwich the column and the beam similar to prior designs which feature an all field fillet-welded joint connection structure; thus reducing the uncertainty of bending moment load transfer between a rigidly attached steel moment frame beam and column used in the past.

Further, by including the vertically and horizontally extending parallel gusset plates 23A, 23D or 23B, 23C that sandwich both the columns 15 and the beams 19, this current bi-axial application of an all field-bolted joint connection structure 11 preserves the advantage of increased beam-to-column joint stiffness. There is also a corresponding increase in overall steel moment frame stiffness, which allows smaller beam sizes when the building design is controlled by lateral story drift (not member strength), and hence reduced material costs. When the building design is controlled by member strength (not lateral story drift), this bi-axial all field-bolted joint connection structure 11 also reduces the beam size and the column size, and hence material quantities and cost, because its connection geometry has no net section reduction in either the beam 19 or the column 15 (i.e., no bolt holes through either the beam or sidewalls of the column), thereby maintaining the full strength of the beam and column.

In one aspect of the present disclosure, full-length beams are connected to gusset plates by bolts so that the full-length beam and gusset plates are substantially free of welded connection. It will be understood that field welding the full-length beam assemblies 17 to the column assembly 13 is within the scope of that aspect of the disclosure, as is providing an all-bearing moment resisting joint connection between full-length beam assemblies 17 and the column assembly 13 (corresponding to the joint connection shown in FIG. 140 of co-assigned U.S. application Ser. No. 14/729,937).

Referring now to FIGS. 22-25, a joint connection structure includes a column assembly 113 configured for connecting three beam assemblies to a column 115 in a manner to resist bending moments, as with the column assembly 13 described above. In this embodiment, the joint connection structure has a 3-sided/3-beam configuration in which three full-length beam assemblies (not shown) can be attached to the column assembly 113. The construction of the column and beam assemblies 113, 117 may be as described above for the column assembly 13 and beam assemblies 17, including the described variants. In one embodiment, the column assembly 113 can be identical to the column assembly 13' of the joint connection 11' of the framework 1 shown in FIG. 1. The connection of the beams to the column 115 may be as shown in FIGS. 1A and 2 or in another suitable manner. The gusset plate assembly 121 includes gusset plates 123A-123E which are not all directly connected to each other, as will be described. More particularly, the gusset plate assembly 121 of the column assembly 113 includes a first gusset plate 123A, a second gusset plate 123B, a third gusset plate 123C, a fourth gusset plate 123D and a fifth gusset plate 123E. The first gusset plate 123A and second gusset plate 123B are connected to each other and also to respective faces 120B, 120C of the column 115. The third gusset plate 123C and fifth gusset plate 123E are connected to each other and also to respective faces 120B, 120D of the column 115. The fourth gusset plate 123D is attached to the face 120A of the column 115 and projects outwardly from two, opposite faces 120C, 120D of the column. The gusset plates 123A-123E extend within planes generally parallel to the longitudinal axis of the column 115 and project laterally outward from the column, and include bolt holes 126A. The projecting left (as oriented in FIG. 22) portion of the fourth gusset plate 123D and a projecting portion of the first gusset plate 123A define a space for receiving an end of one of the beams. The second gusset plate 1236 and fifth gusset plate 123E define a space for receiving an end of a second of the beams. The third gusset plate 123C and the projecting right portion of the fourth gusset plate 123D define a space for receiving a third of the beams. As mounted on the column 115, the gusset plates 123A-123E all intersect a single plane perpendicular to the longitudinal axis of the column.

Figure 26:
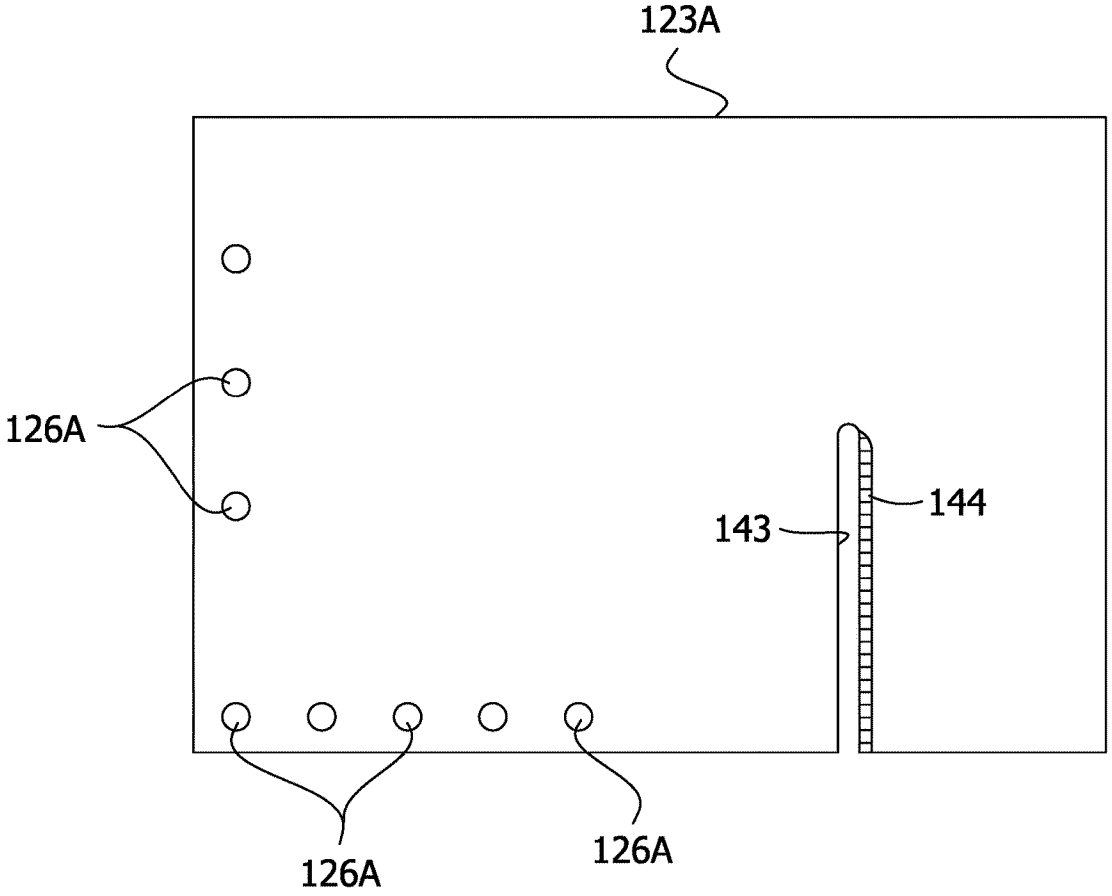
FIG. 26 is a front elevation of a first gusset plate of the column assembly of FIG. 22.
Figure 27:
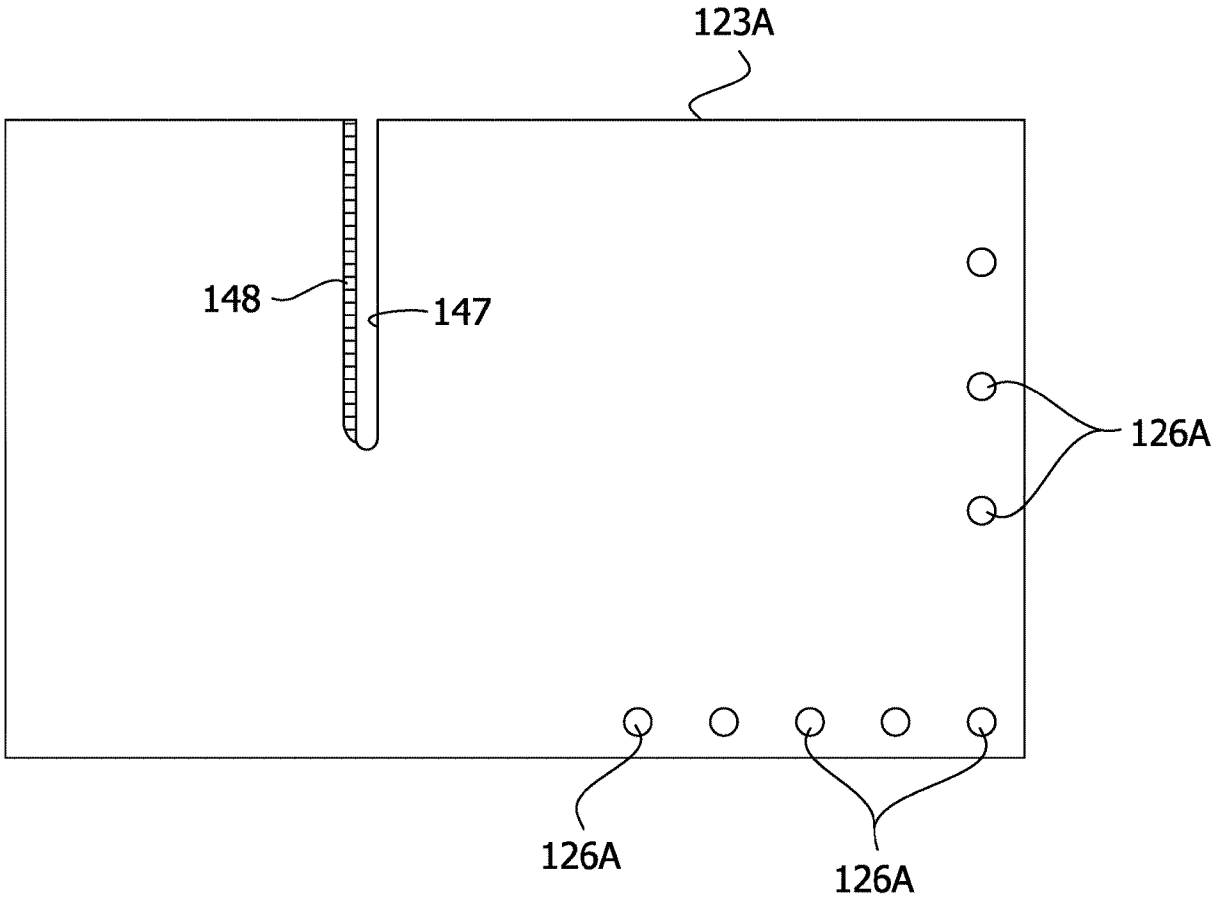
FIG. 27 is a front elevation of a second gusset plate thereof.
Figure 28:
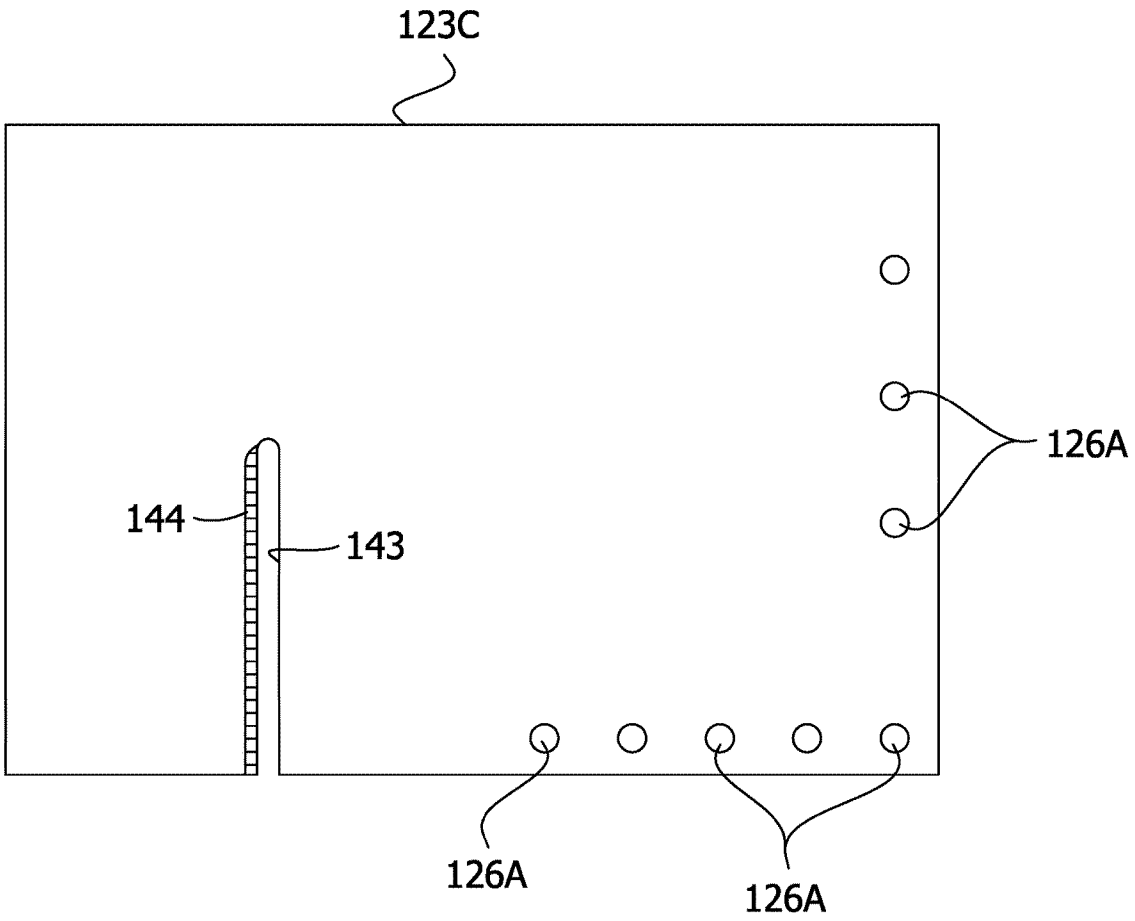
FIG. 28 is a front elevation of a third gusset plate thereof.
Figure 29:
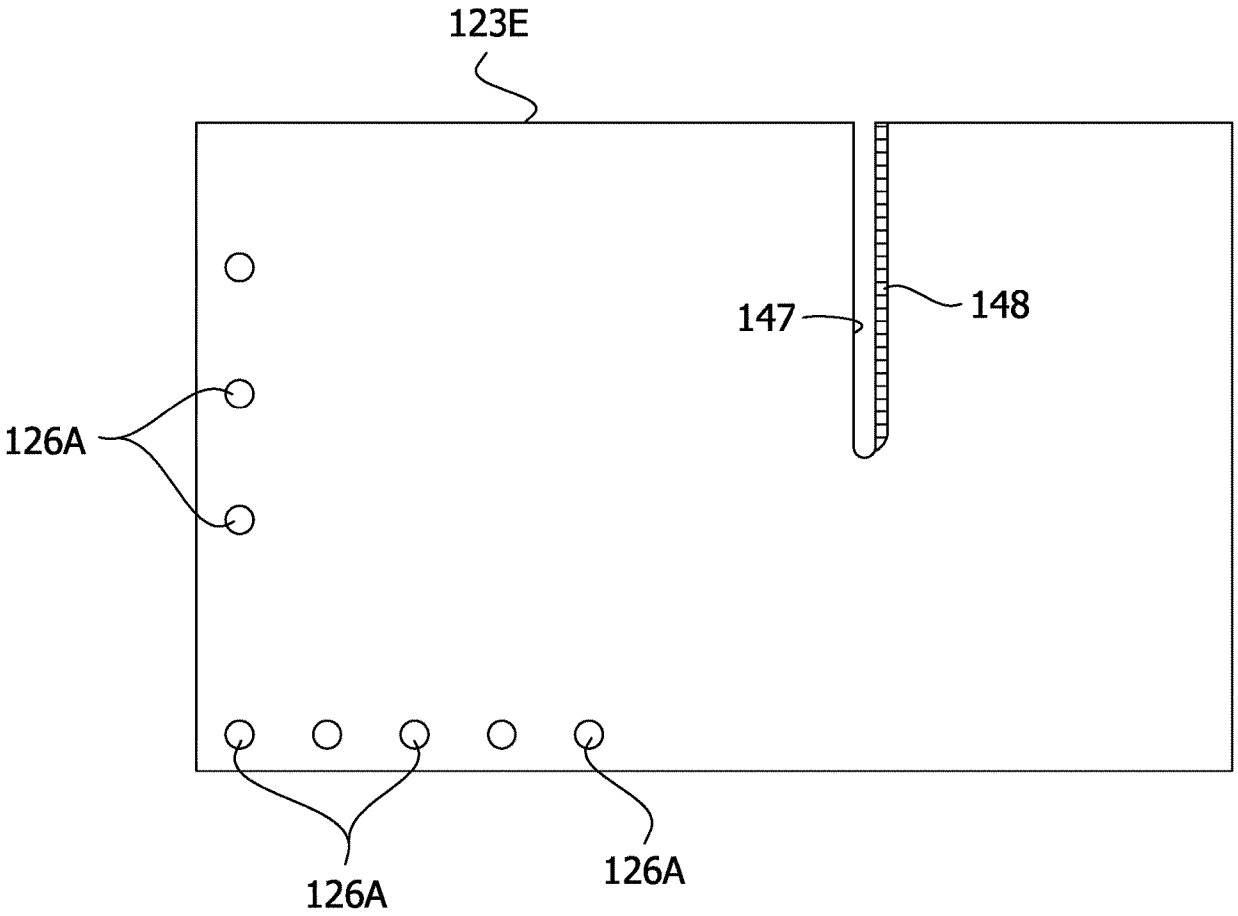
FIG. 29 is a front elevation of a fifth gusset plate thereof.

The construction of the gusset plates 123A, 123B, 123C and 123E is shown in FIGS. 26-29. Gusset plate 123A and gusset plate 123C are illustrated in FIGS. 26 and 28, respectively, as each would appear looking toward the face 1206 of the column 115. Gusset plate 123B is shown as it would appear looking toward the face 120C of the column 115, and gusset plate 123E is shown as it would appear looking toward the face 120D of the column. The gusset plates 123A, 123C each have a single open slot 143 extending from approximately the middle of the gusset plate and opening downwardly at lower edge of the plate. One edge margin of each of the slots 143 in gusset plates 123A, 123C defining an edge of the open slot 143 forms a bevel 144 that facilitates welding as will be described hereinafter. As illustrated, the gusset plates 123A, 123C are mirror images of each other. The gusset plates 123B, 123E each have a single open slot 147 extending from the top of the gusset plate, where they open upwardly from the gusset plate, to an interior of the plate. One edge margin of each of the open slots 147 in gusset plates 123B, 123E defining an edge of the open slot 147 forms a bevel 148 that facilitates welding as will be described more fully. The respective orientation of open slots 143 (opening downwardly), and open slots 147 (opening upwardly) of the gusset plates 123A, 123B, 123C, 123E allow the gusset plates 123A, 123B and gusset plates 123C, 123E to be assembled to each other and to the column 115 as will be described hereinafter.

The column assembly 113 of FIGS. 22-25, when connected with beams of a building framework, creates a bi-axial beam-to-column moment resisting type joint connection structure. The joint connection structure provides for a full-length beam assembly connection along three sides of hollow tubular column 15. Most preferably, each of the components of the joint connection structure, as well as the beam and column 115, are made of structural steel. Some of the components of the joint connection structure are united by welding and some by bolting. All of the welding may be performed at a fabrication shop. The bolting may all be performed at the construction site, which is the preferred option in many regions of the world. However, it will be understood that the beam assembly can be connected to the column assembly 113 in other suitable ways such as by field welding, or in an all-bearing beam-to-column moment resisting connection, as shown in FIG. 140 of coassigned U.S. patent application Ser. No. 14/729,957.

Similar to the embodiment of FIG. 6-21, the column assembly 113 may be fabricated at a fabrication shop and later transported to the construction site. The gusset plate assembly 121 can be efficiently carried out using the column 115 as an alignment jig, and with all welds being made exclusively in the horizontal welding position, which is preferred for the reasons set forth above. However, it also remains the case that some or all of the welding could be done in lesser preferred welding positions within the scope of the present invention. The gusset plate assembly 121 is completed at the same time that the column assembly 113 is completed.

Figure 30:
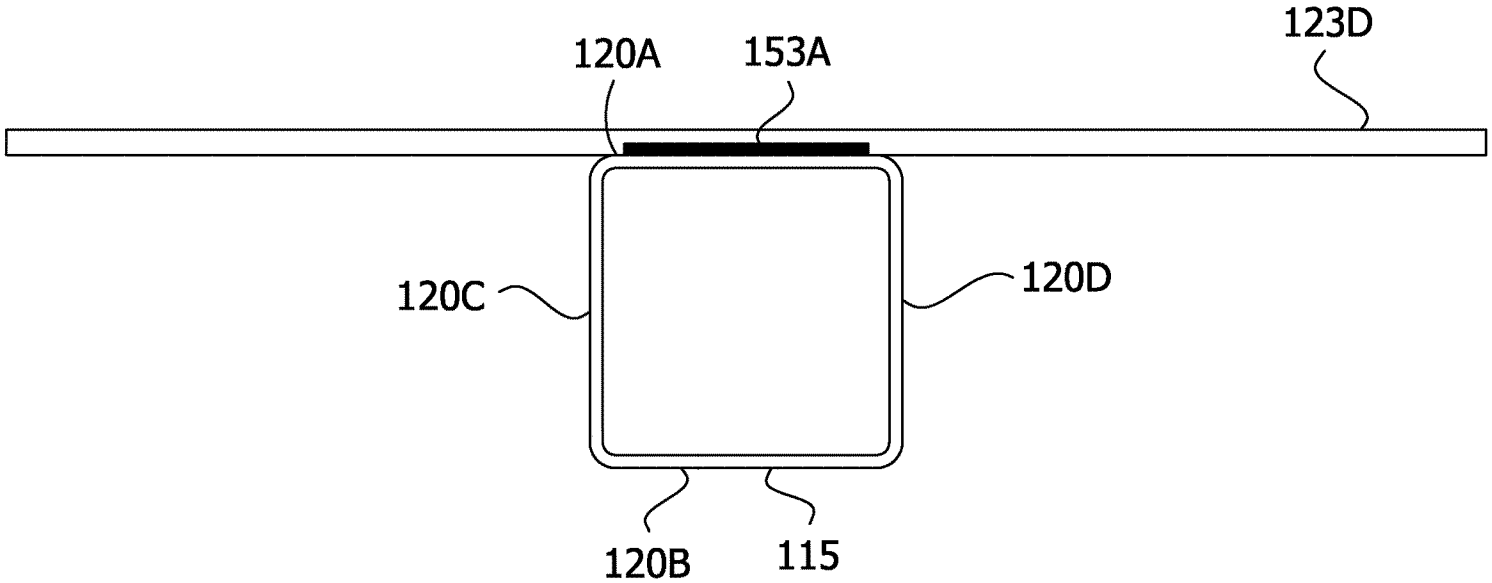
FIG. 30 is an end elevation of a column of the column assembly of FIG. 22 having a (fourth) gusset plate laid on top of the column that is placed in a horizontal position in a first assembly position and welded to the column for initiating construction of a gusset plate assembly on the column.

Referring to FIGS. 30-38, the gusset plates 123A-123E can be assembled with each other and with the column 115 in an ordered, sequential manner, gusset plate by gusset plate. The column 115 is first oriented in a horizontal position with the face 120A directed upward. The fourth gusset plate 123D is placed on the face 120A of the column 115 as shown in FIG. 30. The fourth gusset plate 123D is oriented horizontally and aligned on the column 115 as needed to form the gusset plate assembly 121. Tack welds (not shown) could be used as needed to temporarily secure the gusset plate 123D in place on the face 120A of the column. In this illustrated embodiment, instead the gusset plate 123D is permanently attached to the column. Linear fillet welds 153A, 1536 are made along opposite edges of the gusset plate 123D that are spaced apart from each other along the longitudinal axis of the column 115. The fillet welds 153A, 1536 are both made in the horizontal welding position, and extend transverse to the longitudinal axis of the column 115.

Figure 31:
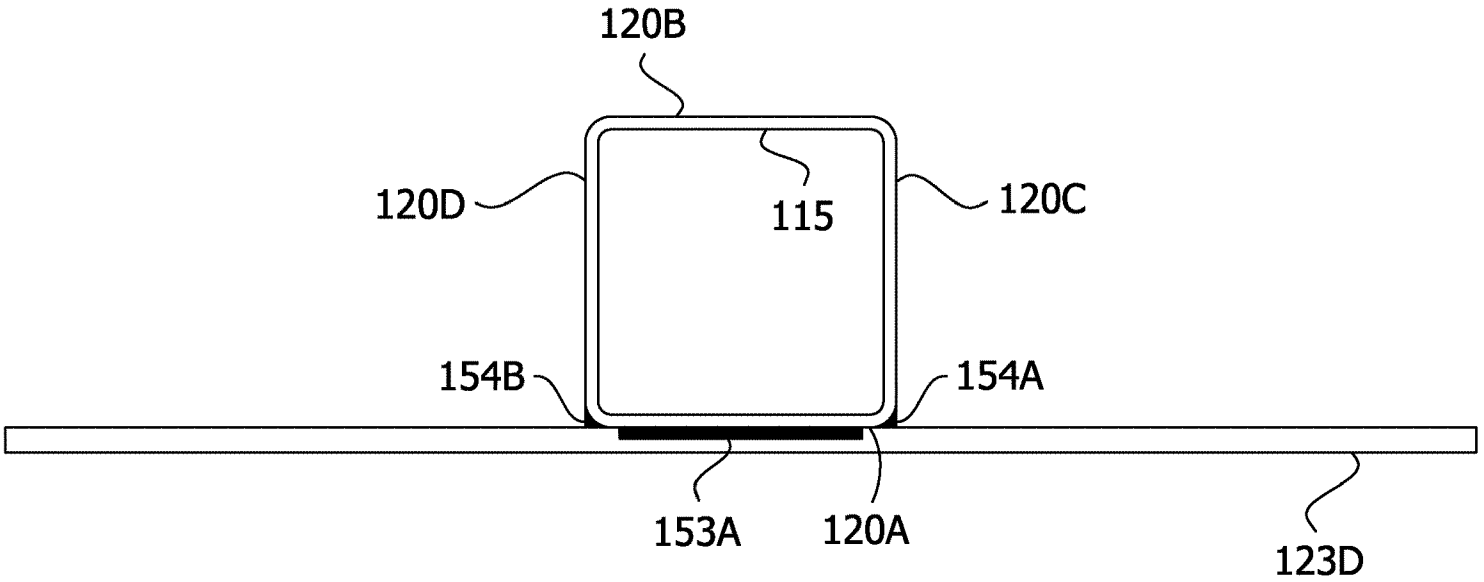
FIG. 31 is the end elevation of FIG. 30 rotated 180° and showing additional welds connecting the fourth gusset plate to the column.
Figure 32:
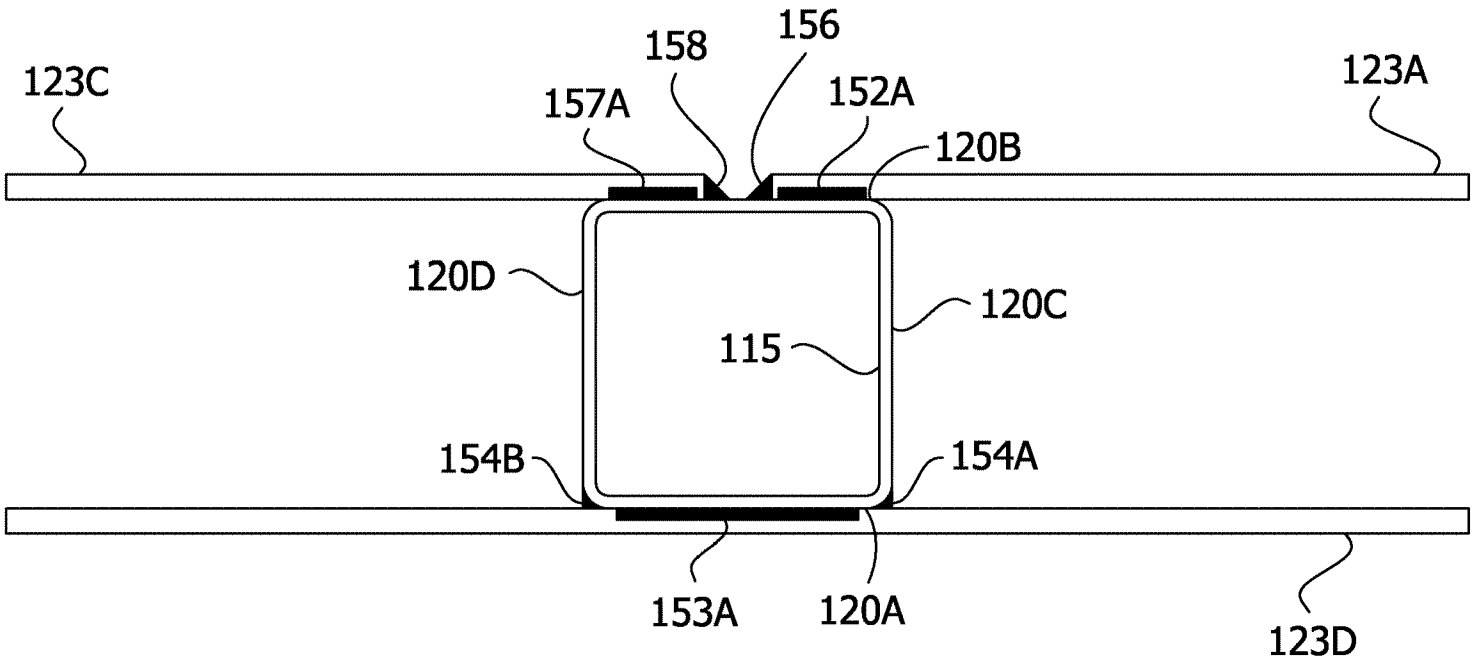
FIG. 32 is the end elevation of FIG. 31 showing welding of first and third gusset plates to the column.

The subassembly of the gusset plate 123D and the column 115 is then rotated about the longitudinal axis of the column 180° to the second assembly position shown in FIG. 31. In this position, the second face 120B of the column 115 faces upward. The gusset plate 123D is welded to corners of the column 115 by flare bevel welds 154A, 1546, each extending substantially the full height of the gusset plate. The welds 154A, 1546 are made in the horizontal welding position after the gusset plate 123D and column 115 are turned to the second assembly position. As shown in FIG. 32, gusset plates 123A and 123C are then mounted on the second face 120B of the column 115 while still in the second assembly position. More particularly, the first gusset plate 123A is aligned on the second face 120B and then fixed to the face by fillet welds 152A, 152B made on opposite edges of the gusset plate 123A spaced apart along the longitudinal axis of the column 115. In addition, a weld 156 along the longitudinal axis of the column 115 attaches an edge of the gusset plate 123A to the second face 1206 of the column. The weld 156 extends substantially the full depth of the gusset plate 123A. The third gusset plate 123C is in the same way aligned on the second face 120B and then fixed to the second face by fillet welds 157A, 157B made on opposite edges of the gusset plate 123C spaced apart along the longitudinal axis of the column 115. In addition, a weld 158 along the longitudinal axis of the column 115 attaches an edge of the gusset plate 123C to the second face 120B of the column. The weld 158 extends substantially the full depth of the gusset plate 123C. It will be appreciated that the order of connection of the first gusset plate 123A and third gusset plate 123C to the column as well as the order of the formation of the welds 152A, 152B, 156, 157A, 157B, 158 may be varied within the scope of the present invention. All of the welds 152A, 152B, 156, 157A, 157B and 158 are made in the horizontal welding position.

Figure 33:
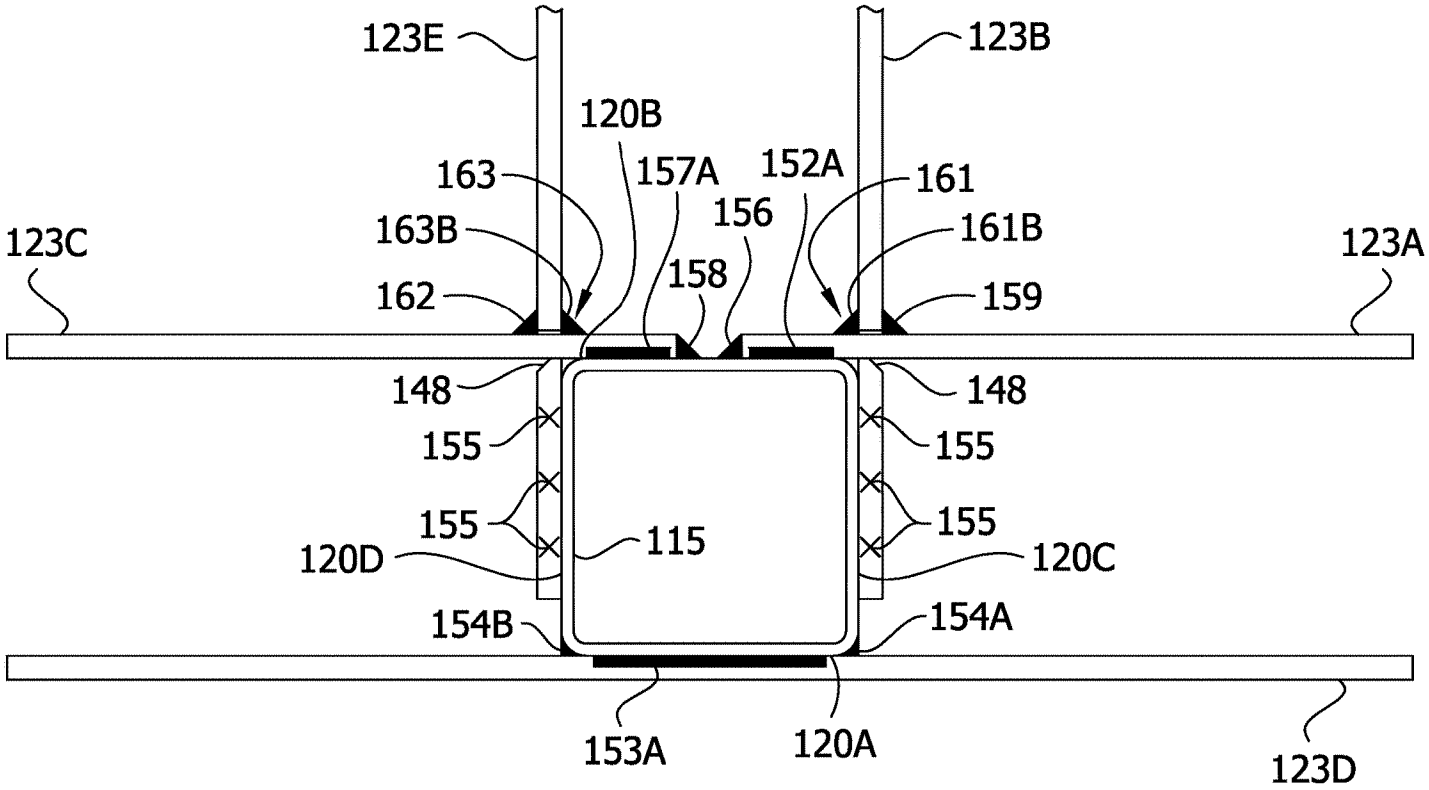
FIG. 33 is the end elevation of FIG. 32 showing second and fifth gusset plates welded to the first and third gusset plates.
Figure 34:
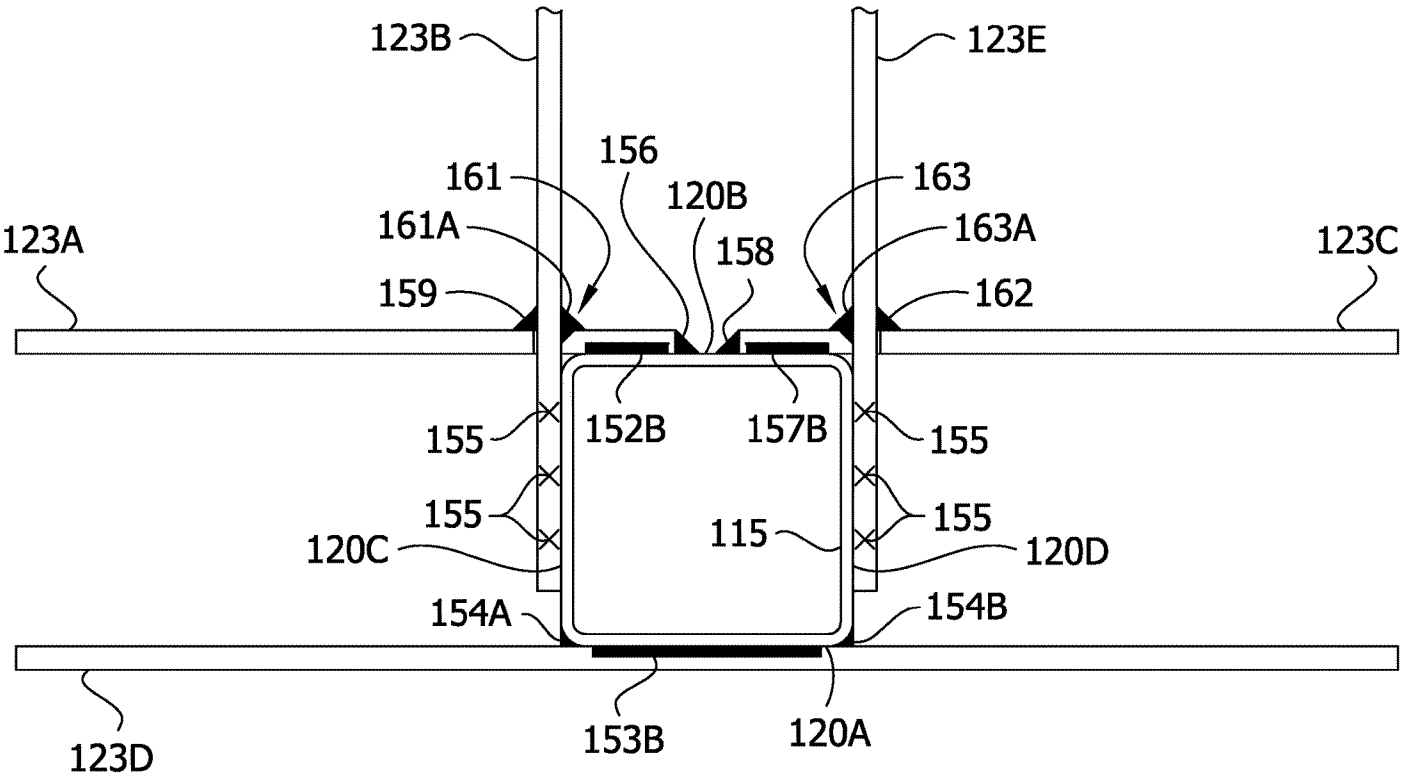
FIG. 34 is an elevation as seen from the opposite end of the column from that shown in FIG. 33.

Referring now to FIGS. 33 and 34, the second gusset plate 123B and fifth gusset plate 123E are then attached to the first gusset plate 123A and the third gusset plate 123C, respectively, and to the column 115. The second gusset plate 123B is self-shored by the first gusset plate 123A by inserting the open slot 147 in the gusset plate 123B into the open slot 143 in the gusset plate 123A. As fully mated, the open slot 143 in the gusset plate 123A receives a portion of the gusset plate 123B and the open slot 147 of the gusset plate 123B receives a portion of the gusset plate 123A. The reception of each gusset plate 123A, 123B by the other provides temporary shoring of gusset plate 123B by gusset plate 123A prior to fixedly connecting the gusset plate 123B to the gusset plate 123A. Using the column 115 as an alignment jig, the gusset plate 123B is substantially axially aligned on the column 115. After the gusset plate 123B is supported on the gusset plate 123A in this manner, and plumbness and orthogonal alignment have been achieved, the gusset plate 123B is temporarily attached by tack welds 155 to the third face 120C of the column 115. A fillet weld 159 made in the horizontal welding position extends the full depth of the gusset plates to join gusset plate 123A to gusset plate 123B. A weld 161 connects the gusset plate 123B to the gusset plate 123A. The weld 161 is made in the horizontal welding position and extends the full depths of the gusset plates 123A, 123B to further permanently join the gusset plates together. The weld 161 includes two types of welds along its length. Where the weld 161 extends along the bevel 144 of the open slot 143 in the gusset plate 123A, it comprises a partial joint penetration (PJP) groove weld with reinforcing fillet weld, designated 161A, as shown in FIG. 34. Away from the bevel 144 of the open slot 143 in gusset plate 123A, the weld 161 comprises a fillet weld 161B (FIG. 33).

The fifth gusset plate 123E is supported (self-shored) on the third gusset plate 123C by inserting the open slot 147 in the gusset plate 123E into the open slot 143 in the gusset plate 123C. As fully mated, the open slot 143 in the gusset plate 123C receives a portion of the gusset plate 123E and the open slot 147 of the gusset plate 123E receives a portion of the gusset plate 123C. The reception of each gusset plate 123C, 123E by the other provides temporary shoring of gusset plate 123E by gusset plate 123C prior to fixedly connecting the gusset plate 123E to the gusset plate 123C. Using the column 115 as an alignment jig, the gusset plate 123E is substantially axially aligned on the column 115. After the gusset plate 123E is supported on the gusset plate 123C in this manner, and plumbness and orthogonal alignment have been achieved, the gusset plate 123E is temporarily attached by tack welds 155 to the fourth face 120D of the column 115. A fillet weld 162 made in the horizontal welding position extends the full depth of the gusset plates to join gusset plate 123E to gusset plate 123C. A weld 163 connects the gusset plate 123E to the gusset plate 123C. The weld 163 is made in the horizontal welding position and extends the full depths of the gusset plates 123C, 123E to further permanently join the gusset plates together. The weld 163 includes two types of welds along its length. Where the weld 163 extends along the bevel 144 of the open slot 143 in the gusset plate 123C, it comprises a partial joint penetration (PJP) groove weld with reinforcing fillet weld, designated 163A, as shown in FIG. 34. Away from the bevel 144 of the open slot 143 in gusset plate 123C, the weld 161 comprises a fillet weld 163B (FIG. 33).

Figure 35:
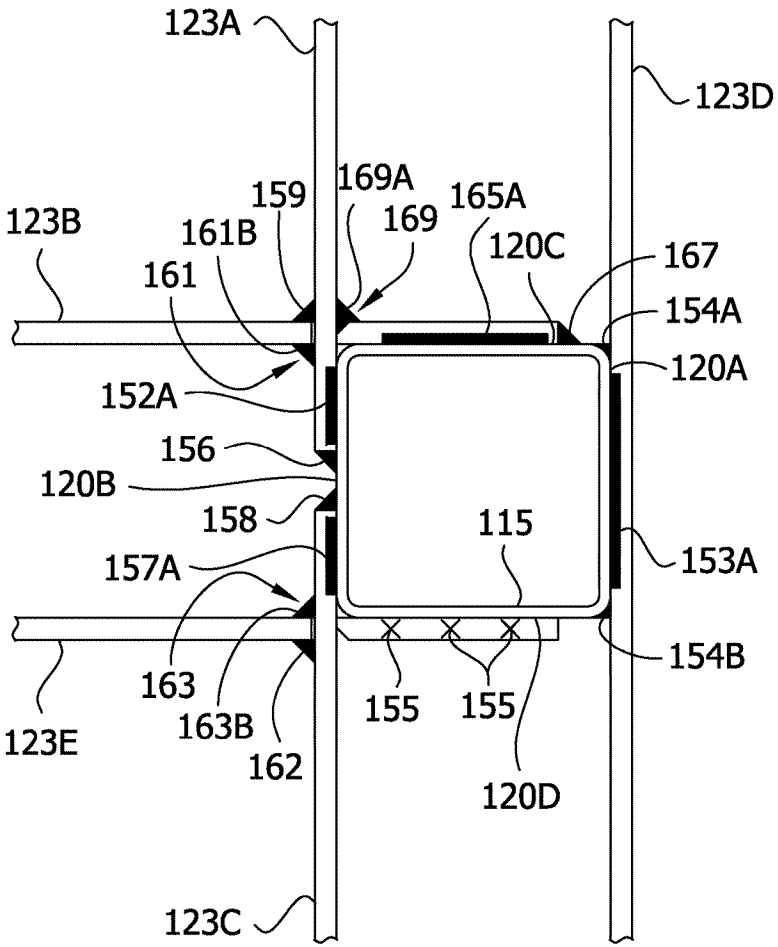
FIG. 35 is the end elevation of FIG. 33 rotated counterclockwise 90° and showing additional welds connecting the second gusset plate to the column and to the first gusset plate.
Figure 36:
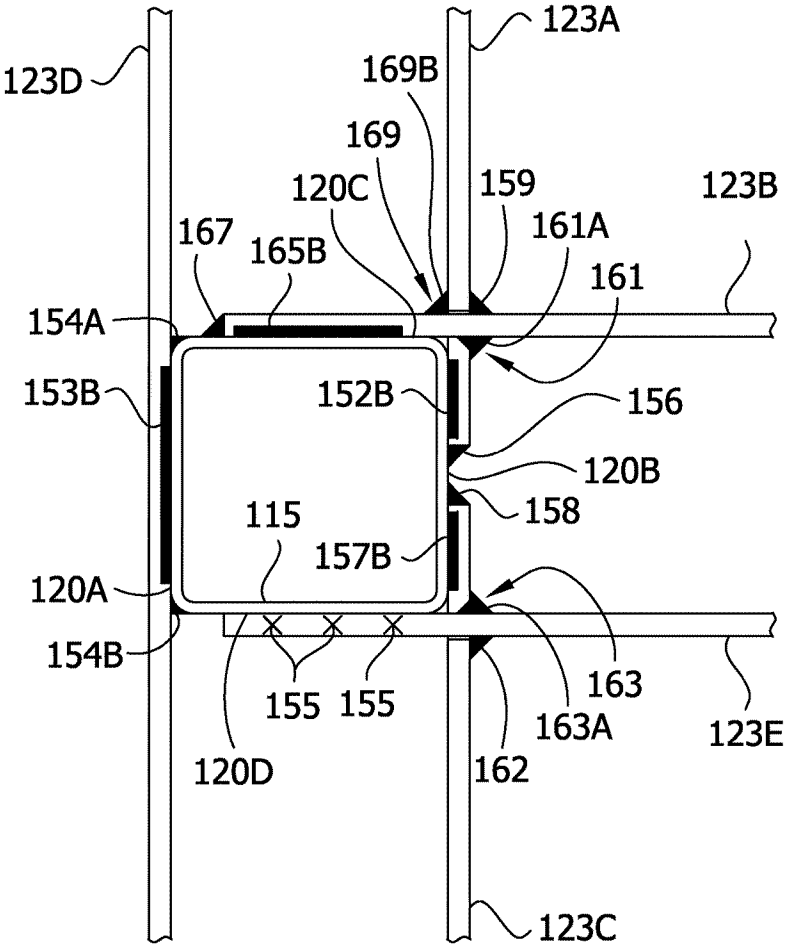
FIG. 36 is an end elevation as seen from the opposite end of the column from that shown in FIG. 35.

The column 115, still in its horizontal position, is rotated 90° in a counterclockwise direction to a third assembly position shown in FIGS. 35 and 36. In this position, the third face 120C of the column 115 is directed upward and four additional welds are made in the horizontal welding position connecting the second gusset plate 123B to the column and to the first gusset plate 123A. The second gusset plate 123B is attached to the face 120C by fillet welds 165A, 165B made on opposite edges of the gusset plate 123B spaced apart along the longitudinal axis of the column 115. In addition, a weld 167 along the longitudinal axis of the column 115 attaches an edge of the gusset plate 123B to the third face 120C of the column. A weld 169 connects the gusset plate 123B to the gusset plate 123A. The weld 169 is made in the horizontal welding position and extends the full depths of the gusset plates 123A, 123B to further permanently join the gusset plates together. The weld 169 includes two types of welds along its length. Where the weld 169 extends along the bevel 148 of the open slot 147 in the gusset plate 123B, it comprises a partial joint penetration (PJP) groove weld with reinforcing fillet weld, designated 169A, as shown in FIG. 35. Away from the bevel 148 of the open slot 147 in gusset plate 123B, the weld 169 comprises a fillet weld 169B (FIG. 36).

Figure 37:
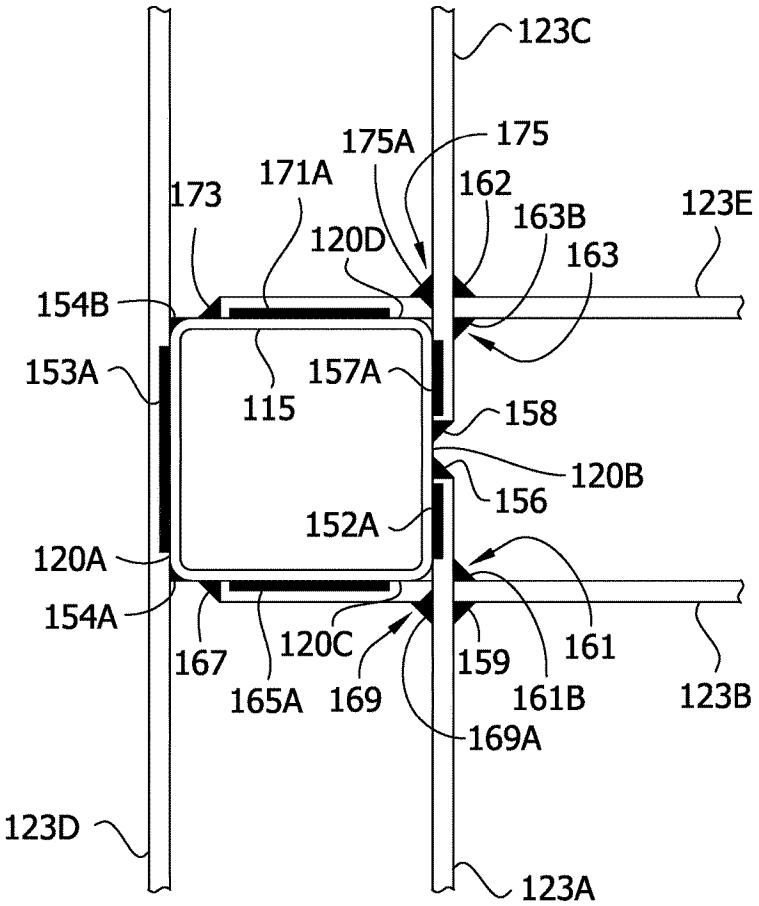
FIG. 37 is the end elevation of FIG. 35 rotated 180° and showing additional welds connecting the fifth gusset plate to the column and to the third gusset plate.
Figure 38:
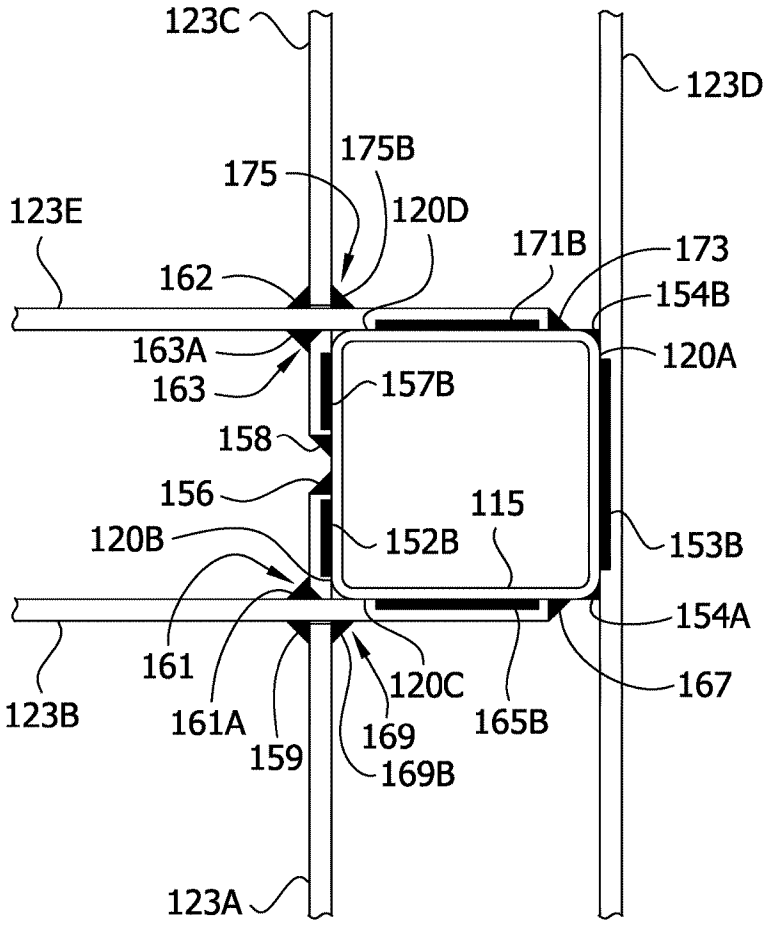
FIG. 38 is an end elevation as seen from the opposite end of the column from that shown in FIG. 37.

The column 115 is rotated 180° to a fourth and final assembly position shown in FIGS. 37 and 38. In this position, the fourth face 120D of the column 115 is directed upward and four further welds are made in the horizontal welding position connecting the fifth gusset plate 123E to the column and to the third gusset plate 123C. The fifth gusset plate 123E is attached to the face 120D by fillet welds 171A, 171B made on opposite edges of the gusset plate 123E spaced apart along the longitudinal axis of the column 115. In addition, a weld 173 along the longitudinal axis of the column 115 attaches an edge of the gusset plate 123E to the fourth face 120D of the column. A weld 175 connects the gusset plate 123E to the gusset plate 123C. The weld 175 is made in the horizontal welding position and extends the full depths of the gusset plates 123C, 123E to further permanently join the gusset plates together. The weld 175 includes two types of welds along its length. Where the weld 175 extends along the bevel 148 of the open slot 147 in the gusset plate 123E, it comprises a partial joint penetration (PJP) groove weld with reinforcing fillet weld, designated 175A, as shown in FIG. 37. Away from the bevel 148 of the open slot 147 in gusset plate 123E, the weld 175 comprises a fillet weld 175B (FIG. 38). Upon completion of the four welds 171A, 171B, 173, 175, the column assembly 113 and the gusset plate assembly 121 are completed.

In the illustrated embodiment of FIGS. 22-38, each of the joint penetration groove welds is a single bevel partial joint penetration (PJP) groove weld in a T-joint configuration with a reinforcing fillet weld, as described above for welds 161A, 163A, 169A and 175A. The partial joint penetration groove welds with reinforcing fillet welds 161A, 163A, 169A, 175A illustrated provide benefits because of their overall economy in making. However, it is to be understood that other joint penetration groove weld types and associated T-joints configurations (with or without beveled gusset plate edges, and with or without a reinforcing fillet weld) may also be used. For example and without limitation, these welds include a single-bevel complete joint penetration (CJP) groove weld, a single J-groove weld and a square-groove weld which might be employed in electro-slag welding applications. The configuration of the groove weld used in a given application may depend upon regional code design requirements. Some regional codes may require the use of a backer bar at the toe (or root) of the groove weld profile, followed by a subsequent removal of the backer bar after placing the weld metal. That may be followed by a back gouge of the root pass of the completed groove weld (with associated non-destructive testing an inspection), and finally the placement of a reinforcing fillet weld to fill the cavity left by back gouging the root pass of the groove weld.

Figure 39:
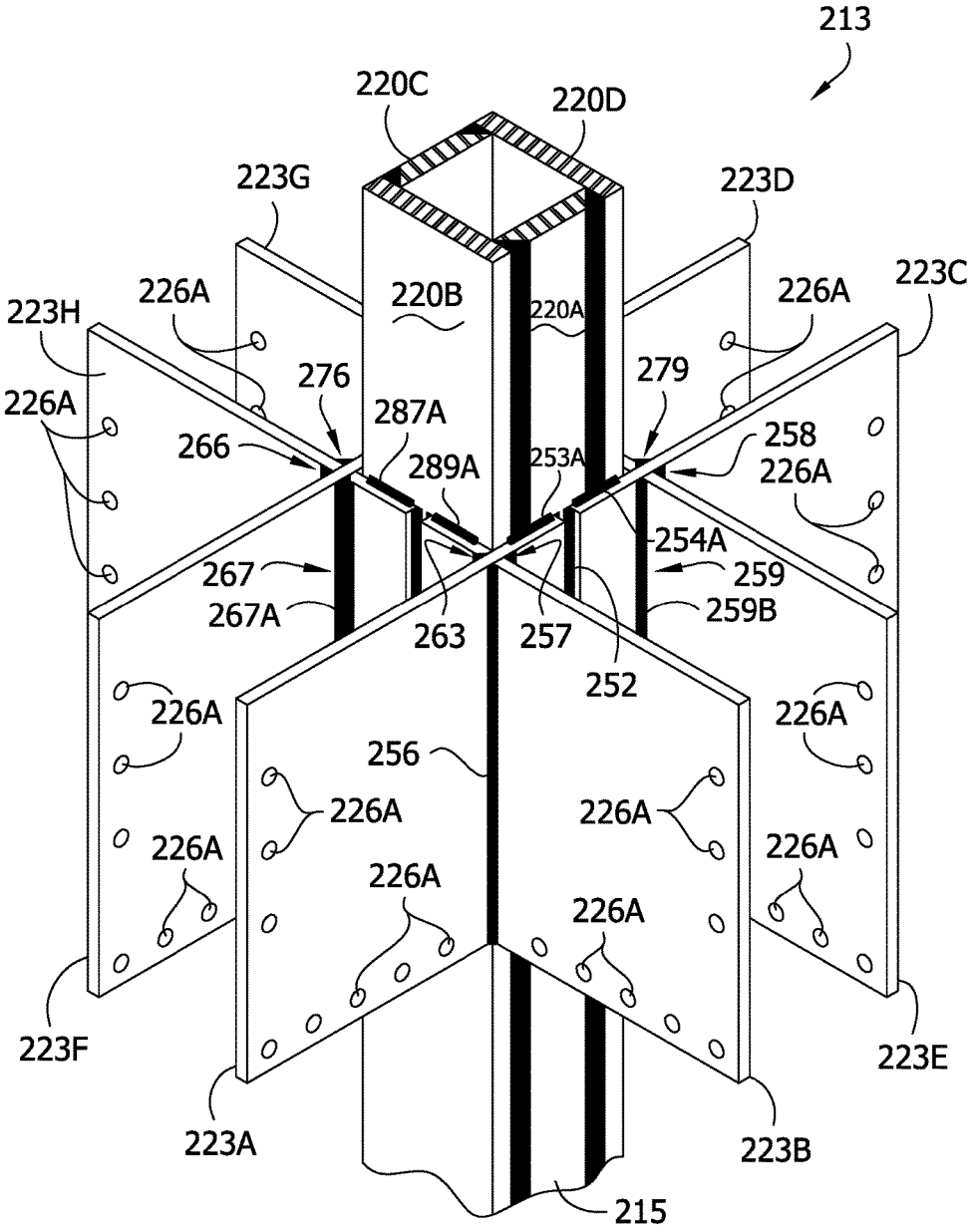
FIG. 39 is a fragmentary perspective of a column assembly including a gusset plate assembly having four distinct interconnected pairs of plates attached to a column.

Referring to FIG. 39, a joint connection structure includes a column assembly 213 configured for connecting four beam assemblies (not shown) to a column 215 in a manner to resist bending moments, as with the column assemblies 13, 113 described above. In this embodiment, the joint connection structure has a 4-sided/4-beam configuration in which four full-length beam assemblies (not shown) can be attached to the column assembly 213. The construction of the column 213 is shown as a built-up box column, rather than an HSS column as shown for columns 13 and 113. It will be understood that the column 213 could be an HSS column or have another construction within the scope of the present invention. The columns 13, 113, 213 may have any suitable construction within the scope of the present invention. The beam assemblies (not shown) mounted by the column assembly 213 may be as described above for the beam assemblies 17, including the described variants. The connection of the beam assemblies to the column assembly 213 may be as shown in FIGS. 1A and 2 or in another suitable manner.

The gusset plate assembly 221 includes gusset plates 223A-223H. Not all of the gusset pates 223A-223H are directly connected to each other. More particularly, the gusset plate assembly 221 of the column assembly 213 includes a first gusset plate 223A, a second gusset plate 223B, a third gusset plate 223C, a fourth gusset plate 223D, a fifth gusset plate 223E, a sixth gusset plate 223F, a seventh gusset plate 223G and an eighth gusset plate 223H. The first gusset plate 223A and second gusset plate 223B are connected to each other and also to respective faces 220A, 220B of the column 215. The third gusset plate 223C and fifth gusset plate 223E are connected to each other and also to respective faces 220A, 220D of the column 215. The fourth gusset plate 223D and seventh gusset plate 223G are connected to each other and also to respective faces 220C, 220D of the column 215. The sixth gusset plate 223F and eighth gusset plate 223H are connected to each other and also to respective faces 220C, 220B of the column 215. The gusset plates 223A-223H extend within planes generally parallel to the longitudinal axis of the column 215 and project laterally outward from the column, and include bolt holes 226A. The gusset plate pairs 223A, 223F and 223B, 223E and 223C, 223D and 223G and 223H each define a space for receiving an end of one of the beam assemblies. As mounted on the column 215, the gusset plates 223A-223H all intersect a single plane perpendicular to the longitudinal axis of the column.

Figure 40:
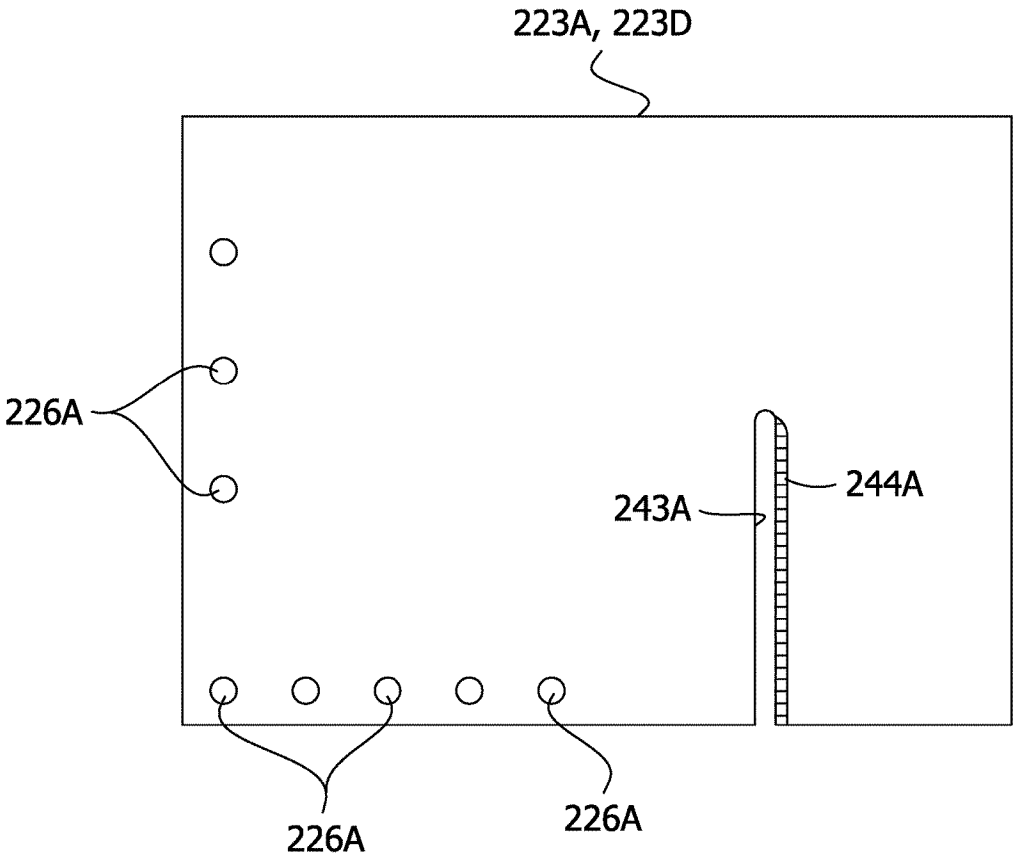
FIG. 40 is a front elevation of a first and a fourth gusset plate of the column assembly of FIG. 39.
Figure 41:
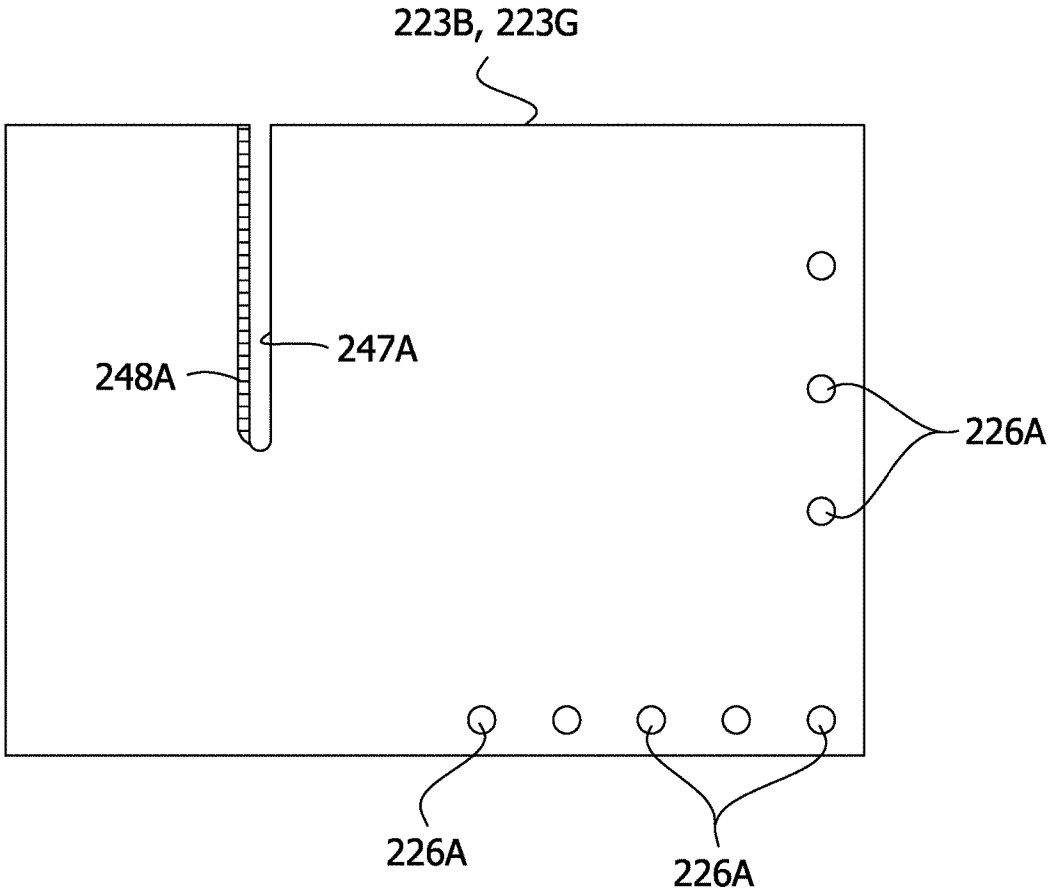
FIG. 41 is a front elevation of a second and seventh gusset plate of the column assembly of FIG. 39.
Figure 42:
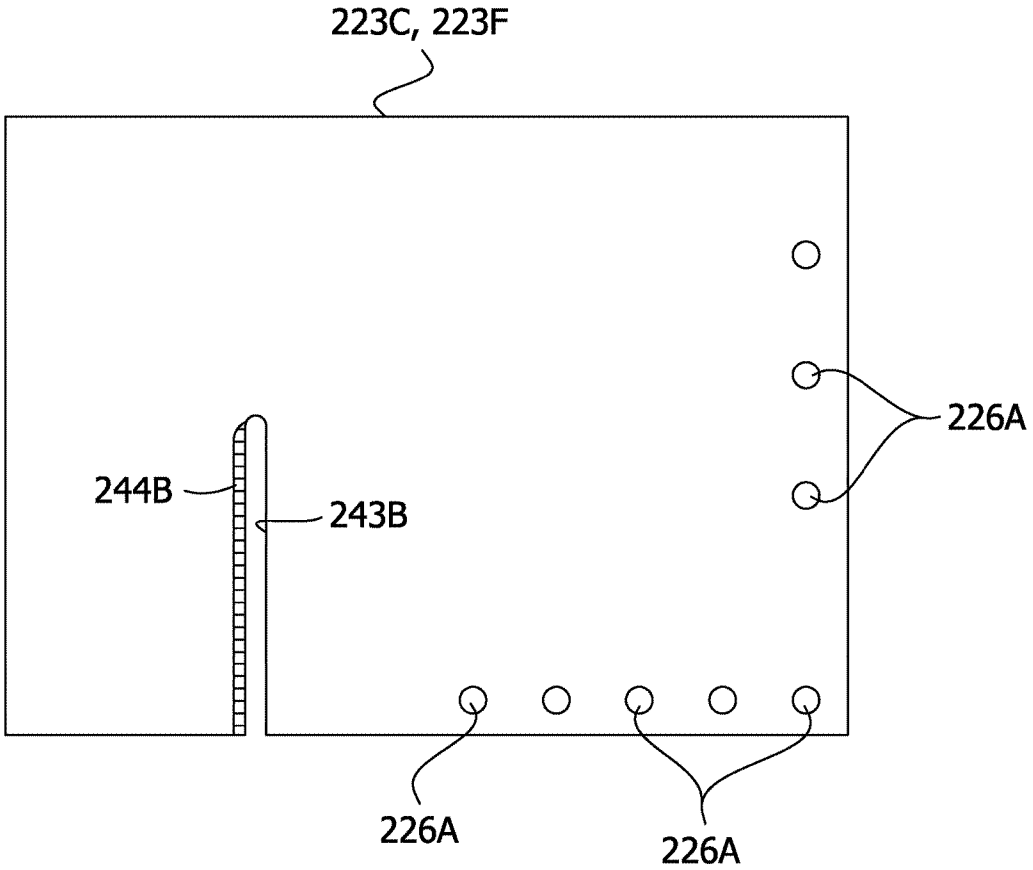
FIG. 42 is a front elevation of a third and sixth gusset plate of the column assembly of FIG. 39.
Figure 43:
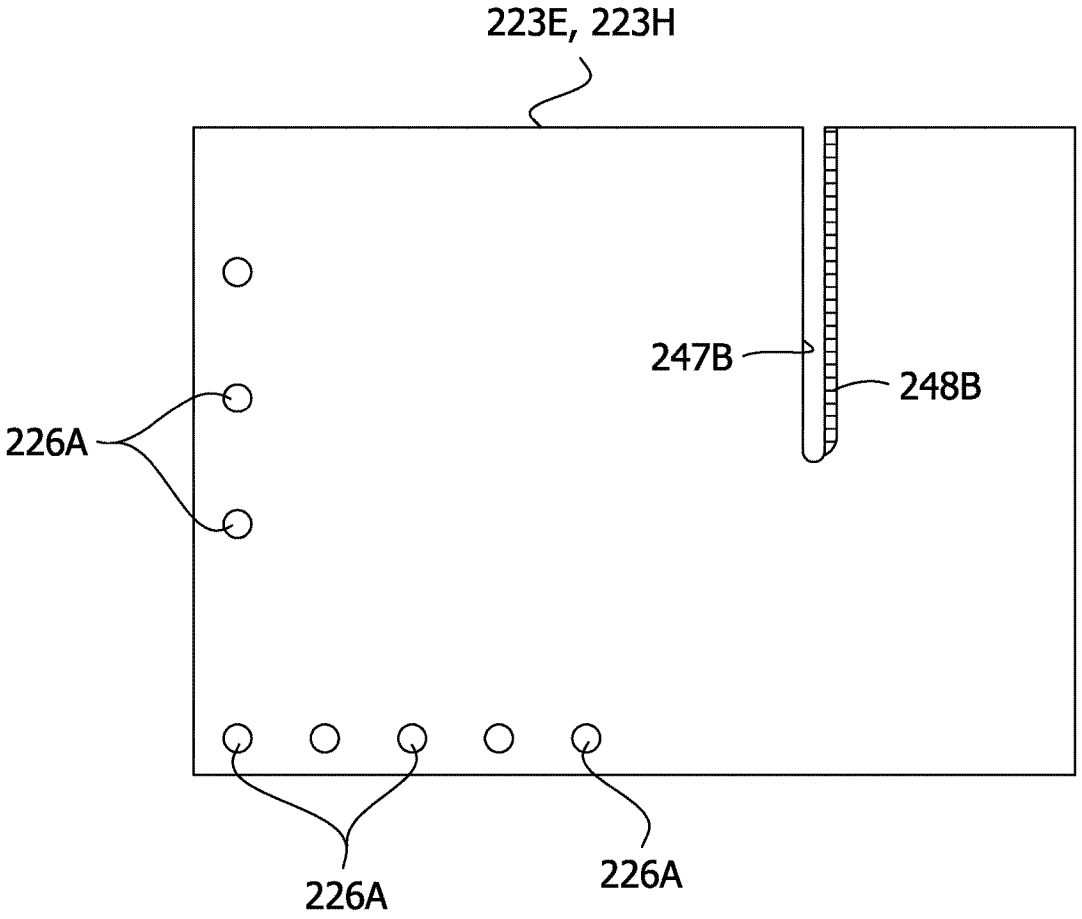
FIG. 43 is a front elevation of a fifth and eighth gusset plate of the column assembly of FIG. 39.

The construction of the gusset plates 223A-223H is shown in FIGS. 40-43. Gusset plate 223A and gusset plate 223D have the same construction and are shown in FIG. 40 as each would appear looking toward the faces 220A and 220C of the column 215, respectively. The gusset plates 223A, 223D each have a single open slot 243A extending from approximately the middle of each gusset plate and opening downwardly at lower, right edge of the plate as oriented in FIG. 40. One edge margin of each of the slots 243A in gusset plates 223A, 223C defining an edge of the open slot forms a bevel 244A that facilitates welding as will be described hereinafter. Gusset plate 223B and gusset plate 223G have the same construction and are shown in FIG. 41 as each would appear looking toward the faces 220B and 220D of the column 215, respectively. The gusset plates 223B, 223G each have a single open slot 247A extending from approximately the middle of each gusset plate and opening upwardly at an upper, left edge of the plates as oriented in FIG. 41. One edge margin of each of the slots 247A in gusset plates 223B, 223G defining an edge of the open slot 247A forms a bevel 248A that facilitates welding. Gusset plates 223C and 223F have the same construction and are illustrated in FIG. 42 as each would appear looking toward the faces 220A and 220C of the column 215, respectively. The gusset plates 223C, 223F each have a single open slot 243B extending from approximately the middle of each gusset plate and opening downwardly at a lower, left edge of the plate as oriented in FIG. 42. One edge margin of each of the slots 243B in gusset plates 223C, 223F defining an edge of the open slot 243B forms a bevel 244B that facilitates welding. Gusset plate 223E and 223H have the same construction and are illustrated in FIG. 43 as each would appear looking toward the faces 220D and 220B of the column 215, respectively. The gusset plates 223E, 223H each have a single open slot 247B extending from approximately the middle of each gusset plate and opening downwardly at an upper, right edge of the plate as oriented in FIG. 43. One edge margin of each of the slots 247B in gusset plates 223E, 223H defining an edge of the open slot 247B forms a bevel 248B that facilitates welding. The open slots 243A, 243B, 247A, 247B of the gusset plates 223A-223H allow the gusset plates to be assembled with each other and with the column 215 as will be described hereinafter.

Figure 44:
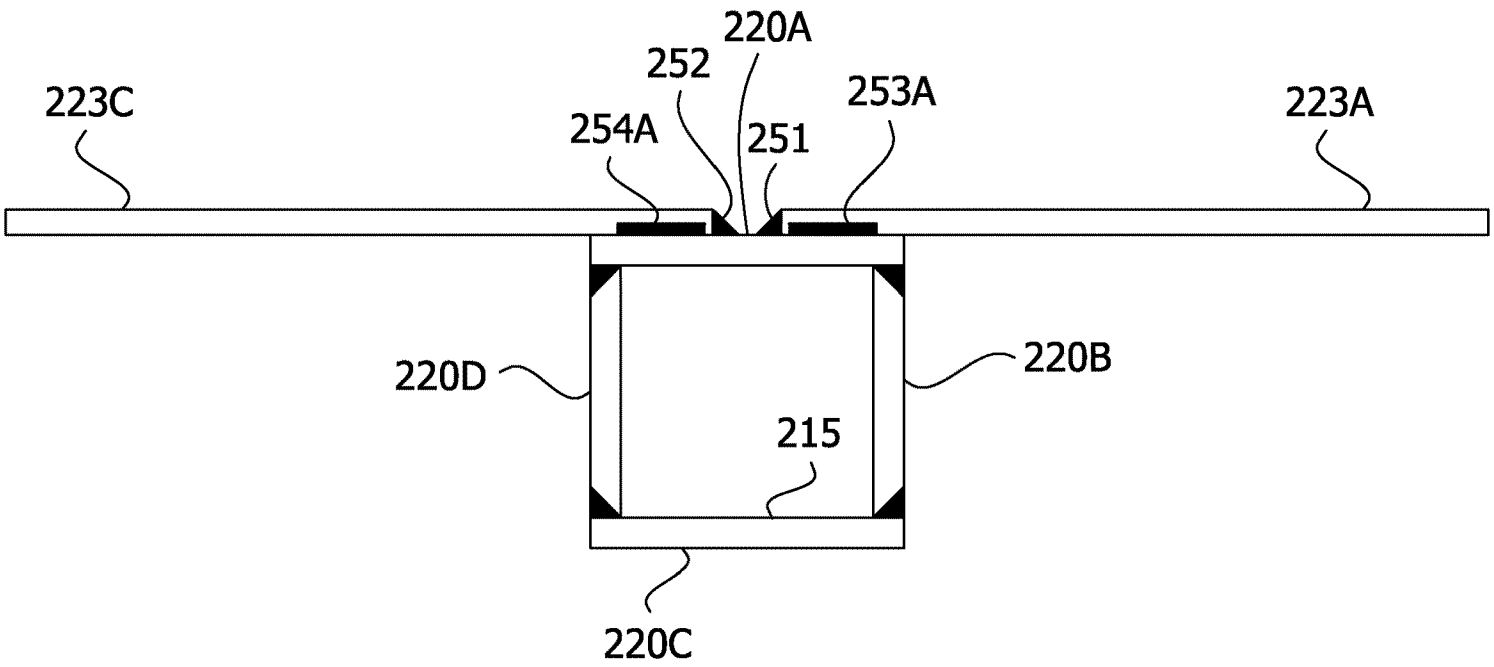
FIG. 44 is an end elevation of a column of the column assembly of FIG. 39 having first and third gusset plates laid on top of the column that is placed in a horizontal position in a first assembly position for initiating construction of a gusset plate assembly on the column.

Referring now to FIGS. 44-52, the column assembly 213 can be put together using an ordered sequence not unlike that used for putting together the column assembly 13, in that the column 215 can be placed in a horizontal position and then turned counterclockwise in 90° increments to four distinct horizontal assembly positions for forming the gusset plate assembly 221. However, similar to the column assembly 113, the gusset plate assembly 221 and column plate assembly 213 are completed at the same time. The construction of the column assembly 213 can be carried out at a fabrication shop using the column 215 as a jig, and later transported to the construction site. The welds made at the fabrication shop can be made exclusively in the horizontal welding position, having the benefits previously described. However, some or all of the welding could be done in other welding positions without departing from the scope of the present invention. As shown in FIG. 44, the column 215 is first oriented in a horizontal position. The first gusset plate 223A is placed in a horizontal position on the column 215 and aligned as needed with respect to the column. A fillet weld 251 is made in the horizontal welding position and extends along the longitudinal axis of the column 215 to connect an edge of the gusset plate 223A extending parallel to the longitudinal axis of the column the face 220A of the column. Linear fillet welds 253A, 253B are made along opposite edges of the gusset plate 223A that are spaced apart along the longitudinal axis of the column 215. The fillet welds 253A, 253B are made in the horizontal welding position and extend transverse to the longitudinal axis of the column 215. The third gusset plate 223C is placed in a horizontal position on the column 215 and aligned as needed with respect to the column. A fillet weld 252 is made in the horizontal welding position and extends along the longitudinal axis of the column 215 to connect an edge of the gusset plate 223C extending parallel to the longitudinal axis of the column the face 220A of the column. Linear fillet welds 254A, 254B are made along opposite edges of the gusset plate 223C that are spaced apart along the longitudinal axis of the column 215. The fillet welds 254A, 254B are made in the horizontal welding position and extend transverse to the longitudinal axis of the column 215.

Figure 45:
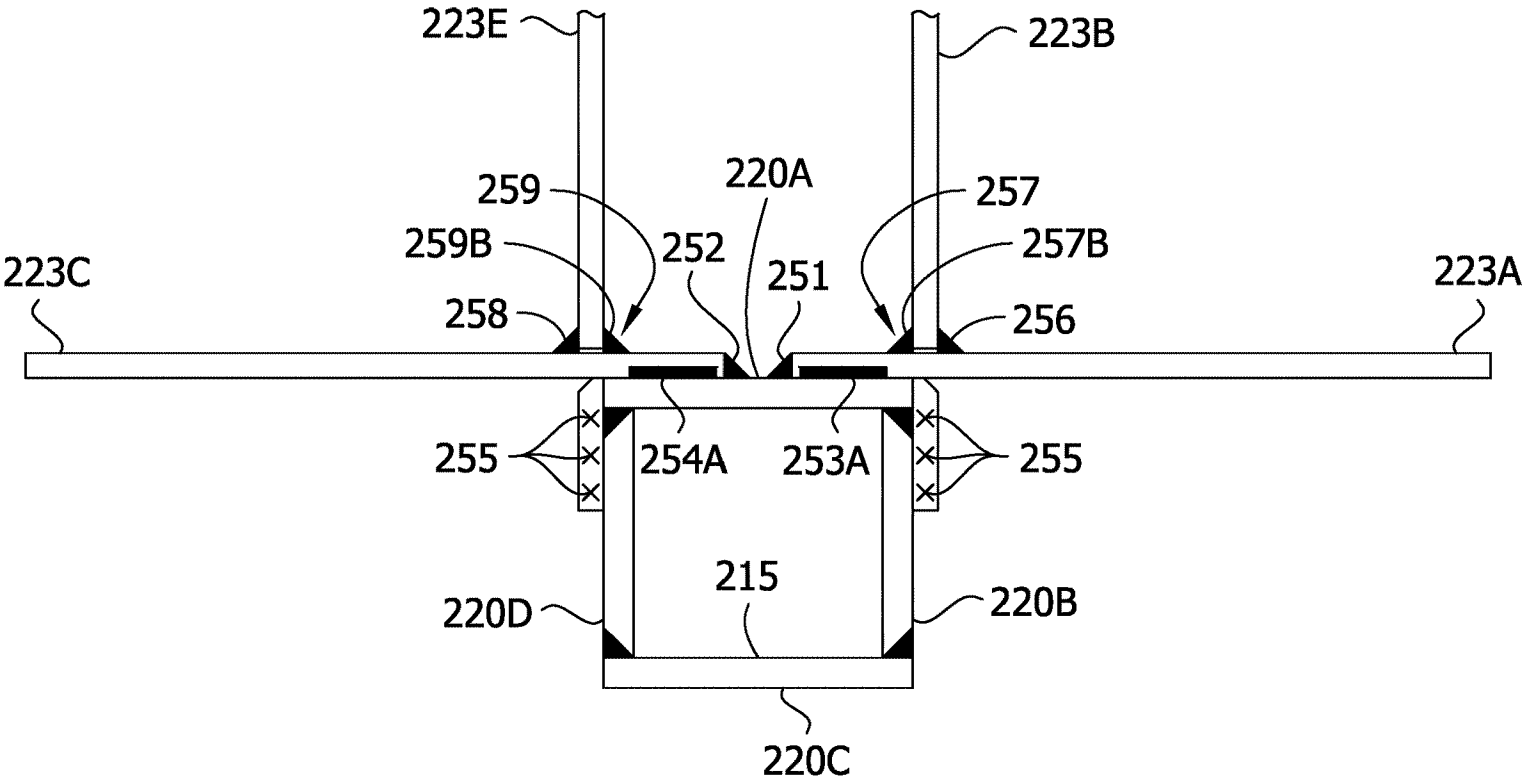
FIG. 45 is the end elevation of FIG. 44 illustrating mating and connection of the third and fifth gusset plates to the column and to each other and additional connections.
Figure 46:
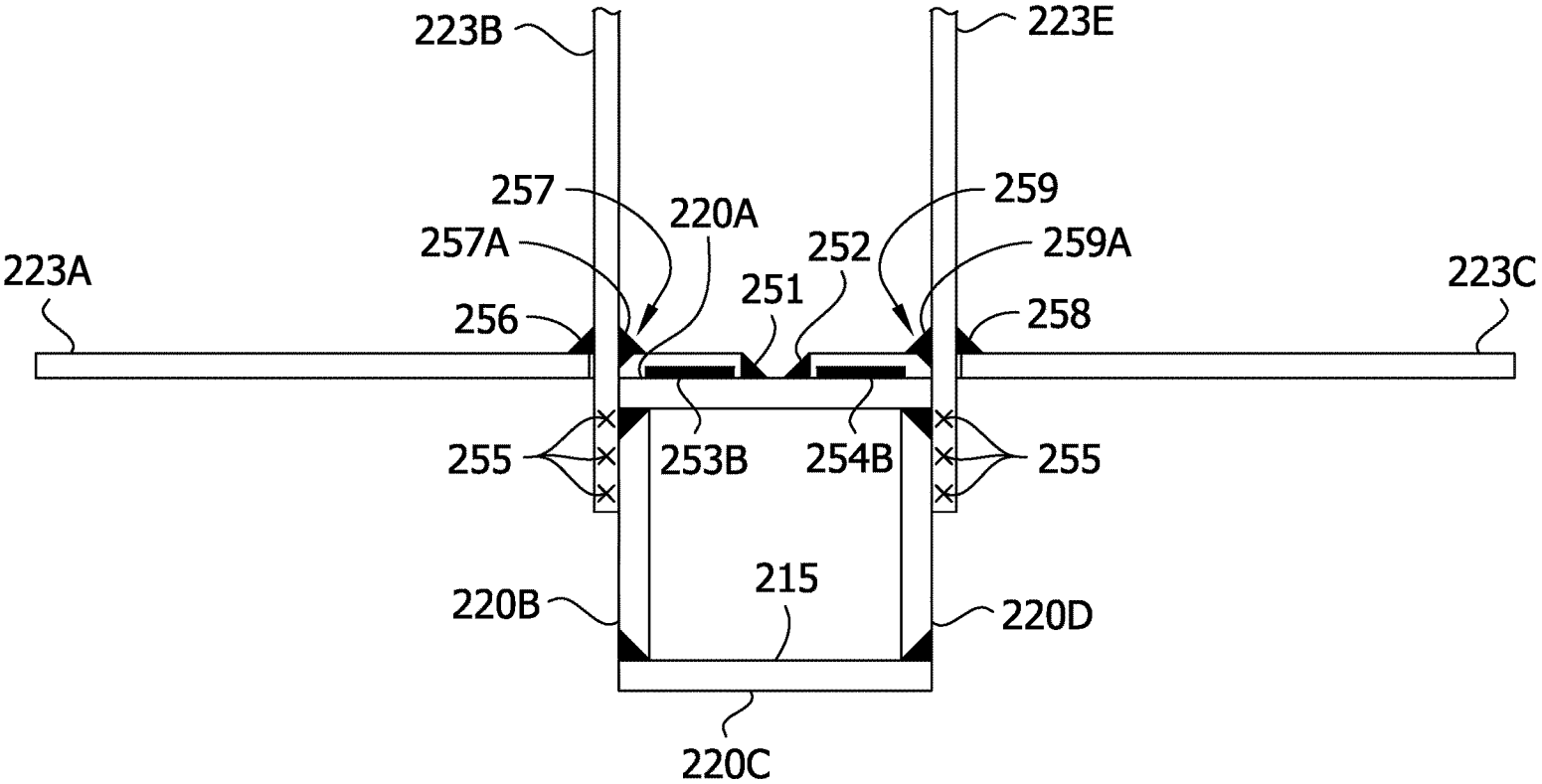
FIG. 46 is an elevation as seen from the opposite end of the column from that shown in FIG. 45.

As shown in FIGS. 45 and 46, the gusset plate 223B is supported (shored) on the gusset plate 223A by inserting the open slot 247A in the gusset plate 223B into the corresponding slot 243A in the gusset plate 223A. As fully mated, the open slot 243A in the gusset plate 223A receives a portion of a the gusset plate 223B, and the open slot 247A in the gusset plate 223B receives a portion of the gusset plate 223A, which provides temporary shoring of the gusset plate 223B on the gusset plate 223A prior to fixedly connecting the two plates together. Using the column 215 as an alignment jig, the gusset plate 223B is aligned on the column. After the gusset plate 223B is supported on the gusset plate 223A in this manner, and plumbness and orthogonal alignment have been achieved, the gusset plate 223B is temporarily attached to face 220B of the column 215 by tack welds 255. A fillet weld 256 is made in the horizontal welding position and extends on the right side of the gusset plate 223B (as oriented in FIG. 45) the full depth of the gusset plates 223A, 223B to join the gusset plates together. A weld 257 located on the left side of the gusset plates 223B (as oriented in FIG. 45) also connects the gusset plates 223A, 223B together. The gusset plate 223E is supported (shored) on the gusset plate 223C by inserting the open slot 247B in the gusset plate 223E into the corresponding slot 243B in the gusset plate 223C. As fully mated, the open slot 243B in the gusset plate 223C receives a portion of a the gusset plate 223E, and the open slot 247B in the gusset plate 223E receives a portion of the gusset plate 223C, which provides temporary shoring of the gusset plate 223E on the gusset plate 223C prior to fixedly connecting the two plates together. Using the column 215 as an alignment jig, the gusset plate 223E is aligned on the column. After the gusset plate 223E is supported on the gusset plate 223C in this manner, and plumbness and orthogonal alignment have been achieved, the gusset plate 223E is temporarily attached to face 220D of the column 215 by tack welds 255. A fillet weld 258 is made in the horizontal welding position and extends on the left side of the gusset plate 223E (as oriented in FIG. 45) the full depth of the gusset plates 223C, 223E to join the gusset plates together. A weld 259 located on the right side of the gusset plates 223E (as oriented in FIG. 45) also connects the gusset plates 223C, 223E together. Each of the welds 257, 259 includes two types of welds along its length. Where the welds 257, 259 extend along the bevels 244A, 244B of the slots 243A, 243B of the gusset plates 223A, 223C, they each comprise a partial joint penetration (PJP) groove weld with reinforcing fillet weld, designated 257A, 259A, respectively as shown in FIG. 46. Away from the bevels 244A, 244B, the welds 257, 259 are fillet welds 257B, 259B, as may be seen in FIG. 45.

Figure 47:
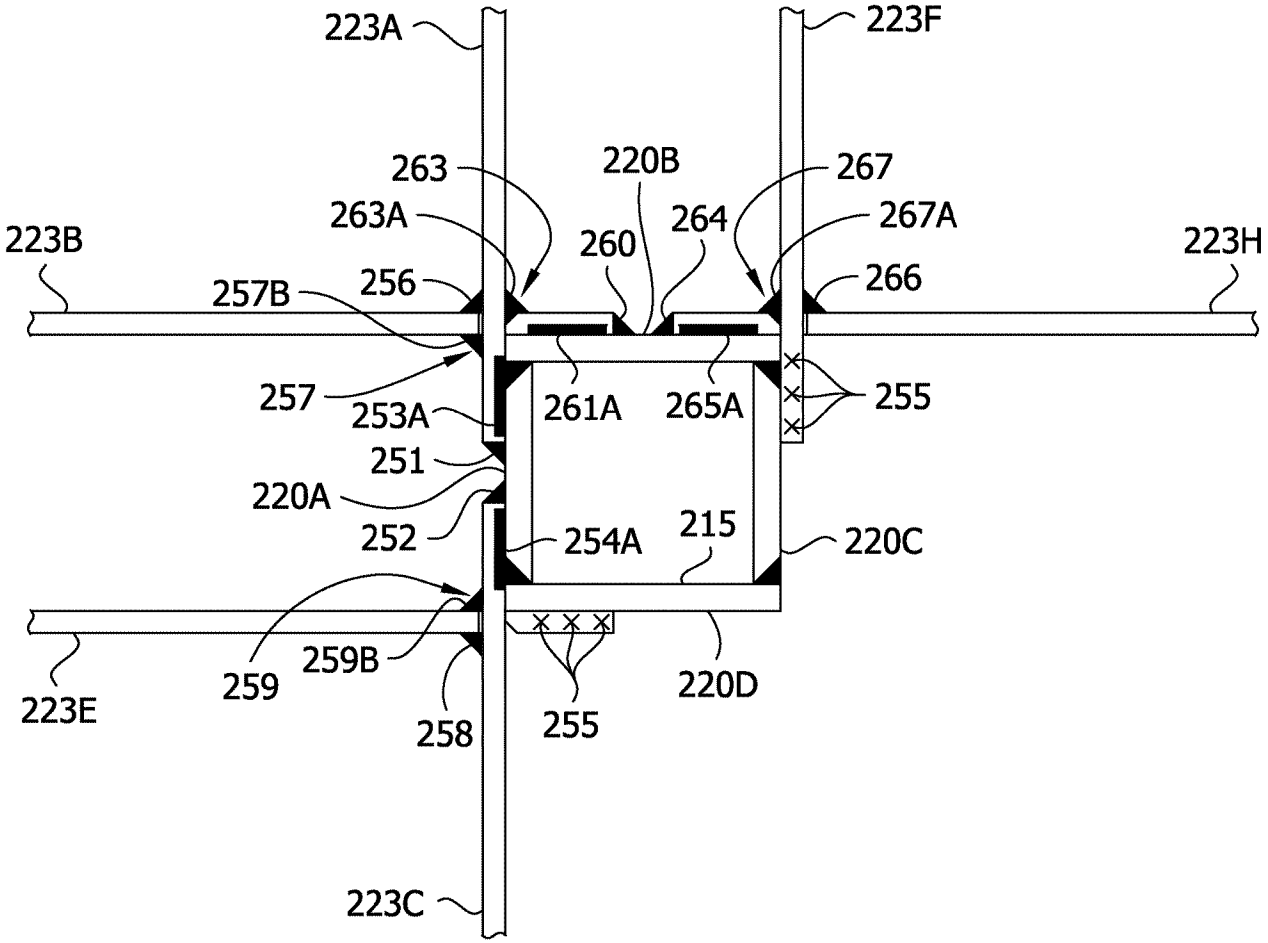
FIG. 47 is the end elevation of FIG. 45 rotated counterclockwise 90° to a second assembly position illustrating mating and connection of the sixth and eighth gusset plates to the column and to each other and additional connections.
Figure 48:
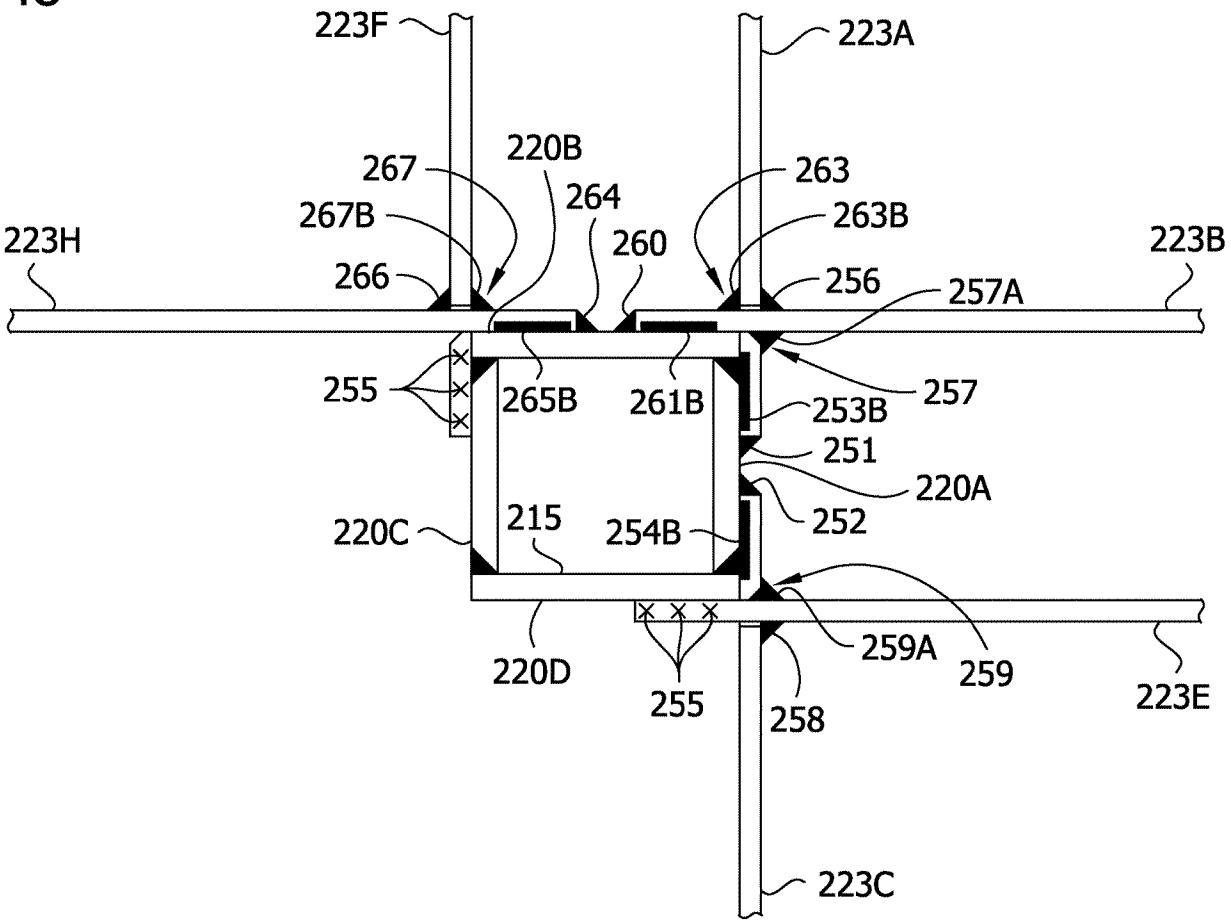
FIG. 48 is an elevation as seen from the opposite end of the column from that shown in FIG. 47.

The column subassembly is then rotated counterclockwise about the longitudinal axis of the column 215, still in a horizontal position, 90° from the first assembly position shown in FIGS. 44 and 45 to a second assembly position shown in FIG. 47. A fillet weld 260 is made in the horizontal welding position and extends along the longitudinal axis of the column 215 to connect an edge of the gusset plate 223B extending parallel to the longitudinal axis of the column to the face 220B of the column. Referring to FIGS. 47 and 48, linear fillet welds 261A, 261B are made along opposite edges of the gusset plate 223B that are spaced apart along the longitudinal axis of the column 215. The fillet welds 261A, 261B are made in the horizontal welding position and extend transverse to the longitudinal axis of the column 215. A weld 263 located on the right side of the gusset plate 223A (as oriented in FIG. 47) further connects the gusset plates 223B, 223A together. The weld 263 includes two types of welds along its length. Where the weld 263 extends along the bevel 248A of the slot 247A of the gusset plate 223B, it comprises a partial joint penetration (PJP) groove weld with reinforcing fillet weld, designated 263A, as shown in FIG. 47. Away from the bevel 248A, the weld 263 is a fillet weld 263B, as may be seen in FIG. 48.

The eighth gusset plate 223H is placed in a horizontal position on the face 220B of the column 215 and aligned as needed with respect to the column. A fillet weld 264 is made in the horizontal welding position and extends along the longitudinal axis of the column 215 to connect an edge of the gusset plate 223H extending parallel to the longitudinal axis of the column to the face 220B of the column. Linear fillet welds 265A, 265B are made along opposite edges of the gusset plate 223H that are spaced apart along the longitudinal axis of the column 215. The fillet welds 265A, 265B are made in the horizontal welding position and extend transverse to the longitudinal axis of the column 215. The gusset plate 223F is then mated with and initially shored on the gusset plate 223H by inserting the open slot 243B in the gusset plate 223F into the corresponding slot 247B in the gusset plate 223H. As fully mated, the open slot 247B in the gusset plate 223H receives a portion of a the gusset plate 223F, and the open slot 243B in the gusset plate 223F receives a portion of the gusset plate 223H, which provides temporary shoring of the gusset plate 223F on the gusset plate 223H prior to fixedly connecting the two plates together. Using the column 215 as an alignment jig, the gusset plate 223F is aligned on the column. After the gusset plate 223F is mated with the gusset plate 223H in this manner, and plumbness and orthogonal alignment have been achieved, the gusset plate 223F is temporarily attached to face 220C of the column 215 by tack welds 255. A fillet weld 266 is made in the horizontal welding position and extends on the right side of the gusset plates 223F (as oriented in FIG. 47) the full depth of the gusset plates 223H, 223F to join the gusset plates together. A weld 267 located on the left side of the gusset plate 223F (as oriented in FIG. 47) also connects the gusset plates 223H, 223F together. The weld 267 includes two types of welds along its length. Where the weld 267 extends along the bevel 248B of the slots 247B of the gusset plate 223H, it comprises a partial joint penetration (PJP) groove weld with reinforcing fillet weld, designated 267A, as shown in FIG. 47. Away from the bevel 244B, the weld 267 is a fillet weld 267B, as may be seen in FIG. 48.

Figure 49:
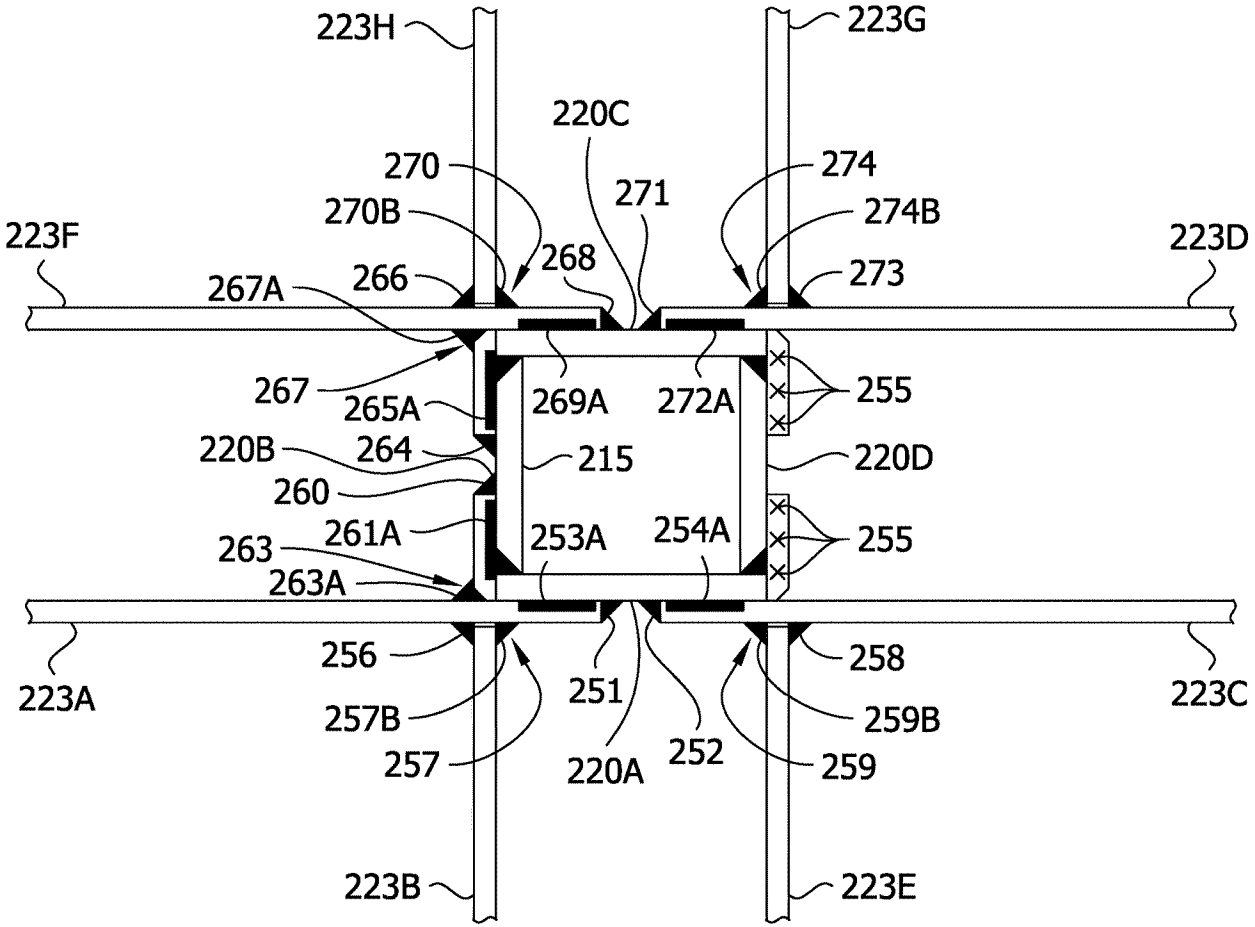
FIG. 49 is the end elevation of FIG. 47 rotated counterclockwise 90° to a third assembly position illustrating mating and connection of the fourth and seventh gusset plates to the column and to each other and additional connections.
Figure 50:
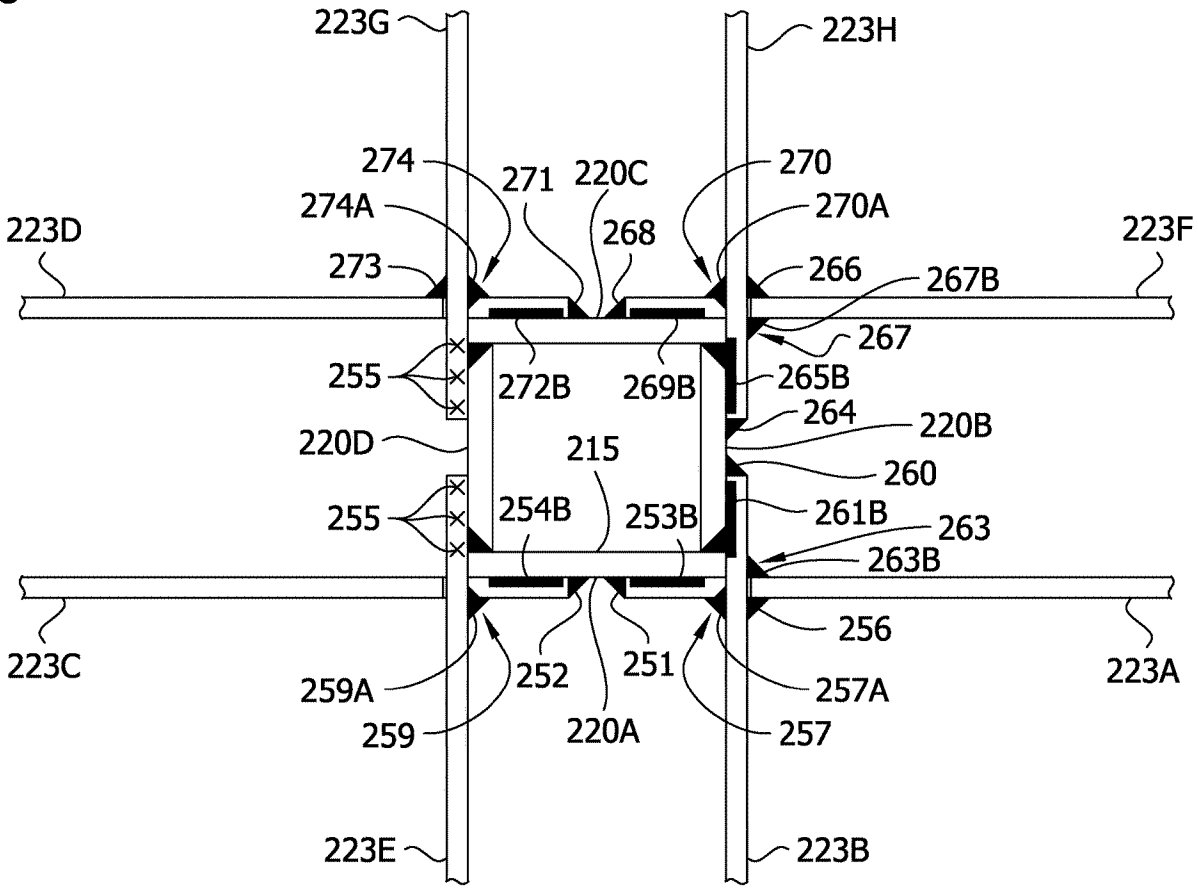
FIG. 50 is an elevation as seen from the opposite end of the column from that shown in FIG. 49.

The column subassembly is then placed in a third assembly position by rotating the column counterclockwise 90° about its longitudinal axis from the second assembly position shown in FIG. 47 to the position shown in FIG. 49. A fillet weld 268 is made in the horizontal welding position and extends along the longitudinal axis of the column 215 to connect an edge of the gusset plate 223F extending parallel to the longitudinal axis of the column to the face 220C of the column. Referring to FIGS. 49 and 50, linear fillet welds 269A, 269B are made along opposite edges of the gusset plate 223F that are spaced apart along the longitudinal axis of the column 215. The fillet welds 269A, 269B are made in the horizontal welding position and extend transverse to the longitudinal axis of the column 215. A weld 270 located on the right side of the gusset plate 223H (as oriented in FIG. 49) further connects the gusset plates 223F, 223H together. The weld 270 includes two types of welds along its length. Where the weld 270 extends along the bevel 244B of the slot 243B of the gusset plate 223F, it comprises a partial joint penetration (PJP) groove weld with reinforcing fillet weld, designated 270A, as shown in FIG. 50. Away from the bevel 244B, the weld 270 is a fillet weld 270B, as may be seen in FIG. 49.

The fourth gusset plate 223D is placed in a horizontal position on the face 220C of the column 215 and aligned as needed with respect to the column. A fillet weld 271 is made in the horizontal welding position and extends along the longitudinal axis of the column 215 to connect an edge of the gusset plate 223D extending parallel to the longitudinal axis of the column the face 220C of the column. Linear fillet welds 272A, 272B are made along opposite edges of the gusset plate 223D that are spaced apart along the longitudinal axis of the column 215. The fillet welds 272A, 272B are made in the horizontal welding position and extend transverse to the longitudinal axis of the column 215. The seventh gusset plate 223G is then mated with and initially shored on the gusset plate 223D by inserting the open slot 248A in the gusset plate 223G into the corresponding slot 243A in the gusset plate 223D. As fully mated, the open slot 243A in the gusset plate 223D receives a portion of a the gusset plate 223G, and the open slot 248A in the gusset plate 223G receives a portion of the gusset plate 223D, which provides temporary shoring of the gusset plate 223G on the gusset plate 223D prior to fixedly connecting the two plates together. Using the column 215 as an alignment jig, the gusset plate 223G is aligned on the column. After the gusset plate 223G is mated with the gusset plate 223D in this manner, and plumbness and orthogonal alignment have been achieved, the gusset plate 223G is temporarily attached to face 220D of the column 215 by tack welds 255. A fillet weld 273 is made in the horizontal welding position and extends on the right side of the gusset plates 223G (as oriented in FIG. 49) the full depth of the gusset plates 223D, 223G to join the gusset plates together. A weld 274 located on the left side of the gusset plate 223G (as oriented in FIG. 49) also connects the gusset plates 223D, 223G together. The weld 274 includes two types of welds along its length. Where the weld 274 extends along the bevel 244A of the slot 243A of the gusset plate 223D, it comprises a partial joint penetration (PJP) groove weld with reinforcing fillet weld, designated 274A, as shown in FIG. 50. Away from the bevel 244A, the weld 274 is a fillet weld 274B, as may be seen in FIG. 49.

Figure 51:
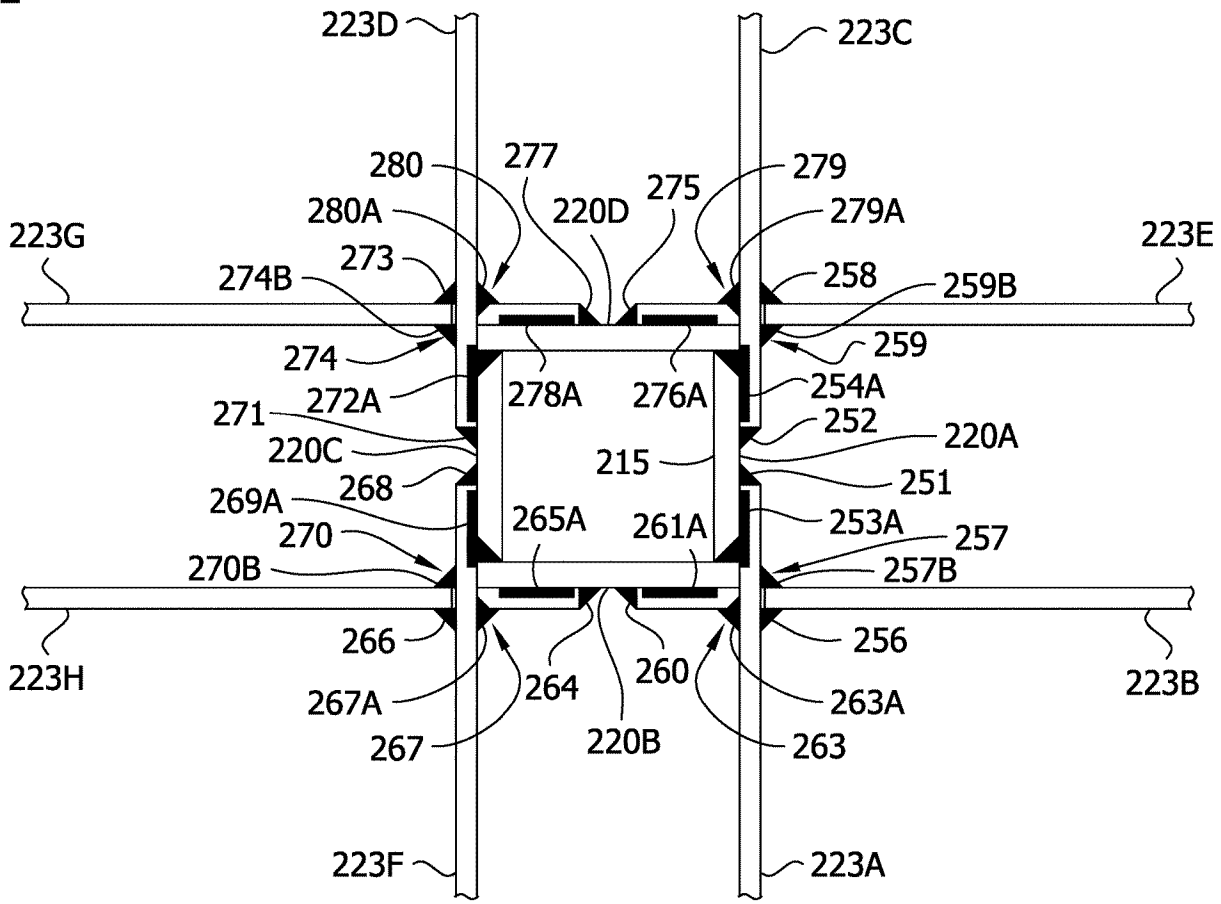
FIG. 51 is the end elevation of FIG. 49 rotated counterclockwise 90° to a third assembly position illustrating final connection of the fourth and seventh and third and fifth gusset plates to the column and to each other.
Figure 52:
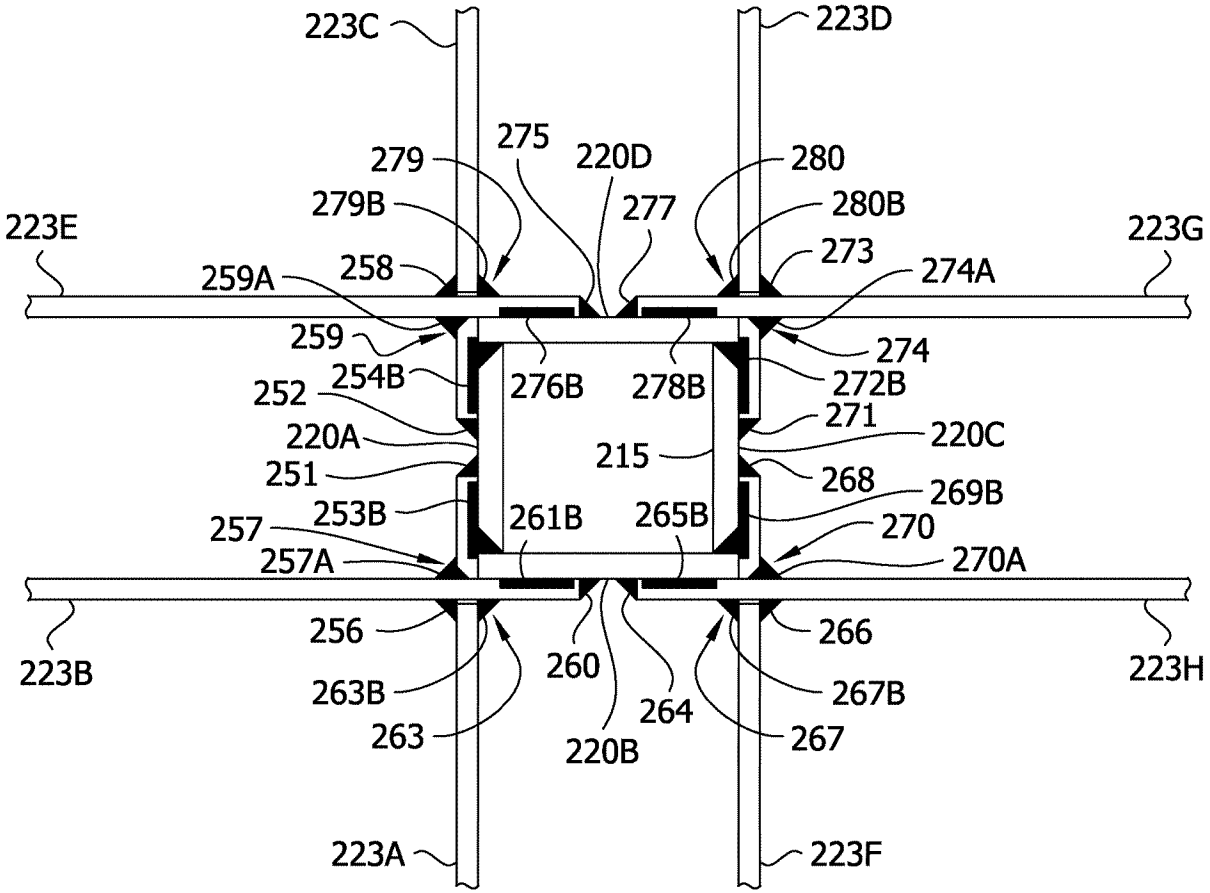
FIG. 52 is an elevation as seen from the opposite end of the column from that shown in FIG. 51.

All of the gusset plates 223A-223H have been connected to the column 215 after the steps described in relation to FIGS. 49 and 50 have been carried out. In order to make the final welds to complete the column assembly 213 in the horizontal welding position, the column 215 is rotated from the third assembly position shown in FIG. 49 to a fourth assembly position shown in FIG. 51. As before, this is accomplished by rotating the column counterclockwise 90° about its longitudinal axis, while remaining in a horizontal position to locate the face 220D of the column in an upwardly directed orientation. A fillet weld 275 is made in the horizontal welding position and extends along the longitudinal axis of the column 215 to connect an edge of the gusset plate 223E extending parallel to the longitudinal axis of the column the face 220D of the column. Referring now also to FIG. 52, linear fillet welds 276A, 276B are made along opposite edges of the gusset plate 223E that are spaced apart along the longitudinal axis of the column 215. The fillet welds 276A, 276B are made in the horizontal welding position and extend transverse to the longitudinal axis of the column 215. A fillet weld 277 is made in the horizontal welding position and extends along the longitudinal axis of the column 215 to connect an edge of the gusset plate 223G extending parallel to the longitudinal axis of the column the face 220D of the column. Linear fillet welds 278A, 278B are made along opposite edges of the gusset plate 223G that are spaced apart along the longitudinal axis of the column 215. The fillet welds 278A, 278B are made in the horizontal welding position and extend transverse to the longitudinal axis of the column 215. A weld 279 located on the left side of the gusset plate 223C (as oriented in FIG. 51) also connects the gusset plates 223C, 223E together. A weld 280 located on the right side of the gusset plate 223D (as oriented in FIG. 51) connects the gusset plates 223D, 223G together. Each of the welds 279, 280 includes two types of welds along their lengths. Where the welds 279, 280 extend along the bevels 248B, 248A of the slots 247B, 247A of the gusset plates 223E, 223G, they each comprise a partial joint penetration (PJP) groove weld with reinforcing fillet weld, designated 279A, 280A, respectively as shown in FIG. 51. Away from the bevels 248B, 248A, the welds 279, 280 are fillet welds 279B, 280B, as may be seen in FIG. 52. These final welds complete the formation of the gusset plate assembly 221 and of the column assembly 213.

The completed column assembly 213 can be transported from a fabrication shop where it was constructed to a worksite to become part of a building framework, like the building framework 1 shown in FIG. 1. It will be understood that the precise order of construction can be varied from that described for column assembly 213 without departing from the scope of the present invention. For example, the precise order in which the welds are made in each assembly position could be changed while retaining the advantage of all of the welds being made in the horizontal welding position. Moreover, the partial joint penetration groove weld with reinforcing fillet welds described in the construction of the column assembly 213 provide benefits because of their overall economy in making. However, it is to be understood that other joint penetration groove weld types and associated T-joints configurations can also be used (with or without beveled gusset plate edges, and with or without a reinforcing fillet weld). For example and without limitation, these welds include a single-bevel complete joint penetration (CJP) groove weld, a double bevel groove weld, a single J-groove weld, a double J-groove weld and a square-groove weld which might be employed in electro-slag welding applications.

Figure 53:
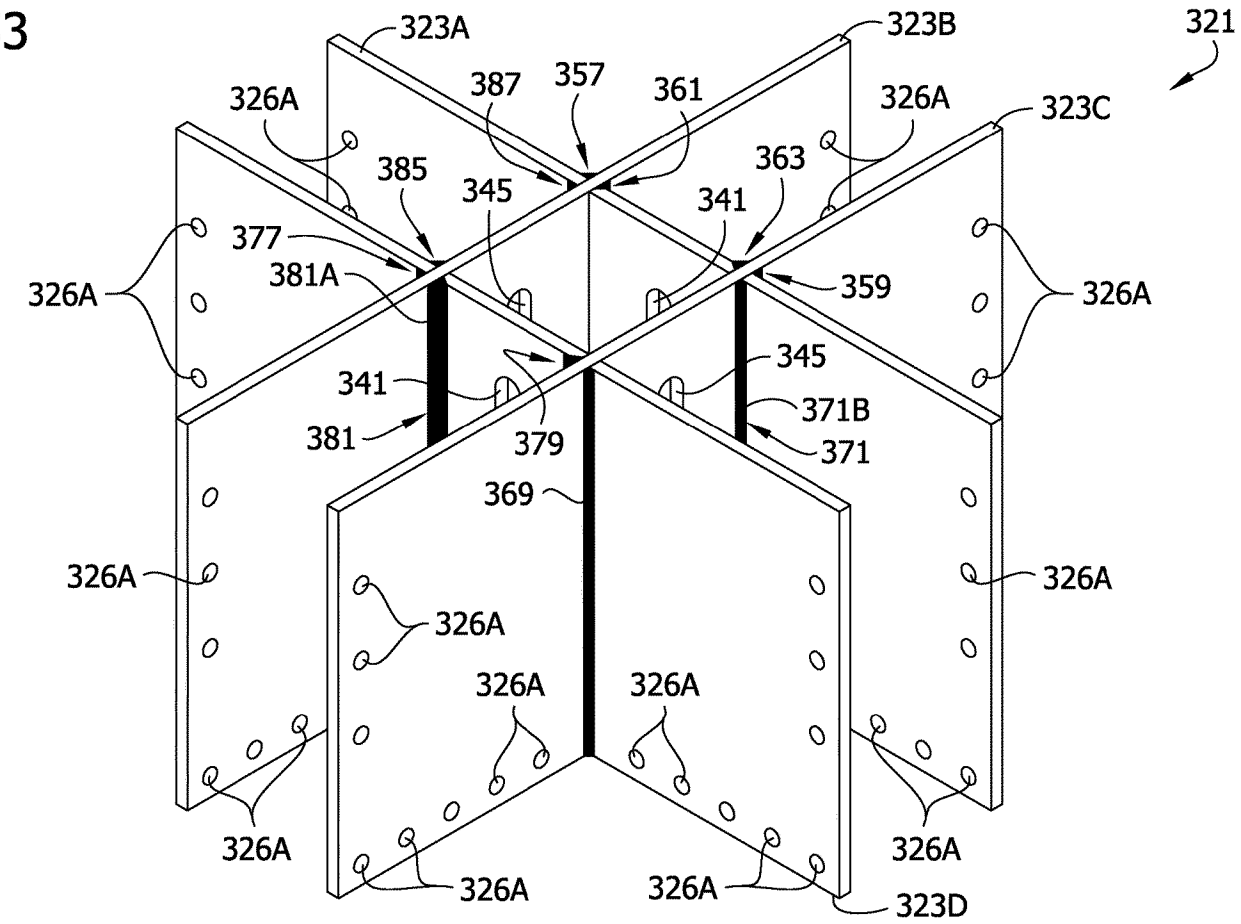
FIG. 53 is a perspective of a gusset plate assembly formed with joint penetration groove welds.
Figure 54:
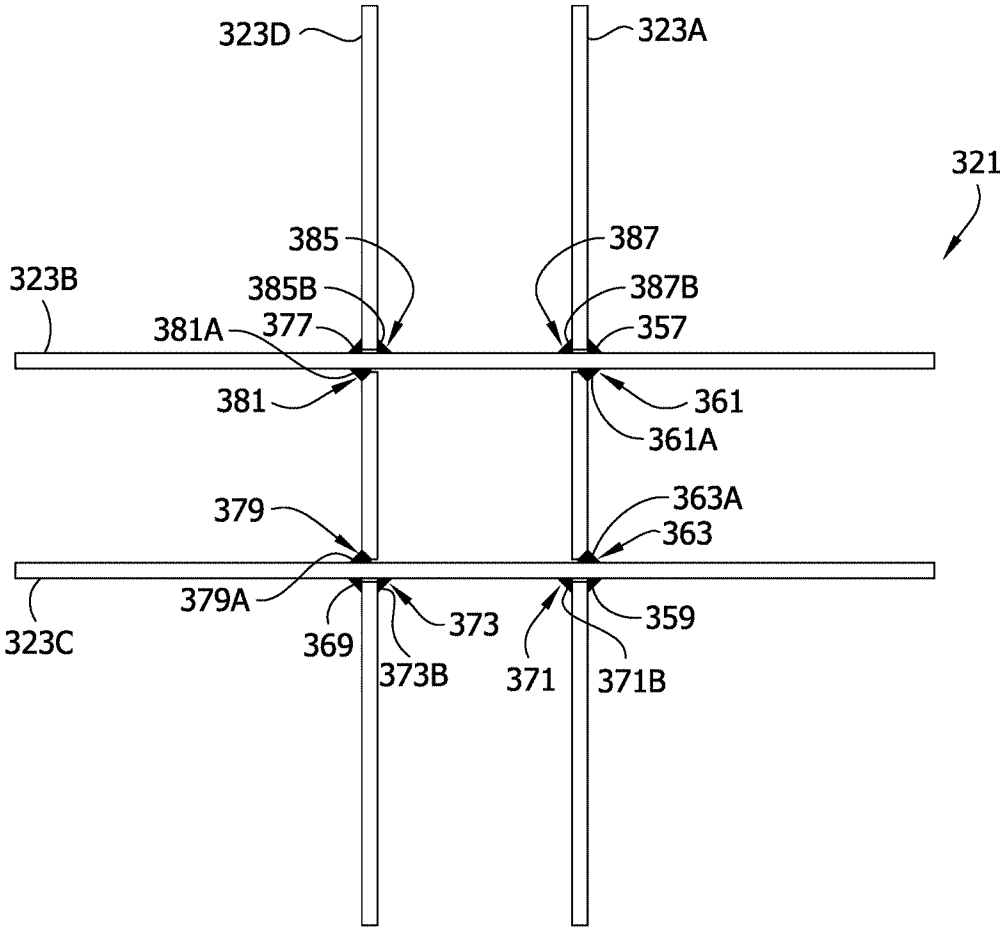
FIG. 54 is a top plan view of the gusset plate assembly of FIG. 53.
Figure 55:
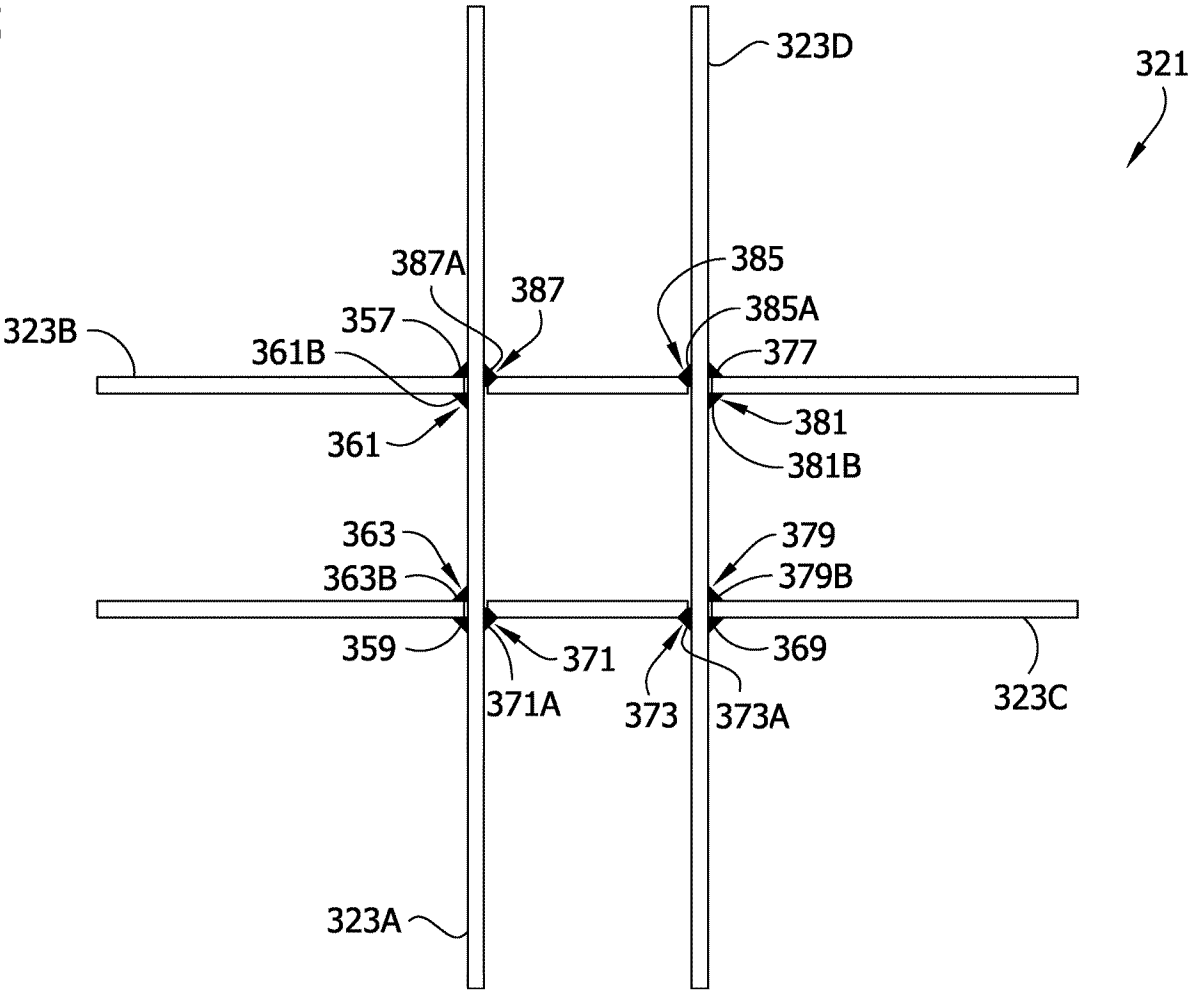
FIG. 55 is a bottom plan view of the gusset plate assembly of FIG. 53.

Aspects of the construction of gusset plate assemblies 21, 121, 221 assembled using the columns 15, 115, 215 as part of the column assemblies 13, 113, 213 described previously herein also provide benefit in the construction of a gusset plate assembly 321 shown in FIGS. 53-55 that is formed independently of any column. It will be appreciated that the configuration of the gusset plate assembly 321 is substantially identical to the gusset plate assembly 21 of column assembly 13, but the gusset plate assembly 321 is formed separately from any column and then later mated with and welded to a column. Gusset plate assemblies of this type are described in coassigned U.S. patent application Ser. No. 14/729,957.

Referring to FIG. 53, the gusset plate assembly 321 includes four gusset plates 323A-323D having the same construction as the gusset plates 23A-23D shown in FIGS. 4 and 5. Interior apertures 341 and 345 used for connecting the gusset plate assembly to a column (not shown) may be seen in FIG. 53. Instead of using a column as a jig, other suitable jigging (not shown) may be used to assembly the gusset plates 323A-323D independently of the column. The slots (not shown in FIG. 53) of the gusset plates 323A-323D allow the plates to be mated prior to any fixed connection between the plates. It will be understood that all four plates may be mated together before any weld or other fixing connection is made, or that welds may be made at the time each new gusset plate is mated with the gusset plates previously mated with each other. For convenience, the welds will be described so as to correspond to the welds described for interconnecting the gusset plates 23A-23D. However, the order of making the welds for the gusset plate assembly 321 can be the same as or different from that described for making the gusset plate assembly 21. Referring to FIGS. 54 and 55, it may be seen that the gusset plate 323A is attached to the gusset plate 323B using a fillet weld 357 extending the full depths of the gusset plates. The gusset plate 323B is further fixedly joined with gusset plate 323A using welds 361 and 387. As illustrated, these welds include two different types of welds. Where the weld 361 extends along a portion of the slot in the gusset plate 323A having a beveled edge, it is a partial joint penetration (PJP) groove weld with reinforcing fillet weld 361A (FIG. 54). Away from the bevel associated with the slot in the gusset plate 323A, the weld 361 is a fillet weld 361B (FIG. 55). Similarly, where the weld 387 extends along a portion of the slot in the gusset plate 323B having a beveled edge, it is a partial joint penetration (PJP) groove weld with reinforcing fillet weld 387A (FIG. 55). Away from the bevel associated with the slot in the gusset plates 323B, the weld 387 is a fillet weld 387B (FIG. 54).

The gusset plate 323A is attached to the gusset plate 323C using a fillet weld 359 extending the full depths of the gusset plates. The gusset plate 323C is further fixedly joined with gusset plate 323A using welds 363 and 371. As illustrated, these welds include two different types of welds. Where the weld 363 extends along a portion of the slot in the gusset plate 323A having a bevel, it is a partial joint penetration (PJP) groove weld with reinforcing fillet weld 363A (FIG. 54). Away from the bevel associated with the slot in the gusset plate 323A, the weld 363 is a fillet weld 363B (FIG. 55). Similarly, where the weld 371 extends along a portion of the slot in the gusset plate 323C having a bevel, it is a partial joint penetration (PJP) groove weld with reinforcing fillet weld 371A (FIG. 55). Away from the bevel associated with the slot in the gusset plates 323C, the weld 371 is a fillet weld 371B (FIG. 54). Gusset plate 323C is fixedly connected to gusset plate 323D with a fillet weld 369 extending the full depths of the gusset plates. The gusset plate 323D is further fixedly joined with gusset plate 323C using welds 373 and 379. As illustrated, these welds include two different types of welds. Where the weld 373 extends along a portion of the slot in the gusset plate 323C having a beveled edge, it is a partial joint penetration (PJP) groove weld with reinforcing fillet weld 373A (FIG. 55). Away from the bevel associated with the slot in the gusset plate 323C, the weld 373 is a fillet weld 373B (FIG. 54). Similarly, where the weld 379 extends along a portion of the slot in the gusset plate 323D having a beveled edge, it is a partial joint penetration (PJP) groove weld with reinforcing fillet weld 379A (FIG. 54). Away from the bevel associated with the slot in the gusset plates 323D, the weld 379 is a fillet weld 379B (FIG. 55).

Proceeding around the gusset plate assembly 321, the gusset plate 323B is fixedly connected to the gusset plate 323D with a fillet weld 377 extending the full depths of the gusset plates. The gusset plate 323D is further fixedly joined with gusset plate 323B using welds 381 and 385. As illustrated, these welds include two different types of welds. Where the weld 381 extends along a portion of the slot in the gusset plate 323D having a beveled edge, it is a partial joint penetration (PJP) groove weld with reinforcing fillet weld 381A (FIG. 54). Away from the bevel associated with the slot in the gusset plate 323D, the weld 381 is a fillet weld 381B (FIG. 55). The portion of weld 385 extending along a portion of the slot in the gusset plate 323B having a beveled edge is a partial joint penetration groove weld with reinforcing fillet weld 385A (FIG. 55). Away from the bevel associated with the slot in the gusset plate 323B, the weld 385 is a fillet weld 385B (FIG. 54).

The gusset plate assembly 321 configured in this manner with groove welds as described, has the strength needed to function in a moment-resisting joint connection structure in building framework without requiring any welds to be made on interior corners of the gusset plate assembly. In particular, the joint penetration groove welds formed on exterior corners of intersecting gusset plates provides the necessary strength for the gusset plate assembly in the absence of any welds on the interior corners of the gusset plate assembly. As a result, the gusset plate assembly 321 can be fit up snugly to the column without physical interference with the corner of the column that might be present if a weld was located on an interior corner of the gusset plate assembly. Particularly when built-up box columns are used, the sharp right angle corners do not permit room for internal welds of a gusset plate assembly. It will be understood that welds on the internal corners of a gusset plate assembly may be used within the scope of the present invention. The partial joint penetration groove welds with reinforcing fillet welds illustrated provide benefits because of their overall economy in making. However, it is to be understood that other joint penetration groove weld types and associated T-joints configurations can also be used (with or without beveled gusset plate edges, and with or without a reinforcing fillet weld may be used. For example and without limitation, these welds include a single-bevel complete joint penetration (CJP) groove weld, a double bevel groove weld, a single J-groove weld, a double J-groove weld and a square-groove weld which might be employed in electro-slag welding applications.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements. The use of numerical identifiers such as "first," "second," "third," and so on to distinguish components and/or steps is done for convenience in describing the embodiments. However, the particular designation of a component or step in the Detailed Description in this way does not require the component to be identified by the same numerical identifier in the claims.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

Bi-axial, moment resisting beam-to-column joint connection structures and column assemblies that are constructed according to the principles of the present invention provide numerous unique features, benefits and advantages. Reference is made to the figures illustrating some of the embodiments to which the advantages and benefits apply. This invention uniquely provides for a direct load transfer of beam flange forces to the sidewalls of the hollow tubular column.

What is claimed is:

1. A method of fabricating a column assembly including a hollow tubular column and connected gusset plates configured to form bi-axial moment connections with beams in a building framework, the method comprising using the column as a jig to locate gusset plates for assembling a gusset plate assembly of the gusset plates, connecting at least some of the gusset plates located by the column to the column, connecting at least some of the gusset plates to each other to form the gusset plate assembly, the connection of the gusset plates to each other being separate from the connection of the gusset plates to the column, wherein the step of using the column as a jig comprises orienting the column in a horizontal position, connecting a first of the gusset plates to the column with the first gusset plate in a horizontal position, rotating the column about its longitudinal axis and connecting a second of the gusset plates to the column with the second gusset plate in a horizontal position.

2. The method as set forth in claim 1 further comprising using the first of the gusset plates connected to the column as a jig for positioning the second of the gusset plates on the column when the column is in a horizontal position and prior to the second gusset plate being connected to the column.

3. The method as set forth in claim 2 wherein using the first of the gusset plates as a jig comprises mating the second gusset plate with the first gusset plate.

4. The method as set forth in claim 3 wherein mating the second gusset plate with the first gusset plate comprises receiving a portion of at least one of a first and second gusset plates in an open slot in another of the first and second gusset plates.

5. The method as set forth in claim 3 wherein mating the second gusset plate with the first gusset plate comprises receiving a portion of the second gusset plate in an open slot in the first gusset plate and receiving a portion of the first gusset plate in an open slot in the second gusset plate.

6. The method as set forth in claim 2 further comprising using the first gusset plate connected to the column as a jig for positioning a third of the gusset plates on the column prior to the third gusset plate being connected to the column.

7. The method as set forth in claim 6 further comprising using the second and third gusset plates as a jig for positioning a fourth of the gusset plates on the column prior to the fourth gusset plate being connected to the column.

8. The method as set forth in claim 7 wherein mating the fourth gusset plate with the second and third gusset plates comprises receiving a portion of the fourth gusset plate in an open slot in the second gusset plate and receiving another portion of the fourth gusset plate in an open slot in the third gusset plate.

9. The method as set forth in claim 7 further comprising the steps of welding the second gusset plate to the first gusset plate, welding the third gusset plate to the first gusset plate, and welding the fourth gusset plate to the second and third gusset plates to form the gusset plate assembly surrounding the column.

10. The method as set forth in claim 9 wherein welding the second gusset plate to the first gusset plate, welding the third gusset plate to the first gusset plate and welding the fourth gusset plate to the second and third gusset plates each includes forming a joint penetration groove weld.

11. The method as set forth in claim 10 wherein forming a joint penetration groove weld comprises forming a partial joint penetration groove weld with reinforcing fillet weld.

12. The method as set forth in claim 9 further comprising welding the first, second, third and fourth gusset plates to the column.

13. The method as set forth in claim 12 wherein welding the first, second, third and fourth gusset plates to the column comprises for each of the gusset plates forming first and second welds extending transverse to the longitudinal axis along opposite edges of each of the gusset plates, and forming a weld to the column through an interior aperture of the gusset plate.

14. The method as set forth in claim 9 wherein the welding of the first, second, third and fourth gusset plates to each other and welding the first, second third and fourth gusset plates to the column is accomplished entirely by welding in the horizontal welding position.

15. The method as set forth in claim 1 wherein connection of the gusset plates to each other comprises forming a joint penetration groove weld on an exterior corner formed by an intersection of the gusset plates.

16. The method as set forth in claim 15 further comprising leaving an interior corner formed by the intersection of the gusset plates free of any weld in the finished column assembly.

17. The method as set forth in claim 1 further comprising rotating the column about its longitudinal axis and connecting a third of the gusset plates to the column with the third gusset plate in a horizontal position.

18. The method as set forth in claim 17 further comprising rotating the column about its longitudinal axis and connecting a fourth of the gusset plates to the column with the fourth gusset plate in a horizontal position.

19. The method as set forth in claim 2 further comprising connecting a third and a fourth gusset plate to the column.

20. The method as set forth in claim 19 further comprising using the third gusset plate connected to the column as a jig to position a fifth gusset plate on the column prior to the fifth gusset plate being connected to the column.

21. The method as set forth in claim 20 wherein connecting the fourth gusset plate to the column comprises welding the fourth gusset plate to a first face of the column in a position where opposite end margins of the plate project outward from opposite side walls of the column.

22. The method as set forth in claim 21 wherein using the column as a jig comprises placing the column in a horizontal position with the first face of the column directed upward, the step of connecting the fourth gusset plate to the first face comprising locating the fourth gusset plate on the first face of the column so that the fourth gusset plate is supported in a generally horizontal position on the column and welding the fourth gusset plate to the first face of the column in a horizontal welding position.

23. The method as set forth in claim 22 wherein the step of connecting the fourth gusset plate to the column is carried out prior to connection of any other gusset plate of the gusset plate assembly to the column.

24. The method as set forth in claim 22 further comprising rotating the column 180° about a longitudinal axis of the column so that a second face of the column is directed upward.

25. The method as set forth in claim 24 wherein connecting the fourth gusset plate to the column comprises welding the fourth gusset plate to corners of the column adjacent the fourth gusset plate in a horizontal welding position when the column is in the position where the second face of the column is directed upward and prior to connecting the first and third gusset plates to the column.

26. The method as set forth in claim 24 wherein connecting the first gusset plate to the column comprises welding the first gusset plate to the second face of the column in a horizontal welding position, and connecting the third gusset plate to the column comprises welding the third gusset plate to the second face of the column in a horizontal welding position.

27. The method as set forth in claim 26 wherein welding the first gusset plate to the second face of the column comprises making welds connecting the first gusset plate to the second face of the column along opposite edges of the first gusset plate, the welds extending transverse to the longitudinal axis of the column, and making a weld connecting the first gusset plate to the second face of the column extending parallel to the longitudinal axis of the column, and wherein welding the third gusset plate to the second face of the column comprises making welds connecting the third gusset plate to the second face of the column along opposite edges of the third gusset plate, the welds extending transverse to the longitudinal axis of the column, and making a weld connecting the third gusset plate to the second face of the column extending parallel to the longitudinal axis of the column.

28. The method as set forth in claim 24 further comprising welding the second gusset plate to the first gusset plate and welding the fifth gusset plate to the third gusset plate in a horizontal welding position, each of welding the second gusset plate to the first gusset plate and welding the fifth gusset plate to the third gusset plate comprising forming a joint penetration groove weld.

29. The method as set forth in claim 28 wherein forming a joint penetration groove weld comprises forming a partial joint penetration groove weld with reinforcing fillet weld.

30. The method as set forth in claim 24 further comprising rotating the column 90° about the longitudinal axis of the column so that a third face of the column is directed upward and welding the second gusset plate to the third face of the column in a horizontal welding position.

31. The method as set forth in claim 30 wherein welding the second gusset plate to the third face of the column comprises making welds connecting the second gusset plate to the third face of the column along opposite edges of the second gusset plate, the welds extending transverse to the longitudinal axis of the column, and making a weld connecting the second gusset plate to the third face of the column extending parallel to the longitudinal axis of the column.

32. The method as set forth in claim 30 further comprising welding the second gusset plate to the first gusset plate on an upward face of the second gusset plate along an edge of an interior face of the first gusset plate intersecting the upward face of the second gusset plate in a horizontal welding position using a joint penetration groove weld.

33. The method as set forth in claim 31 further comprising rotating the column 180° about the longitudinal axis of the column so that a fourth face of the column is directed upward and welding the fifth gusset plate to the fourth face of the column in a horizontal welding position.

34. The method as set forth in claim 33 wherein welding the fifth gusset plate to a fourth face of the column comprises making welds connecting the fifth gusset plate to the fourth face of the column along opposite edges of the fifth gusset plate, the welds extending transverse to the longitudinal axis of the column, and making a weld connecting the fifth gusset plate to the fourth face of the column extending parallel to the longitudinal axis of the column.

35. The method as set forth in claim 33 further comprising welding the third gusset plate to the fifth gusset plate on the upward face of the fifth gusset plate along an edge of the interior face of the third gusset plate intersecting the upward face of the fifth gusset plate in a horizontal welding position, wherein welding the third gusset plate to the fifth gusset plate comprises forming a joint penetration groove weld.

36. The method as set forth in claim 35 wherein forming the penetration groove weld comprises forming a partial joint penetration groove weld with reinforcing fillet weld.

37. The method as set forth in claim 20 further comprising using the fourth gusset plate connected to the column as a jig to position a sixth gusset plate on the column prior to the sixth gusset plate being connected to the column.

38. The method as set forth in claim 37 further comprising connecting a seventh gusset plate to the column and using the seventh gusset plate as a jig to position an eighth gusset plate on the column prior to the eighth gusset plate being secured to the column.

39. The method as set forth in claim 2 wherein the first and second gusset plates are connected to an outer surface of the column.

40. A method of fabricating a column assembly including a hollow tubular column and connected gusset plates configured to form bi-axial moment connections with beams in a building framework, the method comprising using the column as a jig to locate gusset plates for assembling a gusset plate assembly of the gusset plates, connecting at least some of the gusset plates located by the column to the column, connecting at least some of the gusset plates to each other to form the gusset plate assembly, the connection of the gusset plates to each other being separate from the connection of the gusset plates to the column, the method further comprising using a first of the gusset plates connected to the column as a jig for positioning a second of the gusset plates on the column prior to the second gusset plate being connected to the column, connecting a third and a fourth gusset plate to the column, using the third gusset plate connected to the column as a jig to position a fifth gusset plate on the column prior to the fifth gusset plate being connected to the column, wherein connecting the fourth gusset plate to the column comprises welding the fourth gusset plate to a first face of the column in a position where opposite end margins of the fourth gusset plate project outward from opposite side walls of the column.

* * * * *